US008141485B2

(12) United States Patent
Eckert et al.

(10) Patent No.: US 8,141,485 B2
(45) Date of Patent: Mar. 27, 2012

(54) PRINTING MACHINE SYSTEM

(75) Inventors: Günther Oskar Eckert, Zellingen (DE); Burkard Otto Herbert, Würzburg (DE)

(73) Assignee: Koenig & Bauer Aktiengesellschaft, Wurzberg (DE)

( * ) Notice: Subject to any disclaimer, the term of this patent is extended or adjusted under 35 U.S.C. 154(b) by 908 days.

(21) Appl. No.: 11/922,489

(22) PCT Filed: Aug. 17, 2006

(86) PCT No.: PCT/EP2006/065417

§ 371 (c)(1),
(2), (4) Date: Dec. 19, 2007

(87) PCT Pub. No.: WO2007/020285

PCT Pub. Date: Feb. 22, 2007

(65) Prior Publication Data

US 2009/0031907 A1 Feb. 5, 2009

Related U.S. Application Data

(60) Provisional application No. 60/750,357, filed on Dec. 15, 2005.

(30) Foreign Application Priority Data

Aug. 18, 2005 (DE) ..... 10 2005 039 073
May 3, 2006 (DE) ..... 10 2006 020 322

(51) Int. Cl.
*B41F 13/54* (2006.01)
*B41F 13/56* (2006.01)

(52) U.S. Cl. ..... 101/228; 101/221; 270/20.1

(58) Field of Classification Search ..... 101/180, 101/181, 220, 221, 227, 228; 270/5.01, 10, 270/2.07
See application file for complete search history.

(56) References Cited

U.S. PATENT DOCUMENTS 1,240,011 A * 9/1917 Bechman ..... 270/5.01
(Continued)

FOREIGN PATENT DOCUMENTS

CH 208359 1/1940
(Continued)

OTHER PUBLICATIONS

Kipphan, Helmut, "Handbuch der Printmedien, Technologien und Produktionsverfahren," Springer.
Braun, Alexander, "Atlas des Zeitungs- und Jllustrationsdruckes," Polygraph Verlag GMBH (Frankfurt, Germany).

*Primary Examiner* — Leslie J Evanisko
*Assistant Examiner* — Marissa Ferguson Samreth
(74) *Attorney, Agent, or Firm* — Mattingly & Malur, P.C.

(57) ABSTRACT

A printing system is provided with a first printing machine that includes at least one printing unit and a first folding funnel which is located at an exit of the printing unit. A second printing machine, with a second printing unit and a drier, together with a folding funnel at its exit, is also part of the printing system. The first and second folding funnels differ from each other in the number of formers that are placed next to each other in a machine plane, or vary in an effective width of one or more folders. A web, or a partial web, which is printed by the second printing unit, and which is guided through the drier, can be guided either to the second folding funnel structure, or can be guided to the first folding funnel structure, which differs from the second funnel structure in at least one of numbers and width.

60 Claims, 26 Drawing Sheets

U.S. PATENT DOCUMENTS

| | | | | |
|---|---|---|---|---|
| 1,240,014 | A * | 9/1917 | Bechman | 270/8 |
| 1,972,506 | A | 9/1934 | Wood | |
| 2,170,526 | A | 8/1939 | Barber | |
| 5,117,753 | A | 6/1992 | Mamberer | |
| 5,647,582 | A | 7/1997 | Shiba | |
| 5,676,056 | A | 10/1997 | Stein et al. | |
| 6,832,549 | B2 * | 12/2004 | Satoh | 101/228 |
| 6,892,635 | B2 | 5/2005 | Herbert | |
| 6,899,026 | B2 | 5/2005 | Weis | |
| 7,159,514 | B2 | 1/2007 | Eckert et al. | |
| 7,845,276 | B2 * | 12/2010 | Eckert et al. | 101/424.1 |
| 2006/0187472 | A1 | 8/2006 | Elschner et al. | |
| 2008/0116625 | A1 * | 5/2008 | Stein et al. | 270/41 |

FOREIGN PATENT DOCUMENTS

| | | | |
|---|---|---|---|
| DE | 443 745 | | 5/1927 |
| DE | 40 12 396 | A1 | 10/1991 |
| DE | 102 38 010 | A1 | 3/2004 |
| DE | 20 2005 010 058 | | 11/2005 |
| EP | 0 452 704 | A2 | 3/1991 |
| EP | 0 741 020 | A2 | 11/1996 |
| EP | 1145850 | * | 10/2001 |
| EP | 1391410 | * | 2/2004 |
| EP | 1 683 634 | A1 | 7/2006 |
| WO | WO 03/031182 | A1 | 4/2003 |
| WO | WO 2004/024448 | A1 | 3/2004 |

* cited by examiner

Fig. 3a
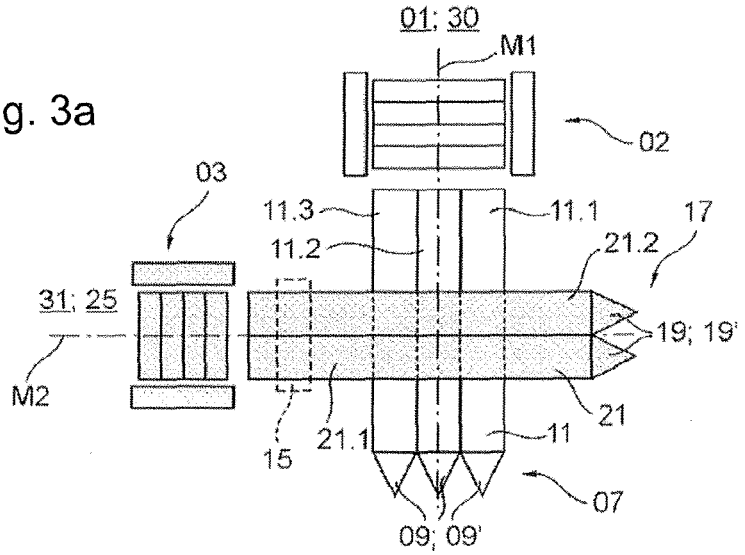
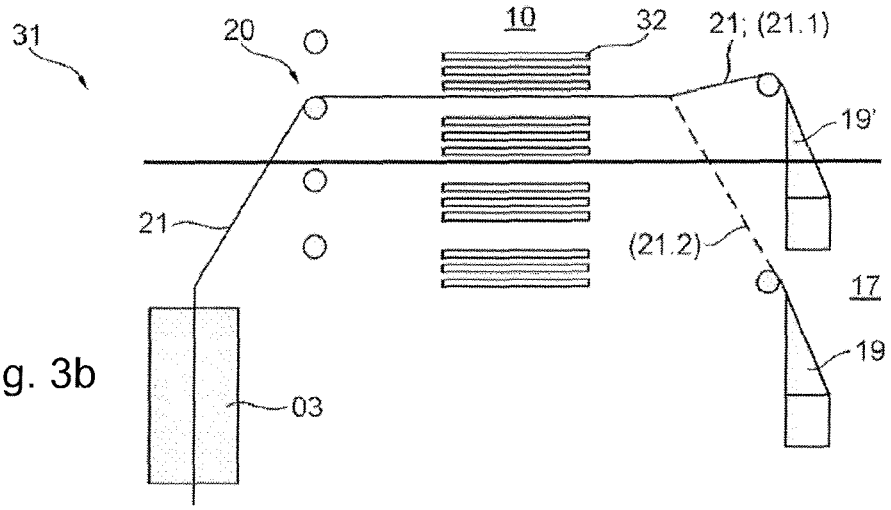
Fig. 3b
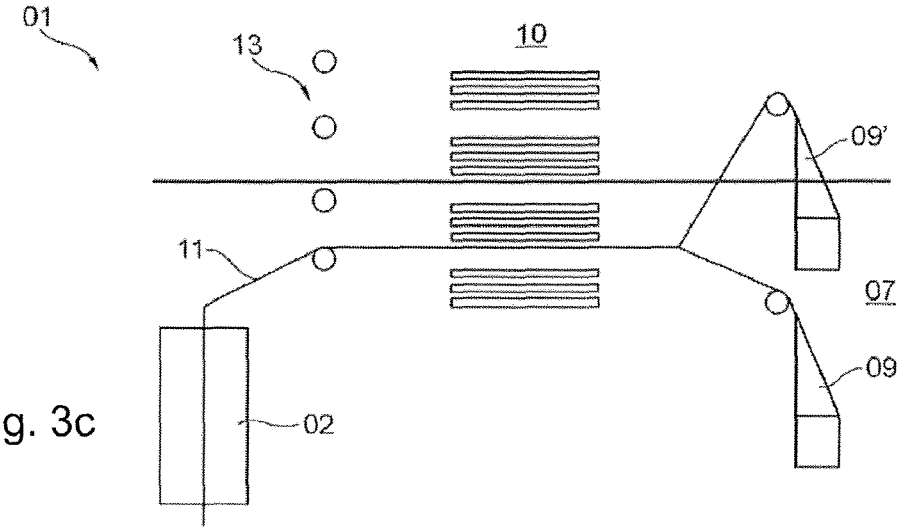
Fig. 3c 01
02
03
05
07
09
09'
10
12
15
17
19; 19'
21
26
27
31
42
T2
A
B
C
D
R11
R12
R13
R14
R15
R16
R17
R18

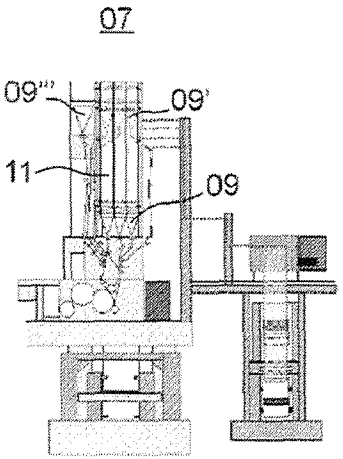
Fig, 23b
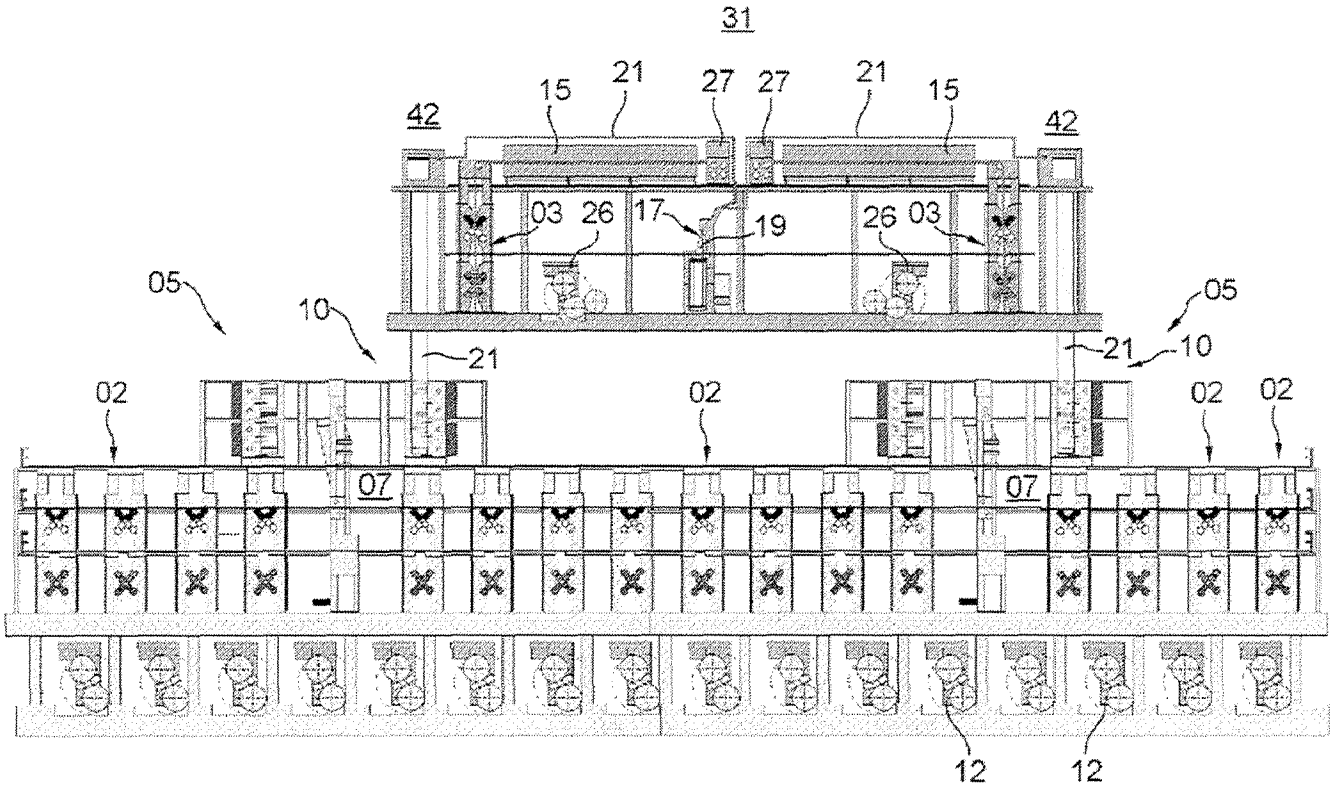
Fig, 23a

PRINTING MACHINE SYSTEM

CROSS-REFERENCE TO RELATED APPLICATIONS

This application is the U.S. national phase, under 35 USC 371, of PCT/EP2006/065417, filed Aug. 17, 2006; published as WO 2007/020285 A1 on Feb. 22, 2007 and claiming priority to DE 10 2005 039 073.0, filed Aug. 18, 2005, to U.S. 60/750,357, filed Dec. 15, 2005 and to DE 10 2006 020 322.4, filed May 3, 2006, the disclosures of which are expressly incorporated herein by reference.

FIELD OF THE INVENTION

The present invention is directed to a printing press system, and in particular to a printing press system which is usable for newspaper printing and for semi-commercial printing. The printing press system has a first printing press, which has at least one first printing unit, as well as a first former structure arranged in alignment with this first printing unit. A second printing press has at least one second printing unit and a dryer and a second former structure.

BACKGROUND OF THE INVENTION

A printing press having printing units for use in newspaper printing, as well as a printing unit for use in printing semi-commercial products, is known from DE 102 38 919 A1. Production of the printed products is performed on a common folding apparatus having a newspaper and an illustration folding apparatus.

WO 2004/024448 A1 discloses a printing press with several printing units, with at least one dryer and with a folding apparatus. The printing units are arranged next to each other in relation to the axial direction of their cylinders. Projected into a horizontal plane, a path from the printing units to a former structure, with three formers, has a 90° bend.

A printing press with several printing towers, for use in printing newspaper products, is disclosed in WO 03/031182 A1. The printing towers are arranged in an alignment extending perpendicularly in relation to the axial direction of their printing group cylinders, so that the printing press is embodied in a so-called in-line press arrangement. The direction of entry into formers of a former structure, which is arranged in a straight-line running direction, also extends along, or at least parallel, to the printing machinery alignment.

Two lines of printing presses, each having several printing groups arranged side-by-side, through which a web runs one after the other, is known from DE 40 12 396 A1. Added devices of the one printing press can be utilized for transferring the web into the other printing press.

A printing press with several side-by-side arranged printing groups and an aligned former structure is disclosed in U.S. Pat. No. 1,972,506 A. Partial webs, which have been imprinted in several colors can be conducted from printing groups, which are offset by 90° with respect to each other, onto the former structure of the first printing press.

DE 20 2005 010 058 U1, and EP 16 83 634 A1, both show a printing press with two partial printing press systems. The printing press systems are differently embodied in such a way that a web of material to be imprinted can be printed with different numbers of printed pages.

Examples of printing presses, or printing press systems having combined heatset/coldset lines of printing presses are provided in the publication "Handbuch der Printmedien", Springer, 2000, pp. 357 and 358.

The publication of Alexander Braun "Atlas des Zeitungs- und Illustrationsdruckes", Polygraph, 1960, represents on page 152 a printing press with a printing group of a width of four plates and a double-width former structure with a downstream-located folding apparatus. Imprinted webs of one-page width from an envelope or insert printing press, with printing groups offset by 90° in relation to the first printing press, can be supplied to the first printing press in the folding apparatus.

SUMMARY OF THE INVENTION

The object of the present invention is directed to providing a printing press system, and in particular a printing press system for variable printed production runs.

In accordance with the present invention, this object is attained by the provision of a printing press system having a first printing press with at least one first printing unit, as well as with a first former structure which is arranged in a machinery alignment of this first printing unit. A second printing press, which has at least one second printing unit, also has a dryer that is arranged in a machinery alignment with the second printing unit, and with a second former structure. The first and second formers differ in their numbers of formers that are arranged side-by-side on a machine level and/or in an effective width of one of or of several of the formers.

The advantages which can be obtained by the present invention consist, in particular, in that, in connection with the arrangement of two different printing presses and two kinds of former structures in a printing press system, it is possible, in a simple and variable way, to form different, separate products, as well as to form the most diverse mixed products. By the combination of, for example, types of printing presses or printing units which are different from each other, it is possible to take the most diverse requirements regarding product variety and quality into consideration.

For example, a printing press, such as a newspaper printing press, may be configured so that it is possible, besides being usable for a pure newspaper production, which takes place during a relatively short period of time at night, to be utilized during the day for the production of other products, for example mixed products.

Furthermore, in an embodiment of the present invention, with an angular or an orthogonal arrangement of printing units and/or former structures, a better variability is possible when mixing webs from the one type of printing units, for example from the semi-commercial printing units, into the flow of webs from the other printing units, for example from the newspaper printing units. In this embodiment, the webs interfere less than they do with a purely linear arrangement. This increases the variability of the position of these "commercial webs" within the total product. The ability of combining heatset and coldset webs, and/or webs from printing units of different width and/or circumference, and/or using different printing methods is provided in a considerably more flexible manner. The heatset webs or the partial heatset web, which may be entering from the side, can be inserted at almost any arbitrary position into the product.

Also, in connection with an embodiment of the present invention, and in an orthogonal arrangement, and in connection with the embodiment of the two printing presses in a line arrangement with two former structures, simultaneous production of, for example, a newspaper and semi-commercial material, independently of each other, is possible without restrictions. The presses, which may be embodied, for example, as heatset and coldset presses, can, for all practical purposes, be operated selectively as completely independent presses, free of side effects.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
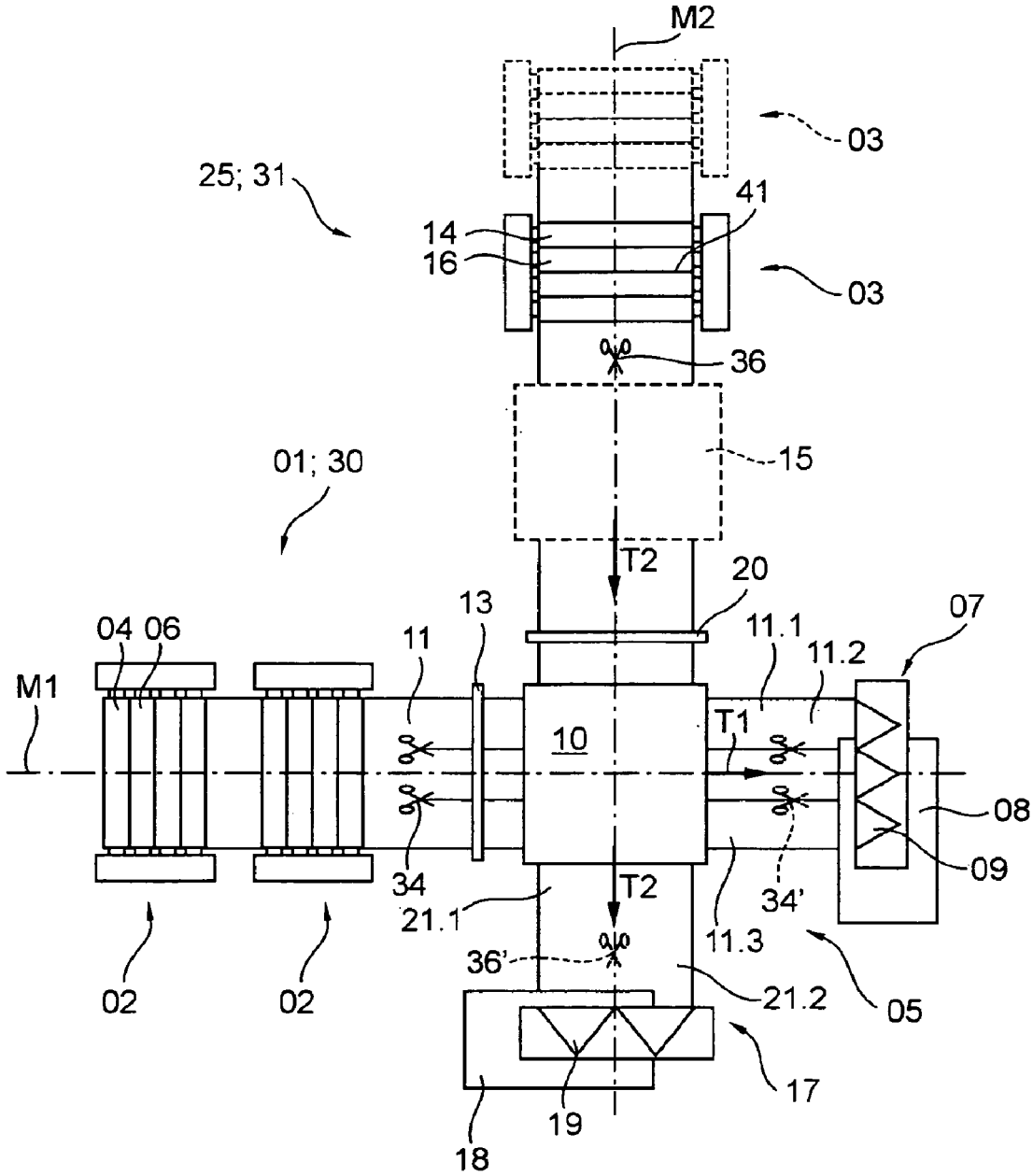
FIG. 1, a schematic top plan view of a preferred embodiment of a printing press system, FIG. 2, a schematic representation of the equipment of a forme cylinder in the newspaper printing mode (a) and tabloid printing (b), FIG. 3, schematic representations a), b), c) of a further preferred embodiment of a printing press system, FIG. 4, schematic representations a), b), c) of a further preferred embodiment of a printing press system, FIG. 5, a schematic top plan view of a further preferred embodiment of a printing press system, FIG. 6, a schematic top plan view of a further preferred embodiment of a printing press system, FIG. 7, schematic representations of former structures, FIG. 8, further schematic representations of former structures, FIG. 9, a schematic top plan view of a further preferred embodiment of a printing press system with several printing units, FIG. 10, schematic representations a), b), c) and d) of a further preferred embodiment of a printing press system, FIG. 11, schematic representations a), b), c), d) and e) of a preferred embodiment of production, or of a web guidance, of the printing press system in accordance with FIG. 10, FIG. 12, schematic representations a), b), c) and e) of a preferred embodiment of production, or of a web guidance, of the printing press system in accordance with FIG. 10, FIG. 13, a schematic top plan view of a further preferred embodiment of a printing press system with several printing units, FIG. 14, a schematic top plan view of a further preferred embodiment of a printing press system with several printing units, FIG. 15, a side elevation view of the printing press system in accordance with FIG. 14, FIG. 16, a schematic view through the printing press system at the level of a printing unit of the newspaper printing press in accordance with FIG. 14, however, for improved clarity, without representation of a folding group which, in this perspective, is in the background, FIG. 17, a schematic view through the printing press system at the level of a turning arrangement of the newspaper printing press in accordance with FIG. 14, however, for improved clarity, without representation of a roll changer assigned to the heatset printing unit, FIG. 18, a schematic top plan view of a further preferred embodiment of a printing press system, FIG. 19, a side elevation view of the printing press system in accordance with FIG. 18, FIG. 20, a schematic representation of the former structure in accordance with FIG. 18, FIG. 21, schematic representations a), b) and c) of the conduct of webs onto formers for creating a "pop-up product", FIG. 22, schematic representations a) and b) of the conduct of webs onto formers for creating a "pop-up product", FIG. 23, schematic representations a) and b) of a further preferred embodiment of a printing press system, FIG. 24, schematic representations a), b) and c) of a further preferred embodiment of a printing press system, FIG. 25, schematic representations a) and b) of a further preferred embodiment of a printing press system, FIG. 26, a schematic side elevation view of a further preferred embodiment of a printing press system, FIG. 27, schematic front views of the former structures in accordance with FIG. 26, and FIG. 28, a schematic side elevation view of a further preferred embodiment of a printing press system.

FIG. 1 shows a schematic top plan view of a printing press system in which, one or several printing units 02 of a first type, or first printing unit 02 of a first printing press 01, and in which one or several printing units 03 of a second type, for example, second printing unit 03 of a second printing press 31 are also provided. The first and second printing units 02, 03 are laterally offset, or are even possibly arranged at an angle, with respect to each other, in a manner to be described in greater detail below.

Particular advantages result, in regard to a product configuration if, depending on the specific printing requirements, both types of printing units 02, 03 are different from each other.

For example, the two types of printing units 02, 03, or printing presses 01, 31 can differ in regard to the printing process which each uses. Thus, it is possible, for example, for the printing units 02 of the one type to be configured as offset printing units, as direct print printing units, as flexographic printing units, or as a printing unit in accordance with a non-impact process, such as a printing process without printing formes, or with ink application without the mechanical action of printing cylinders on the material to be imprinted. This can be done, for example, by imprinting light-sensitive paper, by inkjet printing or by laser printing. The printing press 01 can operate in accordance with the corresponding method. The second printing unit 03 of the other type can be configured in accordance with another one of the desired processes. For example, the one printing press 01 can be configured, in particular, as a newspaper printing press 01 with offset printing units. The other printing press 31 has one or has several direct print or flexographic printing units or non-impact printing units. A first printing press 01 can also be embodied as a newspaper printing press 01 with offset printing units, while the other printing press 31 has offset printing units for job-lot printing, such as, for example, printing groups with a substantially horizontal web run for high-quality commercial printing and a downstream arranged dryer, or can be configured as a job-lot printing press.

In addition to, or in place of a difference in the above-mentioned printing processes, the two types of printing units 02, 03, or printing presses 01, 31, can differ in that one of the printing presses 01, 31 is operated to include drying the freshly imprinted web, for example, in accordance with the "heatset" method, as will be discussed below regarding the use of the term "heatset", and the other printing press 01, 31 without drying, i.e. in accordance with the "coldset" method. The printing press 01, 31, which is operated in accordance with the heatset method, then has appropriate mechanisms 15 for aiding in drying, such as, for example, a dryer 15, and the associated printing units 03, 02 are embodied with appropriately modified units and/or additional devices, as will be discussed below. A printing press 01 can also advantageously be embodied as a newspaper printing press 01, in particular with offset printing units equipped solely for newspaper printing and/or for coldset printing, referred to as coldset printing units 02 for short, while the other printing press 31 has one or several offset printing units configured for semi-commercial and/or "heatset" printing, called heatset printing unitss 03 for short, as well as mechanisms 15 for aiding drying. The prefix "heatset" is understood to not only mean the drying of the web by the use of a thermal method, but also, in contrast to "coldset", to also include drying by other procedures for aiding drying, such as, for example, by UV or IR dryers.

In addition to, or in place of a difference in the above mentioned printing process and/or regarding drying, the two types of printing units 02, 03, or printing presses 01, 31, can differ in that the two types of printing units 02, 03 can differ in the length and/or in the circumference of the image-supplying printing group cylinder 04, 14, for example the forme cylinder 04, 14, as discussed below, which is maximally effective for the printing process. This means that these cylinders 04, 14 can be embodied to have a length and/or a circumference corresponding to a differing number of printed pages of the same format, such as, for example, newspaper pages in broadsheet format, or which supports the corresponding number of printed pages on the forme cylinder 04, 14. For example, the printing unit 02, 03 of the one type of printing group cylinders 04, 14, respectively, can be embodied with a width of four printed pages, and in particular four newspaper pages, and is thus referred to as having a "double-width" and, with at least the forme cylinder 04, being provided with a circumference corresponding to two printed pages or being "double-round", and in particular two newspaper pages, or "double-round", in a so-called "4/2 design". The printing unit 03, 02 of the other type can be configured in 4(length)/1(circumference of at least the forme cylinder 14, 04) configuration, in a 2/2 design, "single-width" and "double-round", or in a 6/2 configuration, "triple-width" and "double round". With a single-round configuration, a printing group cylinder 06, 16, for example a transfer cylinders 06, 16, as discussed below, working together with the "single-round" forme cylinders 04, 14, can also be embodied to be double-round. In principle, the one printing press 01 or 31 can be embodied in one of the configurations 2/1, "single-width" and "single-round", 2/2, "single-width" and "double-round", 4/1, "double-width" and "single-round", 4/2, "double-width" and "double-round", 6/1, "triple-width" and "single-round", or 6/2, "triple-width" and "double-round". The other printing press 31, 01 can be embodied in a configuration which is different from the first of the mentioned configurations. It is also possible to embody a wider, such as, for example, a double-width printing unit 02, to be single-round, 4/1 configuration, and for the printing unit 03 of the second type to be of single-width and double-round, 2/2 configuration. Expressed in general terms, in an x/y configuration, the forme cylinder 04, 14 of the respective printing unit 02, 03 has a number of x print images on its circumference side-by-side in the longitudinal direction, and in the circumferential direction has a number y of print images, or the number of printing formes each with a print image, of the respective format, for example tabloid format or newspaper format, in the case of a newspaper format in particular in broadsheet format.

In the selection of the configuration of the printing press 01, 31, in regard to the differentiation in circumference between single circumference or double circumference configuration, a single circumference configuration for example 2/1, 4/1 or 6/1 can have advantages in regard to the printing formes to be exchanged in the course of a production change and/or in regard to the lateral skip in the product to be made, and/or a height of the press. A double circumference configuration, for example 2/2, 4/2, 6/2), however, can show advantages regarding a product amount which can be maximally produced in the course of a collection production. In regard to the differentiation in the printed pages arranged side-by-side in the longitudinal direction, the amount of production to be achieved, and/or the production efficiency are added decision criteria. If, for example in a mixed product, only a few special layers are needed, and in a single production run of this, for example wherein the second printing press 03, only produces in low numbers, a mere single-width configuration can, for example, be sufficient.

In the case of embodiments of the two types of printing units 02, 03 of different width and/or of those differing in circumference, it is therefore possible, in a directed manner, to provide an adaptation to the requirements of a defined product spectrum in this way.

In a triple-width, 6/1 or 6/2 embodiment of one of the printing units 02, 03, or of one of the printing presses 01, 31, it is possible to respectively arrange, on the transfer cylinder 06, 16 of a width of six printed pages, over its length, two continuous, three page-wide or three two page-wide printing blankets, which are not specifically represented, and in particular metal printing blankets with a dimensionally-stable support plate, for example metal plate, and a resilient and/or compressible coating. The embodiment with two three page-wide rubber blankets arranged side-by-side in the longitudinal direction is advantageous in connection with increased variability, such as with pop-up production, or with variable web width. The rubber blankets can each extend over the entire circumference and, in the case of several blankets arranged in the longitudinal direction, can be offset in respect to each other in the circumferential direction.

Several printing units 02 of the first type, such as "purely" cold-set printing units 02, and/or at least one printing unit 02 of the first type, such as, for example, a coldset printing unit 02 and a former structure 07, are arranged in the manner of a so-called in-line press arrangement 01, in a common machinery alignment M1 extending perpendicularly in respect to the axial direction of their printing group cylinders 04, 06. The machinery alignments M1, which are represented in the drawing figures, extend on the level of a plane of symmetry which halves the printing cylinders 04, 06 in respect to their axial length, and in this shape, they can also be called press center alignment M1. With several printing units 02 of the first type in a line arrangement, it is possible to additionally arrange the at least one former structure 07 assigned to the printing units 02 in this machinery alignment M1, i.e. in a "straight-line embodiment". In the case of offset printing, the printing group cylinders 04, 06 are, for example, embodied as forme cylinders 04, or as image-supplying printing group cylinders 04 and as a transfer cylinder 06. A folding group 08, for example in the case of a printing press 01 which is embodied as a newspaper printing press, a coldset folding group 08, is provided downstream of a former structure 07. The former structure 07 has one or several formers 09 which are preferably oriented in such a way that webs 11 of material, for example paper webs 11, referred to as webs 11 for short, and running up on the former 09, have a transport direction T1 projected onto the horizontal plane, which transport direction T1 extends along, or parallel with the machinery alignment M1 of the first printing press 01. This means that the webs 11 imprinted in the printing units 02 of the first type can be conducted in a so-called straight-ahead guided manner onto the formers 09. The entire first printing press 01, which is embodied as an in-line press arrangement 01, or a section with at least one printing unit 02 and an associated former structure 07, can also be called a first, in-line press arrangement 30.

The first printing press 01 preferably has several groups of adjoining printing units 02, between each of which one or two former structures 07 is, or are arranged. In this way, the mass product, such as, for example, a newspaper can be produced, overlapping groups selectively, on the first printing press 01, while either individual product sections of the mixed product, or a separate product of, for example greater quality and/or lesser size and/or lesser amount, can be produced on the other printing press 31.

The printing press system can, in principle, be any arbitrary, above-mentioned, combination of two different printing units 02, 03, or printing presses 01, 31. However, the printing units 02 of the first printing press 01 are typically configured as printing towers 02, which advantageously have two stacked H-printing units or two stacked satellite printing units, respectively. In principle, the printing towers 02 can also have four double printing groups for two-sided imprinting. In that case, the web 11 runs substantially vertically between the print locations in the printing units 02 of the first printing press 01.

A machinery alignment M2 of the second printing press 31, or in-line press arrangement 25, represented in the drawing figures, extends on the level of the printing group cylinders 14, 16 of the second printing unit 03 in the plane of symmetry which halves the length, and in this embodiment they can also be called center press alignment M2.

Figure 2A:
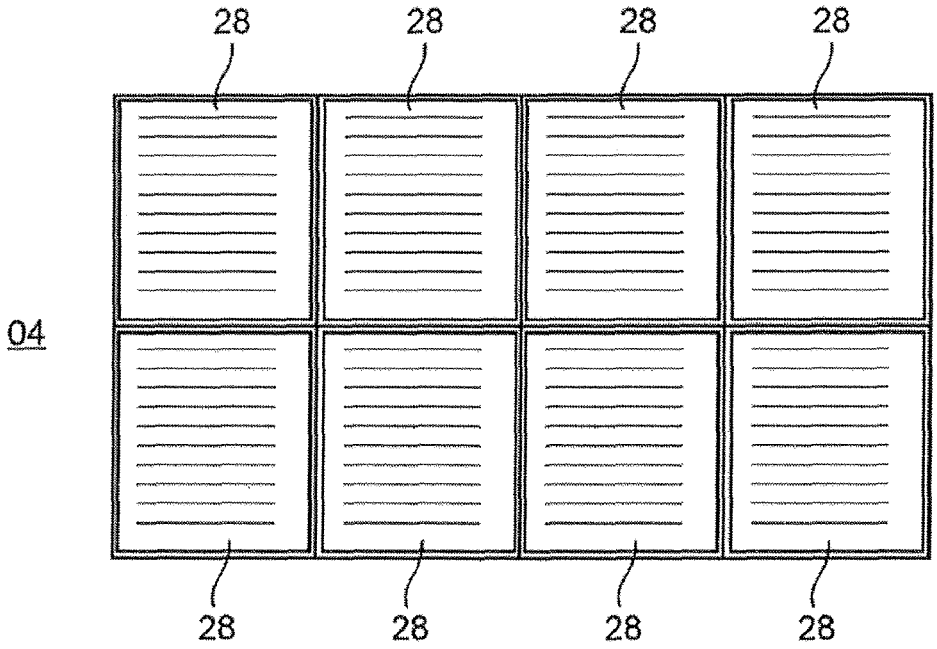

In an advantageous embodiment of the first printing press 01 as "purely" a newspaper printing press 01, it has coldset printing units 02 for newspaper printing as printing units 02 of the first type. With the printing units 02, embodied in particular as coldset printing units 02 for newspaper printing, the printing group cylinders 04, which are embodied as forme cylinders 04, have several printing formes 28, as seen in FIG. 2*a*, on their circumference, viewed, for example, in the longitudinal direction, which, in the axial direction, either support only one print image, such as a single printing forme 28, which is not represented in FIG. 2*a*), or maximally two panoramic printing formes print images of a newspaper page, while viewed in the circumferential direction of the forme cylinder 04 respectively support only one of these print images. Thus, as schematically represented in FIG. 2*a*), the forme cylinder 04 supports for example four printing formes 28 in the axial direction side-by-side, and in the case of double-size forme cylinders 04, supports two printing formes, with one printed page each, in the circumferential direction. In the circumferential direction, single size printing cylinders 04 have only one such printing forme 28. The single printing formes 28 can be replaced individually, or together also in pairs, by panorama printing formes with two printed pages in width. For this purpose, the forme cylinder 04 of the coldset printing unit 02 has on its circumference, for example, one, in the case of a forme cylinder 04 of single size or, one behind the other, two, in the case of a double size forme cylinders 04, grooves each extending in the longitudinal direction over the entire length useful for printing, which grooves are adapted for receiving the printing formes 28. The forme cylinder 04 of the coldset printing units 02 furthermore has, for example, devices, such as, for example, register devices, or axially acting stops, for the lateral alignment of four printing formes 28 situated side-by-side. The embodiment of the forme cylinder 04 mentioned for four printed pages, which has four printed pages, or printing formes 28, side-by-side and four stops, should be applied to a forme cylinder 04 with six printed pages side-by-side corresponding to six printing formes 28 and six stops.

A printing unit 02, which is embodied as a coldset printing unit 02, has an inking group, not specifically represented in any drawing figure, for inking the printing formes 28, which inking group is filled, or is operated, with coldset inks. The coldset ink is distinguished by special auxiliary materials, such as, for example, wetting agents, waxes, yellowing agents, mineral filler materials, which make drying of the imprinted web 11 possible by absorption of the ink by the paper. This takes place, in particular, by the special combination of the coldset ink and the paper used.

The web 11, which is conducted through the coldset printing unit 02, preferably represents uncoated or slightly coated paper having a coating weight of maximally 20 g/m$^2$, and in particular of 10 g/m$^2$ at most.

In the embodiment of the first printing press 01 as a coldset printing press 01 for newspaper printing, the folding group 08 which is assigned to the first printing press 01, and with the former structure 07 arranged in the machinery alignment M1 in a straight-ahead embodiment, is, for example, embodied as a newspaper folding group. The folding group 08, which is embodied as a newspaper folding group, has one or two folding apparatuses, for example embodied as single, or double folding apparatus. The folding group 08 can also have a plurality of individual folding apparatuses. The folding apparatus of the folding group 08, which is embodied as a newspaper folding group has, for example, a cutting cylinder, a transport cylinder, a folding jaw cylinder and possibly a paddle wheel. However, in particular for embodying the folding apparatus for semi-commercial products, it can optionally have an assembly for making a second transverse fold. The folding apparatus of the folding group 08 is advantageously rotatorily driven, mechanically independent of the printing units 02, by at least one drive motor.

Figure 2B:
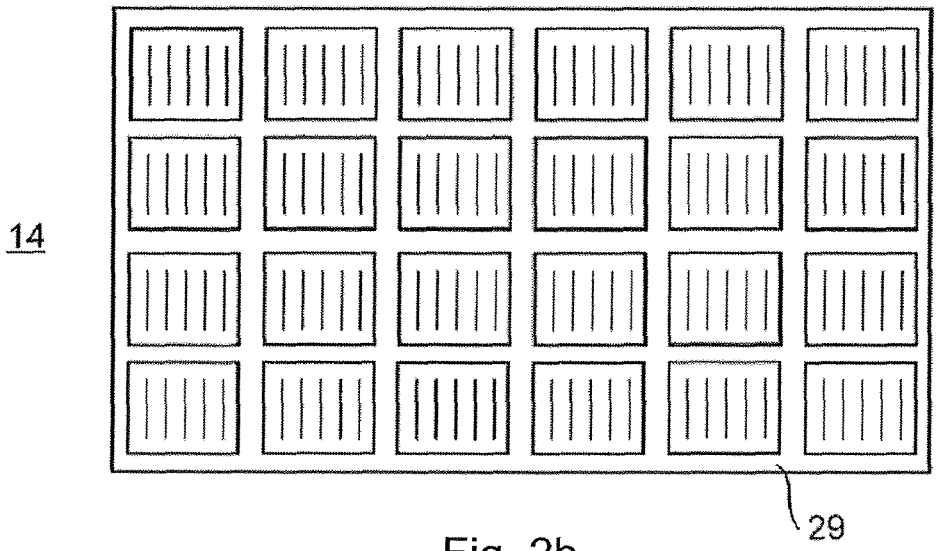

In one embodiment, printing group cylinders 14 embodied as forme cylinders 14 of a heatset printing unit 03 for use in semi-commercial printing, can have, in one embodiment, for example, and when viewed on their circumference in the longitudinal direction, only one, but at most two printing formes 29, as seen in FIG. 2*b*), which, when viewed in the axial direction, support at least three, in the case of printing formes in the longitudinal direction or, for example, six, in the case of only one printing forme 29 in the longitudinal direction print images of a tabloid page, such as, for example, a magazine or a telephone book page, and viewed in the circumferential direction of the forme cylinder 04, support several, such as, for example, at least four, of these print images. As schematically represented by way of example in FIG. 2*b*) and viewed, for example, in the axial, as well as in the circumferential direction, the forme cylinder 14 supports, on the rolled-off circumference, only one printing forme 29, which contains, for example, side-by-side, in the axial direction, the print images of six, and in the circumferential direction, the print images of four printed pages in tabloid format, such as, for example, in magazine or in telephone book format. In the case of two printing formes 29, situated side-by-side over the entire circumference of the forme cylinder 14, the printing formes 29 have, for example, respectively three printed pages in tabloid format side-by-side. For this purpose, the forme cylinder 14 of the heatset printing unit 03 has, on its circumference, for example, a groove, extending in the longitudinal direction, over the entire length of the cylinder 14 which is useful for printing for receiving the printing forme or formes 29. Furthermore, the forme cylinder 14 of the heatset printing unit 03 has, for example, an arrangement, such as, for example, one or several register devices, or axially acting stops, for the lateral alignment of one or two side-by-side printing formes 29.

In another embodiment, the second printing unit 03, operated in heatset, can be embodied, in regard to its forme cylinder 04, corresponding to a forme cylinder 04 of a coldset printing unit 03, and can support, on its circumference, a number of printing formes corresponding to the number of printed pages, for example single printing plates. In the case of a double-width printing unit 03, for example, in the axial direction. The cylinder can carry four side-by-side printing formes, and in the case of a triple-width printing unit 03, it can carry, for example, six printing formes with printed pages, for example of a newspaper format.

The forme cylinder 14 of the heatset printing unit 03 can, for example, have an effective, or a usable barrel width for imprinting a web 21 of material, for example paper web 21, or simply web 21 for short, which at least corresponds to the corresponding number of newspaper pages of the format to be imprinted on the newspaper printing press 01.

The heatset printing unit 03 has an inking group, which is not specifically represented in any drawing figure, for use in inking the printing formes 29 which inking group, in at least one mode of operation, such as a heatset mode, is filled, or is operated, with heatset ink. The heatset ink is distinguished by special oils, for example mineral oils, which evaporate under the effect of heat and in this way permit the imprinted web 21 to dry. These mineral oils typically have a boiling range of 220° C. to 320° C. Related to the ink, they can have a weight proportion of approximately 25 to 40%. Since the ink need not be absorbed in order to dry, it is also possible to imprint paper surfaces with closed pores.

The web 21, which is conducted through the heatset printing unit 03, in the course of a heatset mode, preferably represents satinized and/or more heavily coated paper of a coating weight of more than 10 g/m$^2$, for example at least 15 g/m$^2$. The paper of medium or higher quality can be selected to lie within a range of imprinted paper of greater than 40 g/m$^2$, for example in a range of imprinted paper between 55 and 90 g/m$^2$, and in particular of greater than 50 g/m$^2$. In contrast thereto, the paper which is employed in the coldset mode, can be placed within a weight range of imprinted paper of less than 50 g/m$^2$, and in particular less than 40 g/m$^2$.

The heatset printing unit 03 can preferably be selectively operated in the heatset mode, but also can be operated in the coldset mode, in which it is operated, for example in the first mentioned mode of operation, with heatset ink and/or with heavier coated paper, and, in the second mentioned mode of operation, is operated with coldset ink and/or with uncoated or slightly coated paper. During coldset operation, passage of the web 21 through the dryer 15 can occur, when the dryer 15 is in a deactivated state or, as shown in solid lines in FIGS. 16 and 17, it can be bypassed in a changed web course.

The printing unit 03 of the in-line press arrangement 25, in particular of the heatset in-line press arrangement 25 and/or of the second printing press 31, which is embodied as heatset and/or, as a semi-commercial printing press, is configured, for example, as a printing tower 03, which preferably has four stacked double printing groups for two-sided imprinting, so-called bridge or n-printing units. However, in principle, the printing tower 03 can also have two stacked H-printing units, or two stacked satellite printing units.

If the second printing press 31 is configured as a job-lot press, the printing unit 03 has an offset double printing group with four printing group cylinders 14, 16 arranged vertically above each other, as well as having more elaborate inking groups, such as, for example, dual-train roller inking groups with at least three distribution cylinders located in the roller train. Similar to what has been said above in respect to the heatset printing group, for example, the forme cylinders 14 are embodied with a continuous fastening groove and with the possibility of receiving a printing forme 29 extending over the entire width. In this case, too, the job-lot printing units are operated by the use of heatset ink, and the printing press has a dryer 15.

A downstream-located folding group 18, such as, for example, a heatset folding group 18, is assigned to one or to several of these printing units 03 of the second type, such as, for example, heatset printing units 03, or a heatset in-line press arrangement 25. A heatset folding group 18, for use with semi-commercial products, advantageously has further units, such as, for example, an assembly for forming a second longitudinal fold and/or a second transverse fold, and/or a stapler, and/or a plow fold, in addition to the typical cutting cylinder, transport cylinder and folding jaw cylinder.

The at least one printing unit 03 of the second type is arranged, now viewed from above, as seen in FIG. 1, laterally next to the alignment of the first printing units 02. This should be understood in such a way that, when viewed from above, at least the print locations 41 of this second printing unit 03 are located outside an alignment which is formed by the effective lengths of the first printing group cylinders 04, 06, or the maximal web width of the first printing press 01. As described below, in this way, it is possible, in a simple way, to feed a web 21, which has been imprinted by the printing unit 03 of the second type, to the flow of webs 11, or partial webs from the first printing press 01 from the side transversely in relation to the machinery alignment M1 of the first printing press 01. A second printing unit transport direction T2, projected onto a horizontal plane of a web 21 imprinted by the printing unit 03 of the second type and running toward the first printing press 01, therefore meets the machinery alignment M1 of the first printing press 01 projected onto the horizontal plane at a 90° angle.

It is particularly compact and advantageous, in respect to the number of required direction changes, if at least one printing unit 03 of the second type is arranged angled, and in particular is arranged at right angles, in relation to the printing press 02 of the first type, or to the first printing press 01. The axes of rotation of printing group cylinders 14, 16 of the printing unit, or units 03, of the second type extend in a direction which is perpendicular, or orthogonal, to the axes of rotation of the printing group cylinders 04, 06 of the printing unit, or units 02 of the first type. In this case, the expression "perpendicular" or "orthogonal" does not mean that the imagined straight extensions of the axes of rotation must intersect, they can also extend "skewed" in respect to each other.

In a machinery alignment M2, which is extending perpendicularly in relation to the axial direction of the printing group cylinders 14, 16 of the printing group, or groups 03 of the second type, only one printing unit 03 has to be arranged. It is also possible for several printing units 03, such as a second printing unit 03 represented by dashed lines of the second type, in the manner of an in-line press arrangement, or at least one printing unit 03 and one dryer 15, and/or other units, such as cooling rollers and/or a varnishing group, to be arranged. Such an arrangement of one, or of several second printing units 03, for example together with an additional dryer 15, etc., in a machinery alignment M2 will also be called in-line press arrangement 25, and in a special case, will also be called heatset in-line press arrangement 25, in what follows. The machinery alignment M2 and/or the throughput direction of a possibly existing dryer 15 extends, for example, substantially perpendicularly, in respect to the machinery alignment M1. In case of a linear arrangement of the first printing press 01, the axial direction of the printing group cylinders 14, 16 of the second printing unit or units 03 extends substantially parallel with the machinery alignment M1 of the first printing press 01.

A superstructure 05, with at least one turning arrangement 10, is provided in the machinery alignment M1 of the first printing press 01. The turning arrangement 10 is configured in such a way that a web 21, which is incoming from the second printing unit 03, or from the second printing press 31, can be turned by 90° into an alignment with a web 11, or a partial web, of the first printing press 01. This means that a web 21 of the second printing press 31, running in the transport direction T2, can be turned by 90° into a transport direction T1 which extends parallel with the machinery alignment M1 of the first printing press 01 by the use of the turning arrangement 10, and can be conducted onto the former structure 07 of the first printing press 01.

Because of the above mentioned lateral, or angled arrangement of the two printing presses 01, 31, or printing units 02, 03 of different types, and the turning arrangement 10, in at least one mode of operation, in which a web 21, or a partial web, is being turned in, a printing unit 03 of the second type, such as, for example, a heatset printing unit 03, is therefore assigned, or can be assigned additionally to the former structure 07 of the first printing press 01, besides a printing unit 02 of the first type.

This turning arrangement 10 can either be considered to be a turning arrangement 10 assigned to this first printing press 01 or a separate production process in a superstructure 05 assigned to this first printing press 01. However, it is also advantageously possible to assign an additional, not specifically represented, turning arrangement, in the superstructure 05, to the first printing press 01 in order to be capable of turning the webs 11, or partial webs 11.1, 11.2, 11.3 variably in parallel alignments different from the machinery alignment M1. In the same way, the second printing press 31 can also have, in its superstructure 39, a turning arrangement which is different from the turning arrangement 10 of the superstructure 05, and which permits the turning of webs 21, or of partial webs 21.1, 21.2, 21.3 variably in different alignments parallel with the machinery alignment M2, as will be discussed below.

As shown in FIG. 1, a further, second former structure 17, in addition to the first former structure 07, is assigned to the two printing units 01, 31 in such a way that, in one mode of operation of the printing press system, a separate production run of the one printing press 01 on the one former structure 07, and with the other printing press 31 on the other former structure 17, can be realized. As described above, in another mode of operation of the printing press 01, it is possible to conduct webs 11, 21, or partial webs 11.1, 11.2, 11.3, 21.1, 21.2 from the two printing presses 01, 31 together on one former structure 07, 17 by the use of at least one turning arrangement 10.

Depending on the press width or, in other words, the web width maximally to be imprinted, and/or the number of pages, such as, for example, newspaper pages, in the axial direction of the printing cylinders 04, 06, 14, 16) of the two printing presses 01, 31, or their printing units 02, 03, the two former structures 07, 17 have a different number of formers 09, 19, which are arranged horizontally side-by-side as former groups. Also, depending on the products to be primarily formed on the two printing presses in separate production runs, the former structures 07, 17 can have formers 09, 19 of different effective widths or former format. For example, the one former structure 17, 07 can have a group of two formers 09, 19 side-by-side, and the other former structure 07, 17 can have a group of three formers 09, 19, each of the same effective width or the same former format, as seen in FIG. 1. However, one former structure 07, 17 can have a group of two or three formers 09, 19 of a first effective width, or first former format, and the other former structure 17, 07 can have a group of one or two formers 19, 09 respectively in another, for example, larger effective width, or second former format. Thus, depending on the requirements, the former structures 07, 17 can differ in number and/or effective width of the formers 09, 19. Here, the width in the run-in section of the former 09, 19 transversely to the incoming web 11, 21 or partial web is understood to be the effective width, or the former format, of the former 09, 19. It corresponds, for example, to the maximum width of a partial web which is to be folded by the use of this former 09, 19, which, in turn, corresponds to the printed page format to be respectively folded. As a rule, a partial web has a width of two printed pages of the corresponding format.

In the case of multi-width presses, such as double-width or triple-width printing units 02, 03, a longitudinal cutting device 34, 36 is provided on the web path between the printing units 02, 03 and the respective associated former structure 07, 17. In case of a printing unit 02, 03 embodied n-times or m-times wide, wherein n, m=1, 2, 3, . . . , in one mode of operation, for example, the forme cylinder 04, 14 supports 2*n, or 2*m printed pages of a defined format side-by-side in the axial direction, and in particular in a newspaper format. The longitudinal cutting device 34, 36 is embodied for the longitudinal cutting of a web 11, 21 imprinted in this printing unit 02, 03 into at least n or m partial webs 11.1, 11.2, 11.3, or 21.1, 21.2.

In principle, the respective longitudinal cutting device 34, 36 can be arranged upstream or downstream of the turning arrangement 10. In the first case, the already relatively narrow partial webs 11.1, 11.2, 11.3, or 21.1, 21.2 should be conducted to the formers 09, 19 over guide rollers 13, 20 and/or turning arrangements 10. In the second case, with multi-width webs 11, 21 a "multi-width" turning bar 32, as will be discussed below, is required if it is intended not to conduct the multi-width web 11, 21, or the multi-width partial web 11.1, 11.2, 11.3, or 21.1, 21.2, in a straight line, but instead to turn it into the machinery alignment M1, M2 of the other printing press 01, 31. However, in at least one of the printing presses 01, 31, or even in both, it is also possible to provide a longitudinal cutting device 34, 36 between the printing unit 02, 03 and the turning arrangement 10, and to provide a second longitudinal cutting device 34', 36', represented here in dashed lines, between the turning arrangement 10 and the former structure 07, 17. In this case, a web 11, 21 can be cut during straight-line running, shortly upstream of the former structure 07, 17, into webs 11.1, 11.2, 11.3, or 21.1, 21.2 of a width of a former, while, in the mode of operation with the web conducted in an angled fashion, or in mixed production runs, the partial webs 11.1, 11.2, 11.3, or 21.1, 21.2, which are to be turned into the other in-line press arrangements 25, 30, can be cut upstream of the turning arrangement 10.

In one embodiment of the present invention, the turning arrangement 10 can be configured in such a way that, if required, a web 21, 11, which is coming from only one of the printing presses 31, 01, can also be conducted onto the former structure 07 of the other printing press 01. In another advantageous embodiment of the turning arrangement 10, it can be configured in such a way that selectively or simultaneously one, as well as several webs 21, or partial webs, can be conducted from the second printing press 31 onto the former structure 07 of the first printing press 01 and, vice versa one, as well as several webs 11, or partial webs, can be conducted from the first printing press 01 onto the former structure 17 of the second printing press 31.

In an advantageous embodiment, as depicted in FIG. 1, both of the printing presses 01, 31, which are placed perpendicularly or orthogonally in respect to each other, or in-line press arrangements 25, 30, are respectively each configured as printing presses 01, 31 for imprinted webs 11, 21 running straight ahead. This means that the former structures 07, 17 are preferably oriented in such a way that webs 09, 19 running up on the former 09, 19 have a transport direction T1, T2 projected into the horizontal plane extending along or parallel to the machinery alignment M1, M2 of the respective in-line press arrangement 25, 30. This means that the webs 11, which are imprinted in the printing units 02 of the first type, as well as the webs 21, which are imprinted in the printing units 03 of the second type, can be conducted, in one mode of operation, in a so-called straight-ahead guided embodiment onto the respective assigned former 09, 19.

In this embodiment of the two printing units 02, 03, or printing presses 01, 31, or of the two in-line press arrangement 30, 25, it is then provided that for the first printing units 02, or printing press 01, the assigned former structure 07 is arranged in the machinery alignment M1 for straight-ahead running of webs 11 imprinted by this press, as well as for the other printing unit 03, or printing press 31 extending perpendicularly to it, the assigned former structure 17 is arranged in the machinery alignment M2 for straight-ahead running of webs 21 imprinted in this in-line press arrangement 25. In "normal" print operations, with separate production runs without webs 11, 21 of the two different printing units 02, 03 being intended to be combined, it is now possible to perform production runs in straight-ahead running onto each respectively assigned former structure 07, 17. In that case, the former structures 07, 17 are then also located orthogonally to each other in relation to the transport direction T1, T2 projected onto the horizontal plane in regard to a web 11, 21 running onto them. A former structure 07, 17, whose transport direction T1, T2 projected onto the horizontal plane running up on them extends parallel with the corresponding machinery alignment M1, M2, or perpendicularly to the axes of rotation of the printing group cylinders 04, 06, or 14, 16, of the printing units 02, 03 arranged in straight-ahead running, is assigned to each one of the two printing units 02, 03, or in-line press arrangement 30, 25, aligned orthogonally in respect to each other.

In this case, as represented in FIG. 1, a placement can be advantageous in which the printing unit or units 02, 03 in the two printing presses 01, 31, whose machinery alignments M1, M2 extend orthogonally to each other, and the former structures 07, 17 assigned in straight-ahead running, are respectively arranged on different sides of the machinery alignment M1, M2, i.e. the webs 11, 21 which, during separate production runs, run straight ahead, cross on their respective paths to the former structure 07, 17. In this orthogonal, or crossing placement of a first and a second in-line press arrangement 30, 25, the printing unit 03 and the former structure 17 assigned in straight-ahead running of the second in-line press arrangement 25 are arranged, viewed in a horizontal projection, on different sides of the machinery alignment M1 of the first in-line press arrangement 30, and the printing unit 02 and the former structure 07, assigned in straight-ahead running, of the first in-line press arrangement 30, or of the first printing press 01 of the first in-line press arrangement 30, are arranged, viewed in a horizontal projection, on different sides of the machinery alignment M2 of the second in-line press arrangement 25, or the second printing press 31. This means that two webs 11, 21, which have been imprinted in the two crossed printing presses 01, 31, or in-line press arrangements 30, 25, intersect, viewed in a horizontal projection, at right angles on their path between the printing units 02, 03 and the respective former structures 07, 17 assigned in straight-ahead running. In the discussion which follows, this placement will also be called X-placement.

In the X-placement depicted, for example, in FIG. 1, at least one, or a plurality of turning arrangements 10, as well as a group of guide rollers 13, depicted only schematically in FIG. 1, is preferably embodied in the area of the crossing point of the two webs, each being conducted in a straight line, in such a way that at least one web 11, or partial web 11.1, 11.2, 11.3 from a first in-line press arrangement 30, or printing press 01 can be selectively guided straight ahead to the associated former structure 07, or can be deflected over turning bars of the turning arrangement 10 by 90° and guided onto the former structure 17 of the second in-line press arrangement 25 or the second printing press 31. In addition, turning bars in the turning arrangements 10, or a second turning arrangement, as well as a group of guide rollers 20, also depicted only schematically in FIG. 1, can also be provided in such a way that one or several webs 21 from the second in-line press arrangement 25, or printing press 31, can be guided either straight ahead onto the assigned former structure 17, or selectively deflected by 90° onto the former structure 07 of the first in-line press arrangement 30 or printing press 01 via these guiding rollers 20 and/or turning arrangements 10. In this way, webs 11, 21 from the in-line press arrangement 30 and 25 can be guided together on a former structure 07, 17 for forming a mixed product.

FIGS. 3 to 6 and 9 schematically represent further preferred embodiments of an X-placement of two printing presses 01, 31, or two in-line press arrangements 30, 25, by use of the example of two printing presses 01, 31, or of two printing units 02, 03 of different press width. One of the in-line press arrangements 25, 30 can additionally have a dryer 15, shown in conjunction with printing press 31 in this case, and can be embodied as "heatset-capable" press with the appropriate equipment, as was discussed above. In the example, the printing units 02, 03 of different types at least differ in the press width, i.e. the effective width of the printing group cylinders 04, 06, 14, 16. One of the printing presses 31, 01 is configured, for example, n-times wide (n=1, 2, 3, . . . ), wherein, in one mode of operation, the forme cylinder 14, 04 supports 2*n printed pages of a defined format, and in particular of a newspaper format. The other printing press 01, 31 is configured m-times wide, m=2, 3, or more. In this embodiment, m not equal to n applies. In one mode of operation, the forme cylinder 04, 14 supports 2*m printed pages of a defined format, and in particular of the same format as that of the first mentioned printing press. For the sake of simplicity, here only one printing unit 02, 03 per printing press 01, 31 is shown. However, in one or in both machinery alignments M1, M2, several printing units 02, 03 can be provided. In particular, in at least one of the two printing presses 01, 02, advantageously in a coldset printing press 01, at least two printing units 02, 03 can be provided. At least one turning arrangement 10 is provided in the above mentioned crossing area.

The term "single-width", "multi-width", "double-width", etc. should generally be understood in a way that "single-width" is understood to be the effective width of the respective unit, or of a web/partial web width corresponding to two side-by-side arranged printed pages, in particular newspaper pages. For example, since, in respect to a defined format, a former 09, 19 has a width of two printed pages, such as, for example, of two upright or vertical newspaper pages or two horizontal tabloid pages, a single-width former structure 07, 17 corresponds to a width of two printed pages and has, viewed transversely to the web running direction, only one former 09, 19. A double-width former structure 07, 17 has two formers 09, 19 side-by-side. A triple-width former structure 07, 17 has three formers 09, 19. An n-width former structure 07, 17 has n formers 09, 19 side-by-side.

FIG. 3 is an example of a printing press system with two printing units 02, 03, crossed in the above mentioned manner, or of two in-line press arrangements 30, 25, and two former structures 07, 17. In one mode of operation, a separate production run by the one printing press 01 onto the one former structure 07, and by the other printing press 31 onto the other former structure 17, is provided, or can be realized.

In the example of FIG. 3, the first printing press 01 is embodied with triple-width (n=3) printing units 02, and in one mode of operation supports six printed pages side-by-side in the axial direction of the forme cylinder 04, and in particular supports six newspaper pages in a broadsheet format. A "triple-width" former structure 07 is arranged downstream in the machinery alignment M1, in straight-ahead conduct, and which has a group of three formers 09 of a width of two newspaper pages side-by-side. The other printing press 31 is embodied with double-width (n=2) printing units 02 and supports, in one mode of operation, four printed pages arranged side-by-side in the axial direction of the forme cylinder 04, such as, for example, four newspaper pages, and in particular four newspaper pages of the same broadsheet format as that of the first mentioned printing press 01. In another embodiment, the printing presses 01, 03 can also be embodied in single width combined with double-width. A "double-width" former structure 17 is arranged in the machinery alignment M2 downstream of the double-width printing units 03, which has a group of two formers 19, each of a width of two newspaper pages, side-by-side. The forme cylinders 04, 14 of the two printing units of different width can both be embodied single-round, with one printed page, and in particular one newspaper page, on the circumference; or both can be double-round, with two printed pages, and in particular two newspaper papers, on the circumference. However, one type of forme cylinder 04, for example the triple-width forme cylinder 04, can be embodied to be double-round, and the other can be single-round. The printing units 02, 03, or the printing presses 01, 31 can also differ in other of the above mentioned characteristics, such as printing process, coldset/headset, coated/uncoated material to be imprinted, ink type, and the like).

Figure 4A:
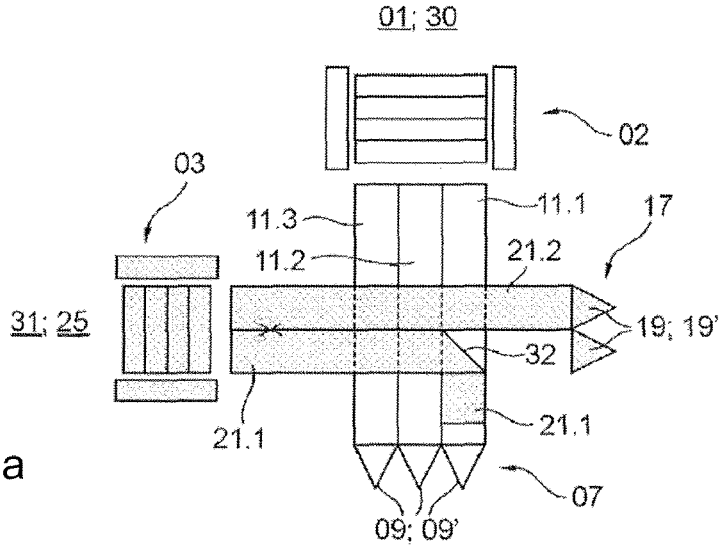
Figure 4B:
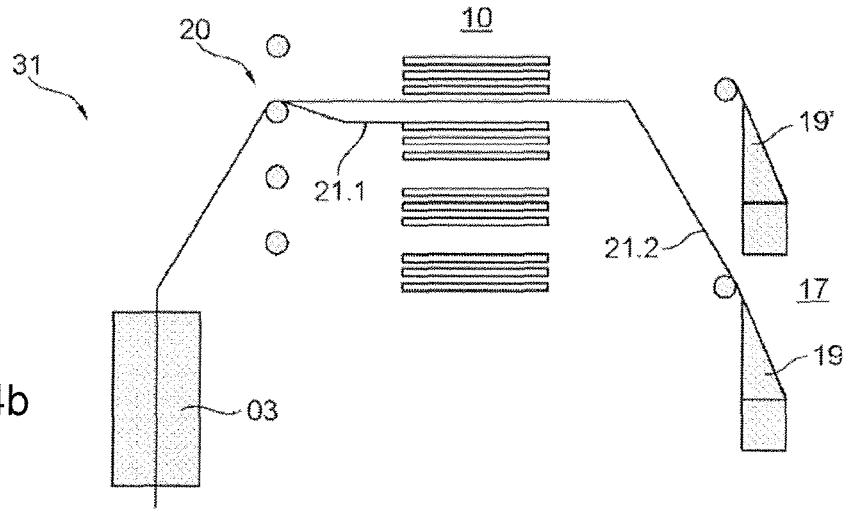
Figure 4C:
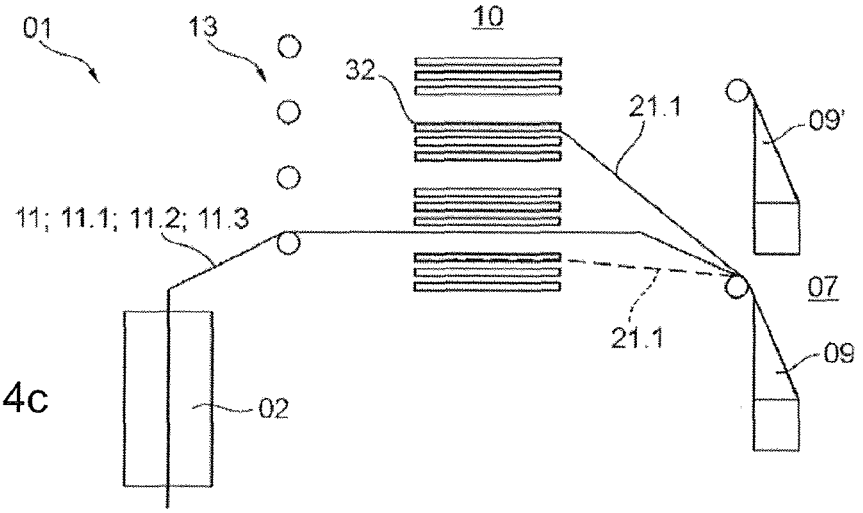
Figure 5:
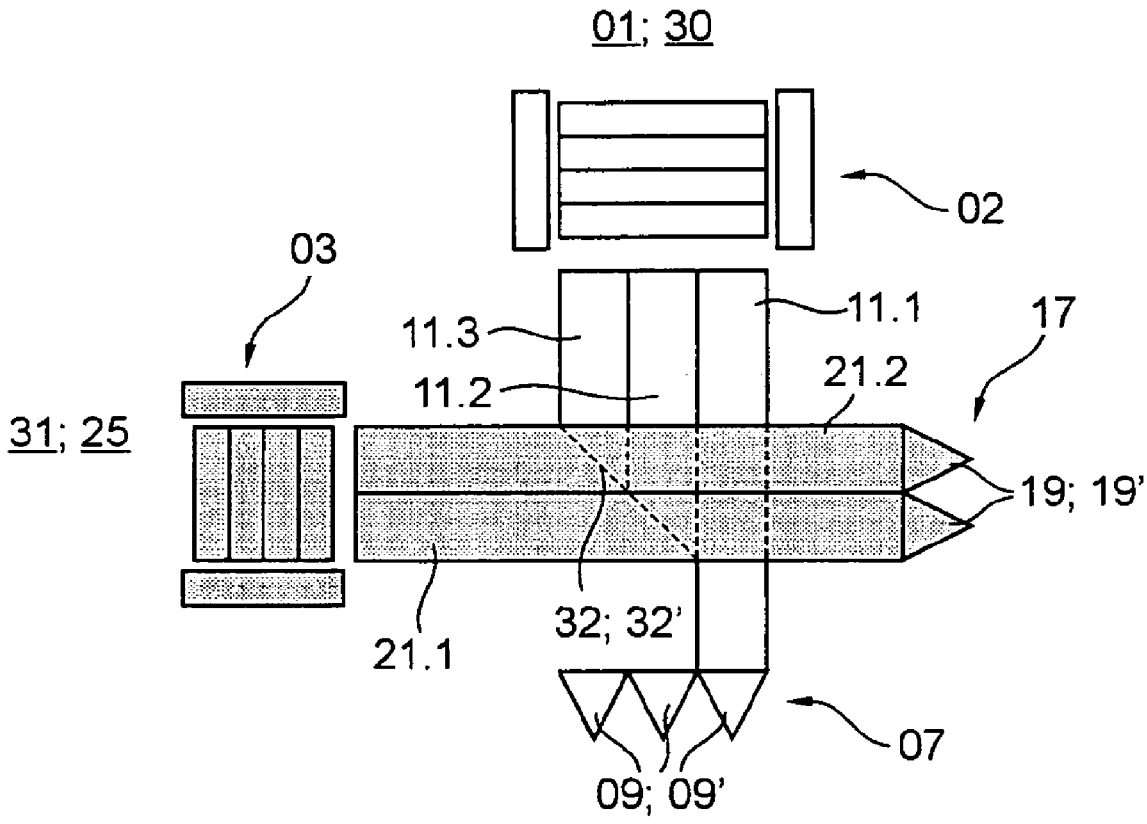

In FIGS. 3 to 5 two formers 09, 19, or two groups of formers 09, 19 or 09', 19', arranged on top of each other, per each former structure 07, 17 are provided by way of example. The explained principle of web conduct and deflection, however, should be applied, where possible, in the same way to arrangements of only one former 09, 19, or to only one former group. One former structure 07, 17 can also have only one former 09, 19, or one former group, and the other two formers 09, 19, of former groups.

An operational situation of the two crossed printing presses 01, 31 is represented in FIG. 3 wherein, each in a separate production run, production is provided by the one printing press 01 onto the one former structure 07, and by the other printing press 31 onto the other former structure 17. Here, as FIGS. 3 *b*) and 3 *c*) show in the respective lateral views of the two printing presses 01, 31 of FIG. 3 *a*), the webs 11, 21, or the partial webs 11.1, 11.2, 11.3, or 21.1, 21.2, are conducted, without turning, in a straight line onto the assigned former structure 07, 17. As indicated by dashed lines in FIG. 3 *b*), a partial web 21.2 can also be conducted onto a former 19 of the one group, and the other partial web 21.1 on a former 19' of the other group, or both partial webs 21.1, 21.2 can be conducted onto the lower former group.

By way of example, FIGS. 4 *a*) to *c*) show an operational situation with mixed production on the former structure 07 of the printing press 01 of the first type. A partial web 21.1 from the second printing press 31, which was longitudinally cut upstream of the turning arrangement 10, is deflected by 90° by a guide element 32, such as, for example, by a turning bar 32 of the turning arrangement 10, and is conducted into alignment with a partial web 11.1 of the first printing press 01. For this purpose, the superstructure 05 has the turning arrangement 10, as well as at least one group of guide rollers 13. The turning arrangement 10, such as, for example, a turning deck 10, has a group of several turning bars 32 arranged on top of each other on different levels. Regarding the position of their level, at least a portion of the groups of turning bars 32 advantageously corresponds with at least two guide rollers 13 of the group of guide rollers 13 in such a way that the web 21, or the partial web 21.1, which is selectively conducted over one of three turning bars 32, that are arranged on top of each other, can come to lie either above, as seen in FIG. 4 *c*) in solid lines, or underneath, as seen in FIG. 4 *c*) in dashed lines, of a web 11, or of a partial web 11.1, 11.2 (11.3), which was imprinted in the first printing press 01. The partial web 21.1, which is shown in solid lines, can also be guided onto a former 09' of the upper group of formers. The other partial web 21.2 can either also be turned into alignment with a partial web 11.1, 11.2, 11.3, or a former 09, 09' of the other printing press 01 or, as represented, can be guided straight ahead onto the former structure 17. The reference numerals represented in FIG. 4 should be applied to the subsequent drawing figures.

In another embodiment, only one turning bar 32 can be provided in the turning arrangement 10 for each partial web 21.1, 21.2 to be turned from the second printing press 31, which, however, corresponds, in height, with four rollers of a group of guide rollers 13 in such a way that, depending on the conduct of two webs 11.1, 11.2 (11.3) which were imprinted in the first printing press 01, both of these webs come to lie above the turned-in web 21, both underneath, or one below and one above the turned-in web 21.

The conduct of the web, which is represented by way of example in FIG. 3, can also take place in a different way in that, for example, both partial webs 21.1, 21.2 are now selectively conducted onto two different formers 09, 09', onto the same former 09, 09', or onto formers 09, 09' of different groups of formers of the former structure 07. With only a multi-width turning bar 32, 32' per web 21 of the second printing press 31, the partial webs 21.1, 21.2 being formed can only be conducted onto two formers 09, 09' of adjoining formers 09, 09', or aligned formers of the two groups. If it is intended that a number "j" of partial webs 21.1, 21.2 of the one printing press 01, 31 can be turned independently of each other into the machinery alignment M1, M2 of the other printing press 01, 31, at least "j" turning bars 32 must be provided in the turning arrangement 10. If, for example, in an m-multi-width printing press 01, 31 all of the partial webs 21.1, 21.2 of a web 21 are to be capable of being turned into the other machinery alignment M1, j=m turning bars 32 must be provided for each web 21.

FIG. 5 shows, by way of example, an operating situation with mixed production on the former structure 17 of the printing press 31 of the second type. A single- or multi-cut partial web 11.2 of the first printing press 01, which has been longitudinally cut upstream of the turning arrangement 10, is deflected by 90° over a turning bar 32, 32' of the turning arrangement 10 and is conducted, in alignment, with a single- or a multi-width partial web 21.1, 21.2 of the second printing press 31. In the example depicted here, a multi-width partial web 11.2, 11.3, or two single-width partial webs 11.2, 11.3 of a first, full web 11 coming from a wider printing press 01 are brought in alignment with partial webs 21.1, 21.2 of a second, full web 21 coming from a narrower printing press 31, and wherein the web width of the uncut first web 11 is greater than the web width of the uncut second web 21. Here, the other partial web 11.1 runs, for example conducted straight, onto a former 09, 09' of the first printing press 01. Definitely stated, here one or several partial webs 11.1, 11.2, 11.3 of a triple-width web 11 are turned by 90° into an alignment of a double-width printing press 31, or onto a merely double-wide former structure 17. Generally speaking, here a partial web 11.1, 11.2, 11.3 of an n-times wide web 11 is turned by 90° into alignment with an (n−1)-times wide printing press 31, and/or is conducted on an (n−1)-wide former structure 17.

Figure 6:
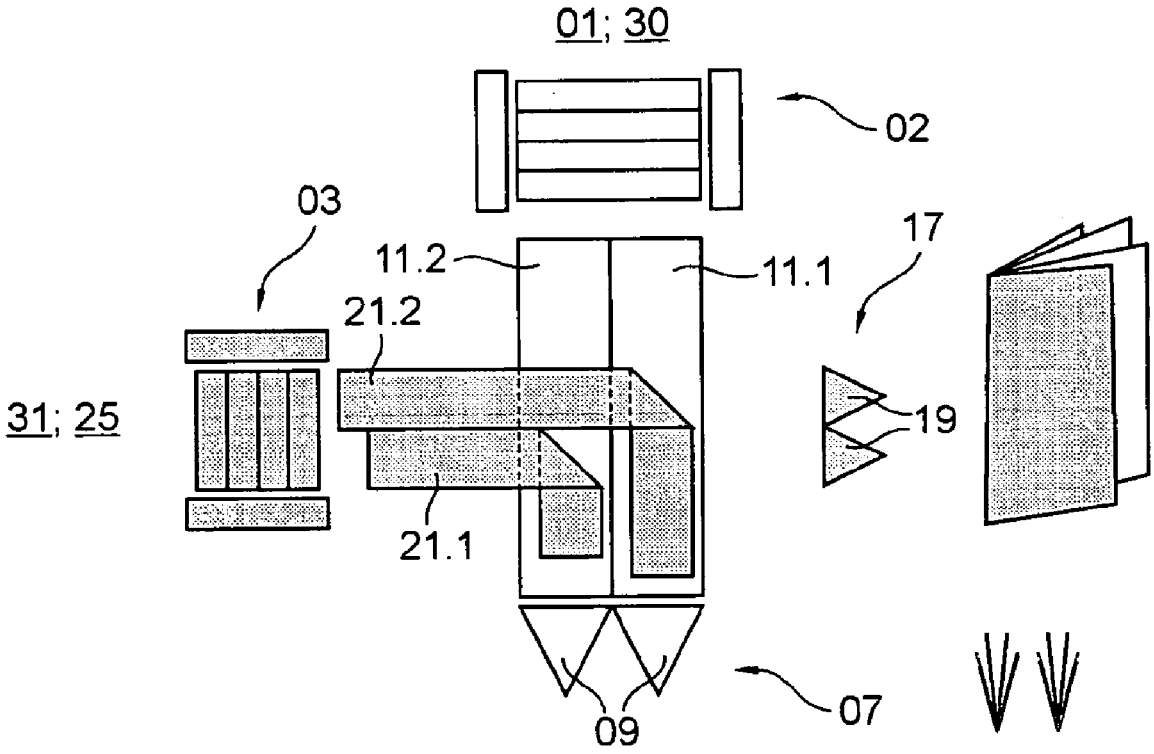

Examples of a printing press system in an X-placement are provided in FIG. 6. The one, first printing press 01 is embodied, or is operated, as an n-times wide press, and in this case as a double-wide printing press 01 with an n-times wide, here double-wide, former structure 07 in relation to a first printed page format. The second printing press 31 is embodied as an m-times wide, with m=n, and in this case, as a double-wide printing press 31 with an m-times wide, with m=n double-wide former structure 17 in relation to a second, for example smaller printed page format. Accordingly, in the first printing unit 02, the web 11 is imprinted with wider print images than is the web 21 which is imprinted in the second printing unit 03. The partial webs 11.1, 11.2 of the first printing unit 02, being formed by longitudinal cutting and containing two printed pages of the larger format side-by-side, are therefore wider than are the partial webs 21.1, 21.2 of the second printing unit 03 and which are being formed by longitudinal cutting and containing two printed pages of the smaller format side-by-side. If the partial webs 11.1, 11.2, 21.1 21.2 of different width are brought together on a former 09 and are longitudinally folded, a projection of the wider over the narrower partial product is formed on at least one side of the continuous web. For an illustration, see FIG. 6, and FIG. 13 right side. In an advantageous manner, the lateral projection of the one partial product can also be imprinted and can already provide a reader with information even in the closed state of the end product, or can constitute an aid to orientation.

The first printing press 01 can also be configured in such a way that the first printing units 02 can selectively be operated n-times wide in the larger format and (n+1)-times wide in the smaller format, such as depicted in FIG. 3 or 4, for example. In this case, it is possible, as will be explained in greater detail subsequently, a group of wider and a group of narrower formers 09, 09' can be provided in a former structure 07.

Figure 7:
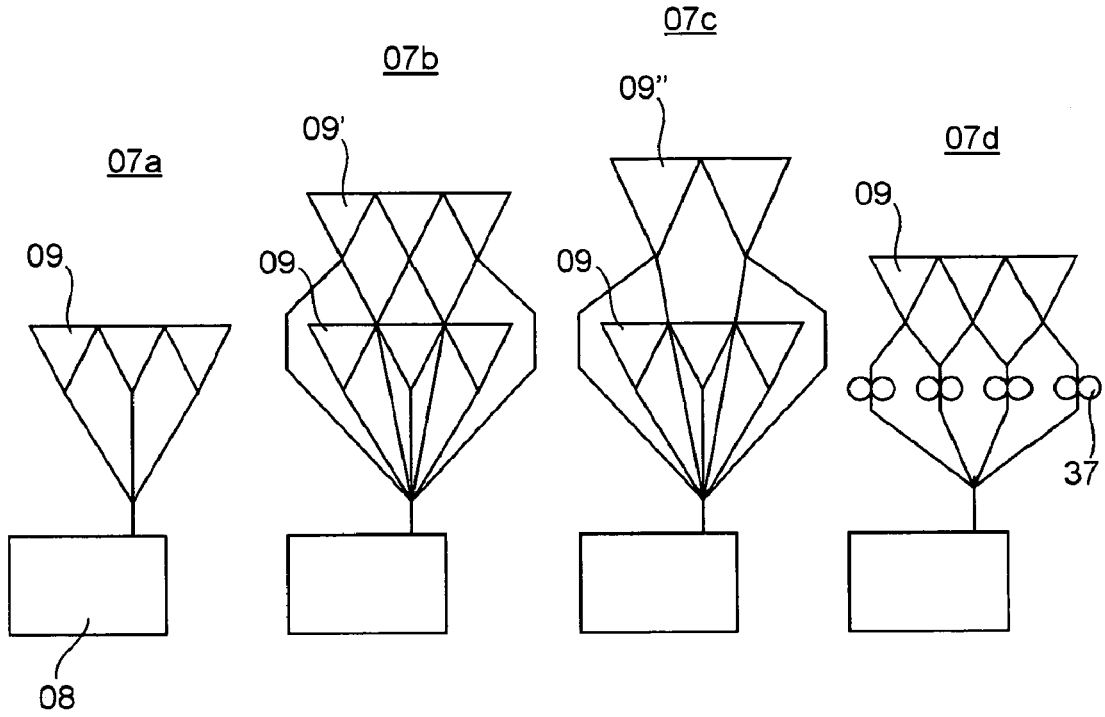

FIG. 7 depicts different alternatives for embodiments of a triple-width former structure 07, at least in a defined printed page format. The embodiment, in accordance with the former structure 07*a*, has a former group of three formers 09 arranged on only one level and situated side-by-side transversely to the incoming direction of a web 11. The effective width of these three formers 09 maximally corresponds to the effective barrel length of a forme cylinder 04 of the printing unit 02 which is arranged in a straight line upstream of the former structure 07, for example. The folding group 08 is arranged downstream of the former group. In the embodiment of the former structure depicted in FIG. 07*d*, the latter has additional, not specifically represented, longitudinal cutting arrangements located in the web path upstream or downstream of the folders 09 for the centered longitudinal cutting of the partial webs 11.1, 11.2, 11.3 in the area of the back of the fold of the longitudinally folded continuous web. These partial webs, which are cut open along the back of the fold and which are then placed on top of each other on the same former 09, can now be divided and, depending on the requirements, can be combined via guide and/or traction rollers 37 with a continuous web or with a partial continuous web of an adjoining former 09. This is advantageous, in particular, if a further processing stage, such as a gluing device or a stapler, is/are arranged on one or several of the possible continuous web paths between the formers 09 and the folding group 08. It is possible, by the use of this, and depending on the distribution of the continuous webs, to make a variable assignment of the partial webs to stapled/non-stapled or to glued/not glued continuous webs.

In the embodiment of the former FIG. 07*b*, the latter has two former groups each of three formers 09, 09' each side-by-side in each group and on two levels which are vertically offset in respect to each other.

In the embodiment of the former of FIG. 07*c*, the latter has two groups, arranged on top of each other, each with a different number of formers 09, 09" which, in each group, are arranged horizontally side-by-side as a former group, and/or has two groups of formers 09, 19 of a differently effective width or former format. For example, the first one of the groups is embodied to be of triple width in accordance with a first printed page format, and has three single-width formers 09 in accordance with this printed page format In accordance with a second, for example, larger printed page format, the second group is embodied to be of double-width and has two single-width formers 09" in accordance with this printed page format. For example, the group with the larger number of formers 09 has, as a whole, an effective width which corresponds, for example, to the maximally effective barrel length of a forme cylinder 04 of the printing unit 02, which is located upstream of the former structure 07 in a straight line. In contrast thereto, the wider formers 09" have a significantly larger effective width, being, for example, larger by a factor of 1.1, and in particular by a factor of 1.2, than that of the formers 09 of the first group. This former arrangement of the former structure 07*c* is, in particular, advantageous in connection with printing presses which have been arranged for the imprinting of variable web widths and/or for the making of products with different print formats. This arrangement is also advantageous for producing so-called "pop-up" products by the use of the two combined printing presses, such as has already been represented by way of example in FIGS. 3 and 4. A pop-up product is distinguished in that, in the folded, or in the combined product, one part has a greater width and/or length than another part, so that a projection of a partial product over another partial product is formed. In the finished product, this projection is advantageously at least 10 mm, and in particular is at least 20 mm wide, and advantageously contains a portion of a print image, such as, for example, text.

Figure 8:
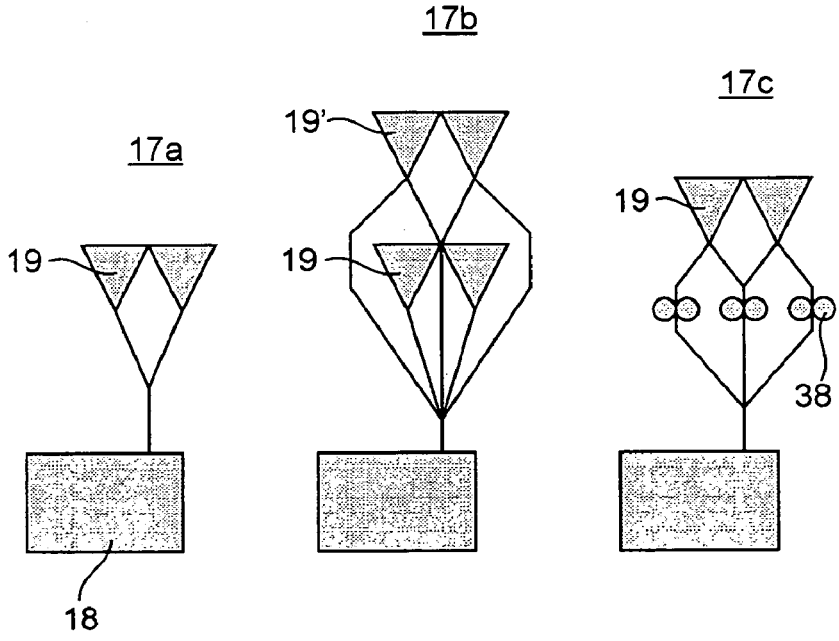

Various alternatives of the embodiments of a double-width, at least in a defined printed page format, former structure 17 are depicted in FIG. 8. The embodiment in accordance with former structure 17*a* has a former group of two formers 19, which are arranged side-by-side transversely to the incoming direction of a web 21, and which are situated at only one level. The effective width of these two formers 19 corresponds, for example, maximally to the effective barrel length of a forme cylinder 14 of the printing group 03 which is arranged in a straight line upstream of the former structure 17. The folding group 18 is arranged downstream of the former group. In the embodiment of the former structure 17*c* of FIG. 8, the latter additionally has not specifically represented longitudinal cutting arrangements in the web path upstream or downstream of the folders 19 for the centered longitudinal cutting of the partial webs 21.1, 21.2 in the area of the back of the fold of the longitudinally folded continuous web. These partial webs, which have been cut open along the back of the fold and which have been placed on top of each other on the same former 19, can now be divided and, depending on the requirements, can be combined, via guide and/or traction rollers 38, with a continuous web or with a partial continuous web of an adjoining former 19. This is advantageous, in particular, if a further processing stage, such as a gluing device or a stapler, is/are arranged on one or on several of the possible continuous web paths between the formers 19 and the folding group 18. It is possible, by this, depending on the distribution of the continuous webs, to make a variable assignment of the partial webs to stapled/non-stapled or glued/not glued continuous webs.

In the embodiment of the former structure 17*b* of FIG. 8, the latter has two former groups of two formers 19, 19' each side-by-side on two levels that are vertically offset with respect to each other.

Figure 15:
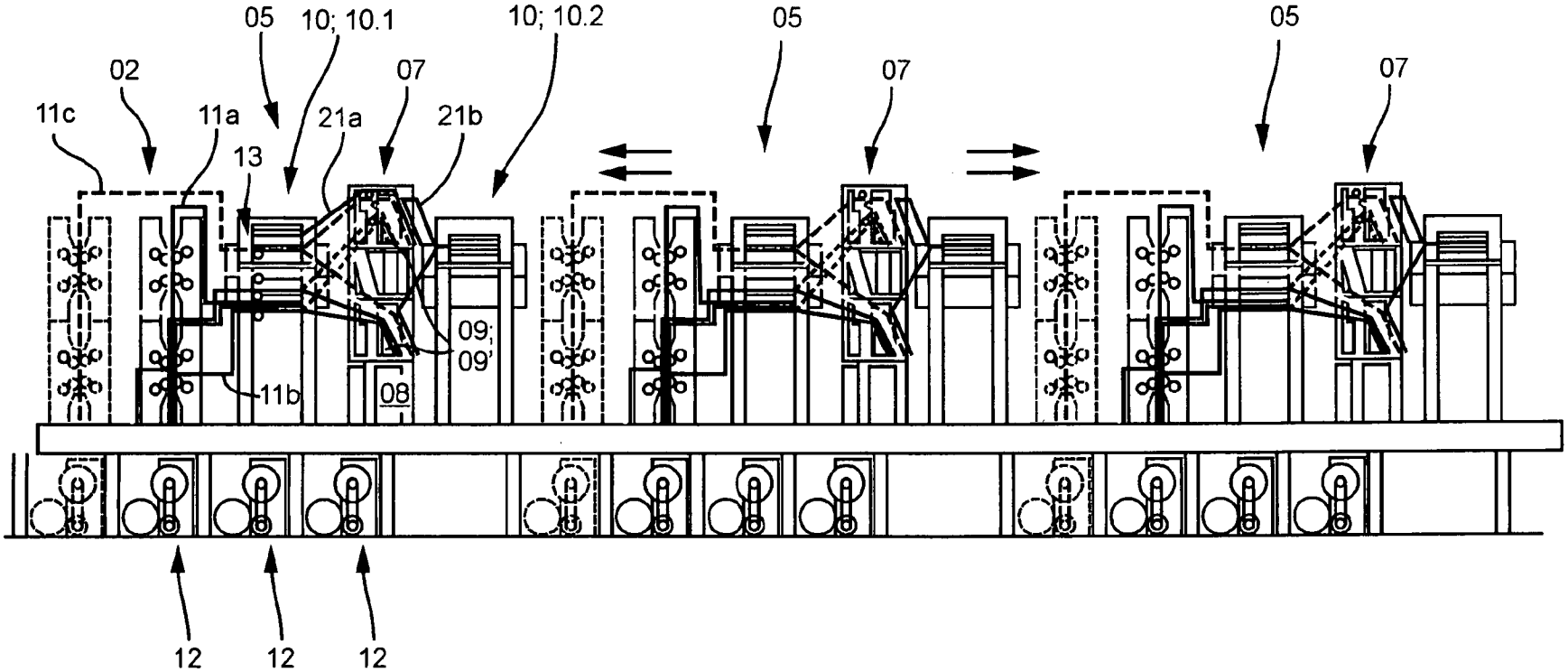

In an embodiment of the former 17, which is not specifically represented, the latter can have, corresponding to the principle shown in FIG. 7, and in FIG. 15, there as the former structure 07*c*, two groups, which are arranged on top of each other, each with a different number of formers arranged horizontally side-by-side as a former group, and/or two groups of formers of a differently effective width or former format. For example, a first one of the groups is embodied to be of double-width in accordance with a first printed page format, and has two single-width formers 19 in accordance with this printed page format. Above or below this first group there is a single, significantly wider former, or a group of two wider formers 19, 19'. In this case, what was said regarding the effective width in connection with the former structure 07*c* applies in a figurative sense. It is possible, by the use of such an embodiment of the former structure 07 in connection with the two printing presses 01, 31, to create a pop-up product.

Figure 9:
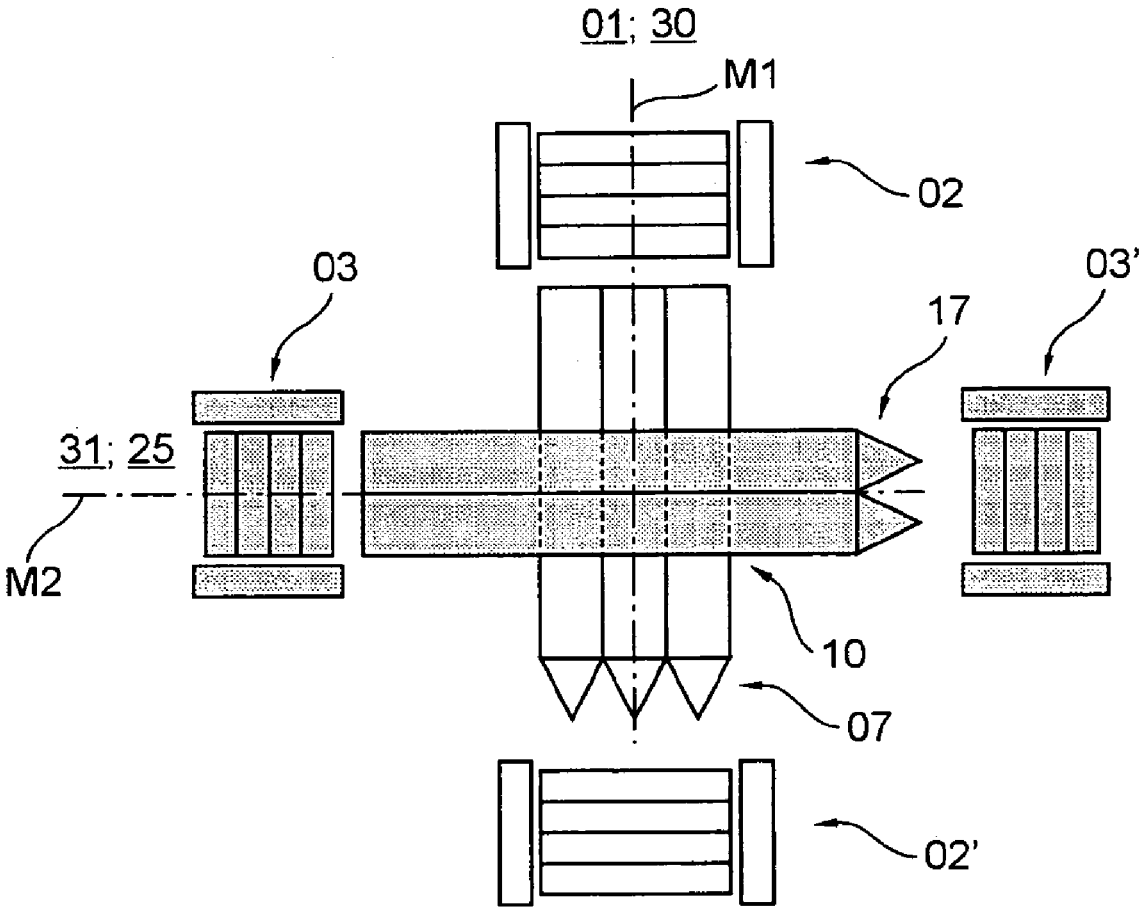

FIG. 9 shows a further development of a combination of two printing presses 01, 31 in an X-placement. In contrast to FIG. 1 or 3, in the case of several printing units 02, 02', 03, 03', two printing units 02, 02', 03, 03' per printing press 01, 31 are arranged in the respective machinery alignment M1, M2 on oppositely located sides of the turning arrangement 10. Webs 11, 21 of these second printing units 02, 02', 03, 03', which are arranged on the opposite side of the turning arrangement 10, can be turned "backward", also in a straight-ahead embodiment, on the former structure 07 which is located between the two printing units 02, 02', 03, 03' of the same machinery alignment M1, M2, or also by 90° by use of the turning arrangement 10 on the other former structure 17.

Figures 10A, 10B, 10C, 10D:
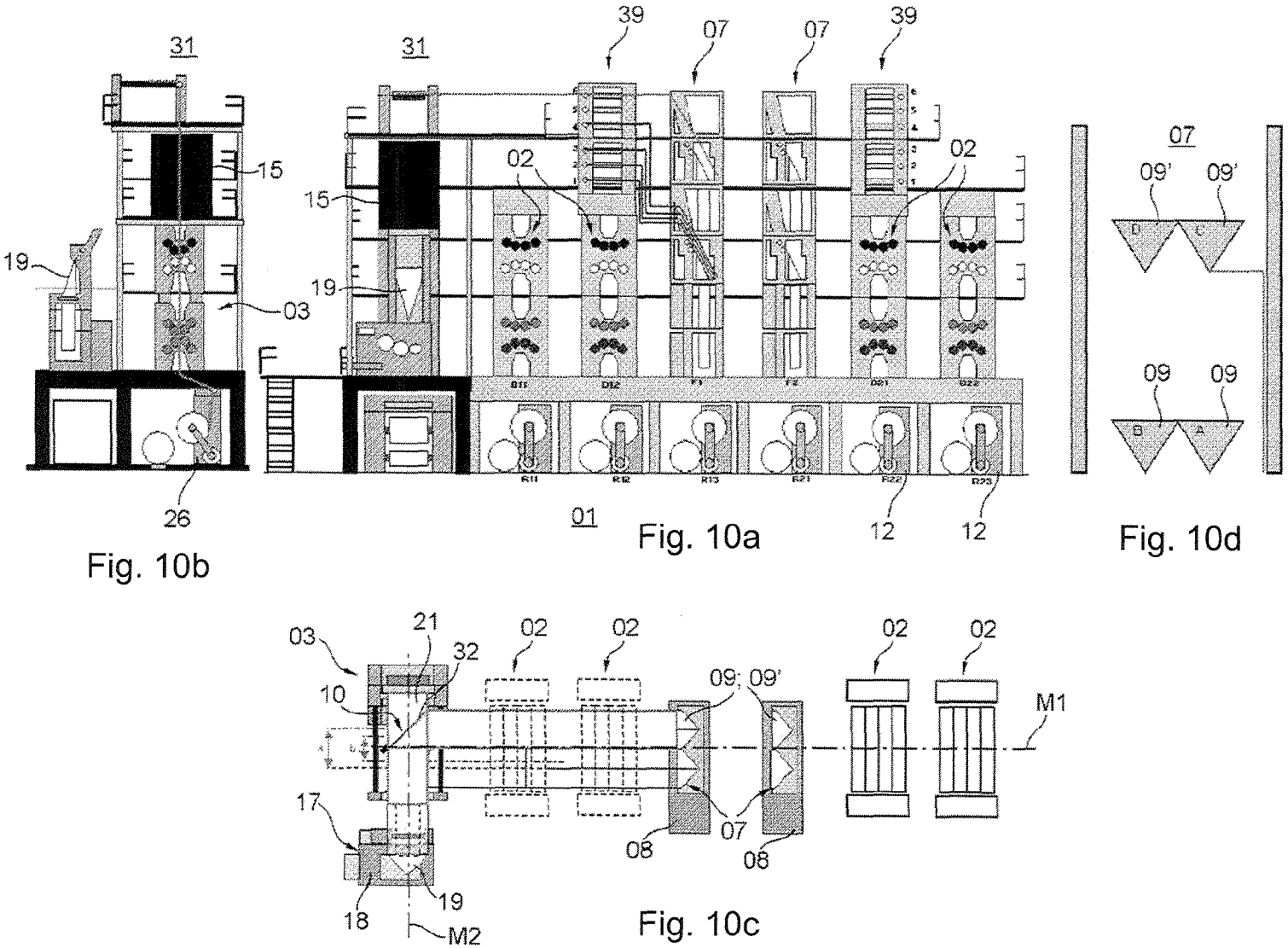

Besides the above-described X-placement, and as represented in FIG. 10, a placement can be advantageous in which, in only one of the two printing presses 01, 31, whose machinery alignments M1, M2 are arranged orthogonally in relation to each other, the printing unit or units 02, 03 and the assigned straight-ahead former structure 07, 17 are arranged on different sides of the machinery alignment M1, M2 of the other printing press 01, 31, so that the webs 11, 21, which, in a separated production run straight, do not cross here on their respective path to the former structure 07. 17. In this orthogonal placement of a first and a second in-line press arrangement 30, 25, or printing press 01, 31, the printing unit or units 03, 02 of, for example, the second machinery alignment M2, M1, and the assigned, straight-ahead arranged former structure 17, 07 of this machinery alignment M1, M2 are on two different sides of the machinery alignment M1, M2 of the first printing press 01, 31, or on the same side of a turning arrangement 10 which can be assigned to the two printing presses 01, 31. The printing unit, or units of the first machinery alignment M1, M2 and the straight-ahead assigned former structure 07, 17 of this machinery alignment M1, M2 are on the same side of the machinery alignment M1, M2 of the second printing press 31, 01, or the same side of the turning arrangement 10 which can be assigned to the two printing presses 31, 01. Since the respective printing units 02, 03 and the former structures 07, 17 of the printing presses 01, 31 are arranged in a T-shape in a view from above, this placement will also be called a T-placement in the discussion that follows.

In a T-placement, such as is shown, for example in FIG. 10, the turning arrangement 10, or a plurality of such turning arrangements 10, as well as one, or a group of guide rollers 32 is embodied, preferably in the area of the crossing point of the two machinery alignments 01, 03, in such a way that at least one web 21, or one partial web, can be selectively conducted from the one in-line press arrangement 25, or printing press 31, straight ahead onto the assigned former structure 17 or, if deflected by one or by several turning bars 32 of the turning arrangement 10 by 90°, onto the former structure 07 of the in-line press 30 arrangement, or printing press 01.

In addition, it is possible to provide turning bars 32 in the turning arrangement 10, or a second turning arrangement 10, as well as to provide one, or a group of guide rollers 29, in such a way that one or several webs 11 from the first in-line press arrangement 30, or printing press 01, can be conducted over these guide rollers 20 and/or turning arrangement s 10, selectively deflected by 90°, onto the former structure 17 of the second in-line press arrangement 25, or printing press 31 instead of onto the straight-ahead assigned former structure 07. In this way, webs 11, 21 from the in-line press arrangement 30 and 25 can again be brought together into a mixed product on a former structure 07, 17.

In the preferred embodiment of the present invention, as depicted in FIG. 10, the first printing press 01 has several, and specifically has four printing units 02 of the first type, as well as having, in the machinery alignment M1, at least one, and having here two former structures 07. In the view of FIG. 10 *a*), the printing press system is represented from the direction of the first printing press 01, in the view of FIG. 10 *b*, is represented from the direction of the second printing press 31, in the view of FIG. 10 *c*), it is depicted from above, and in the view of FIG. 10 *d*) it is shown in a schematic front view of the former structure 07 of the first printing press 01. Here, the printing units 02 of the first type are embodied as printing towers 02 and can represent stacked bridge, stacked satellite or stacked H-printing units.

Roll changers 12, for use in supplying the printing units 02 with the webs 11, which are not specifically represented in FIG. 10, are provided for the printing units 02, for example on a level that is below the level which is supporting the printing units 02. In one type of production, all of the webs 11 which are imprinted in the printing units 02 can be supplied to the former structure 07, which is of double-width here, in a straight line via a superstructure 39 that is assigned to this printing press 01. The printing units 02 of the first printing press 01 are of double-width, for example, and are advantageously embodied as coldset printing units 02. They can be embodied to be single-round or double-round, in respect to a newspaper page.

The printing unit, or units 03 of the second printing press 31 is or are located laterally, as discussed above, to the machinery alignment M1 of the first printing press 01 and orthogonally with respect to it. A roll changer 26, for use in supplying the printing unit 03 with webs 21, is also provided to the printing unit 03, for example on a level below the level that is supporting the printing unit 03. The printing unit, or units 03 of the second printing press 31 are embodied to be of single width, for example, and can be advantageously embodied as heatset printing units 03. In this case, a hot air dryer, a UV dryer or an IR dryer, for example, is provided in the web path. The printing unit, or units 03 of the second type can also be embodied to be single-round or double-round in respect to a newspaper page. In principle, the two printing presses 01, 31, or their two printing units 02, 03 can differ in many of the above mentioned ways in regard to methods, material to be imprinted, ink type and/or printing cylinder size.

The turning arrangement 10, having at least one turning bar 32, is arranged in the crossing point of the two machinery alignments M1, M2 in such a way that, in a mixed production run, the transport direction T2 of the web 21 can be brought over 90° into alignment with a partial web 11.1, 11.2, or with a former 09 of the first printing press 01. Preferably, during a mixed production run, the transport direction T1 of a partial web 11.1, 11.2 can also be changed over 90° into alignment with the web 21, or with the former 19 of the second printing press 31. The turning bar 32 is preferably embodied to be movable in a direction along the machinery alignment M2. In this way, the alignment with the first printing press 01, in regard to running up on one of the several formers 09, 09', can be varied. In a separated production run, the web 21 from the printing unit 03 of the second type, or the "second printing unit", can be conducted straight ahead onto the former structure 17 and into the downstream-located folding group 18, and the webs 11, which are not specifically represented in FIG. 10 and in FIG. 22, can be conducted straight ahead onto the former structure 17 and into the downstream-located folding group 18. To the extent that it is sensible and possible, what was discussed in connection with the previous preferred embodiments, should be applied in regard to the equipment of the individual units, such as printing units 02, 03, former structures 07, 17, turning arrangement 10 and/or folding groups 08, 18.

Figures 11A, 11B, 11C, 11D, 11E:
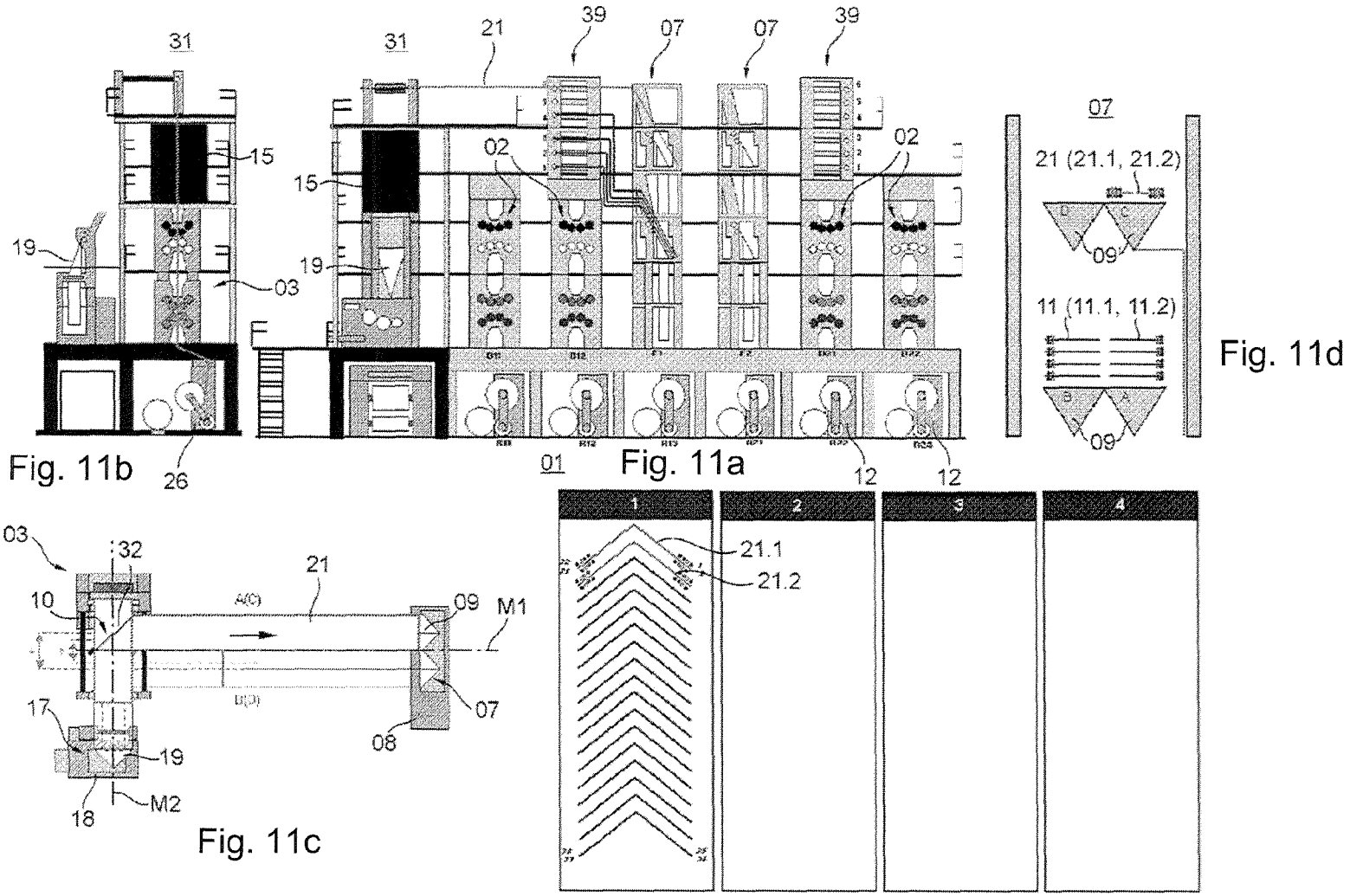
Figures 12A, 12B, 12C, 12D:
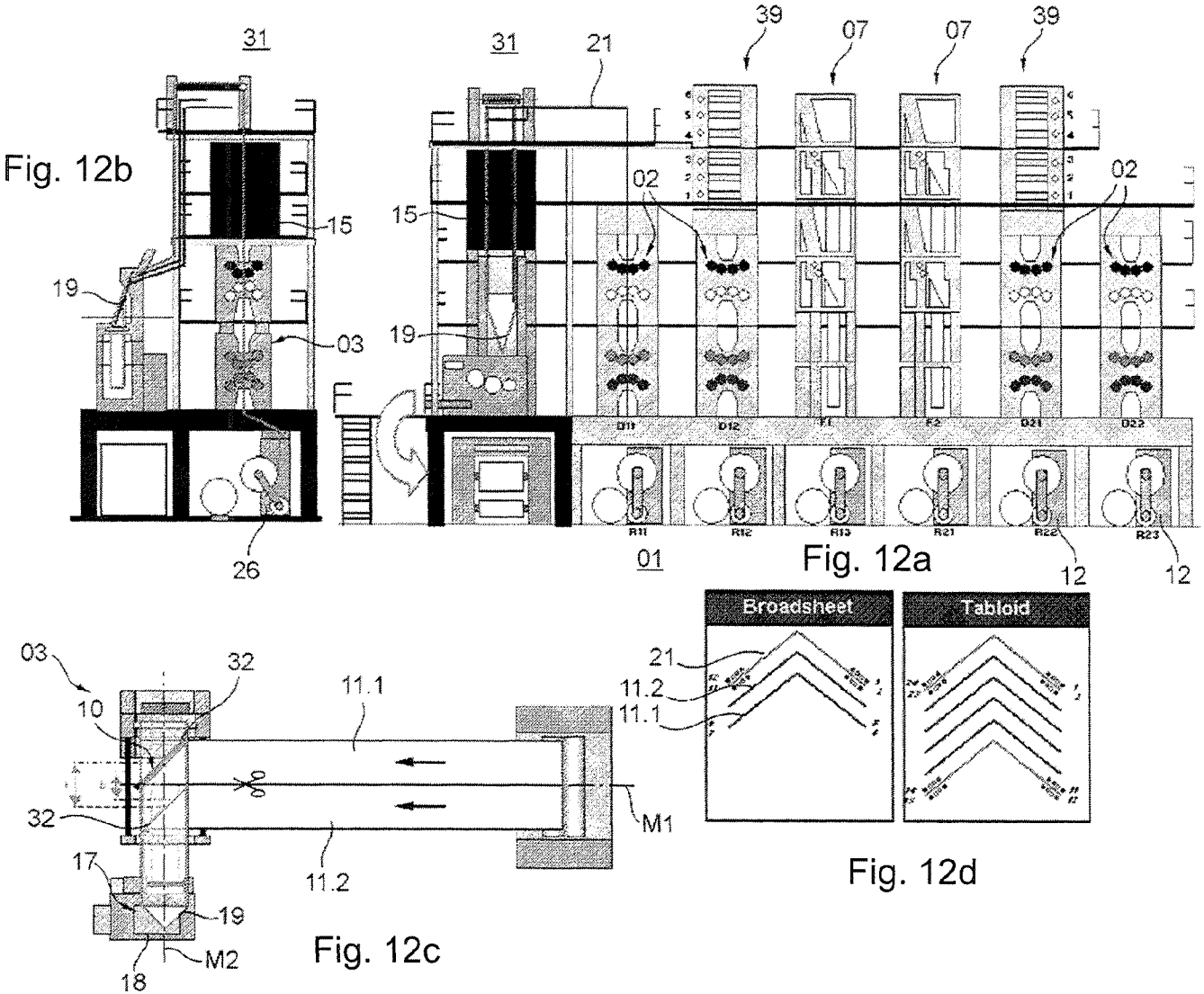

Preferred embodiments of possible production runs, or of web paths of the printing press system, in accordance with FIG. 10, are represented in FIGS. 11 and 12. Here, the views from FIG. 10 have been selected in the representations a) to d) wherein, however, the representation of FIG. 10 *c*) has been reduced to the web path between the former structures 07, 17. The representation e) in FIG. 11 shows the positions of a product made in this production run when the webs 11, 21, or the partial webs 11.1, 11.2, 21.1, 21.2 are cut open in the manner of a tabloid product through the back of the fold to be formed or which has been formed by the formers 09, 09', and the continuous webs are brought together after passing through the former structure 07. FIG. 12 shows, in the representation of FIG. 12 *e*), once the sequence of layers cut open along the back of the fold in a tabloid format, and once a sequence of layers in double-page broadsheet format kept as double pages.

In FIG. 11 the web 21, which is coming from the printing unit 03 of the second type, such as, for example, from a heatset printing unit 03, is turned by the turning bar 32 of the turning arrangement 10 out of the machinery alignment M2 and into an alignment that is parallel to the machinery alignment M1. Here, turning takes place on the level of a first of two adjoining formers 09, 09' of a former group, here called alignment A(C). In the depicted example, the web 21, or single page-wide partial webs 21.1, 21.2 is or are conducted onto the upper former 09' identified by "C". The webs 11, or the partial webs 11.1, 11.2 imprinted in the printing units 02 of the first type, for example coldset printing units 02, are here conducted onto the two lower formers 09"B" and 09"A". By conducting the web 21 on its own former 09"C", and by redirecting of the continuous web thus formed around the lower former 09, it is achieved that the layers from the web 21 come to lie completely on the outside, here on top, in the product as seen in representation e) of FIG. 11.

In contrast to FIG. 11 *c*), however, the web 21 can also be conducted into another alignment B(D), or even exactly between the two alignments with one half on the one former 09, 9' and the other half on the other former 09, 09'. Depending on the alignment in which, and on which former 09, 09' the web 21 is conducted, the position of the layers formed from the web 21 in the total product can be determined.

Now, an operating situation is represented in FIG. 12, in which a web 11, or a partial web 11.1, 11.2 coming from the first printing press 01, or from the printing unit 02 of the first type, is turned into the machinery alignment M2 of the second printing press 31, or of the alignment of a web 21 running, in a straight-ahead embodiment, through the second printing press 31. A mixed production takes place on the former structure 17, here of single width, which is assigned, in a straight-ahead embodiment, to the second printing unit 03. In the embodiment of the printing press system in which it is intended to turn partial webs 11.1, 11.2 of a wider, such as, for example, of a multi-width printing unit 02 into the machinery alignment M2 of a narrower, for example single-width printing press 31, several turning bars 32 are advantageously provided in the turning arrangement 10. This also applies to different, previously mentioned combinations of printing presses 01, 31 of different width.

In the example of FIG. 12, the double-width web 11 is longitudinally cut, the partial webs 11.1, 11.2 are brought into the alignment of the web 21 that was imprinted by the printing unit 03 of the second type, via the two turning bars 32 of the turning arrangement 10, and are guided, together with the web 21, or the partial webs 21.1, 21.2 of the printing unit 03, over the former structure 17. If the layers, which have been conducted on top of each other, are not longitudinally cut in the area of the back of the fold, the broadsheet product, which is represented at the left in the representation of FIG. 12 *e*) results if the partial webs 11.1, 11.2 from the first printing press 01 are turned underneath the web 21 of the second printing press 31. In this case the web 21 of the second printing unit 03 lies on the outside. If the partial webs 11.1, 11.2 were to be turned in above the web 21, the latter would lie on the inside. However, if the layers which are placed on top of each other were to be cut in the area of the back of the fold, the tabloid product represented at the right in the representation of FIG. 12 *e*) results if the partial webs 11.1, 11.2 from the first printing press 01 are turned underneath the web 21 of the second printing press 31. In this case, one of the partial webs 21.1, 21.2 of the second printing unit 03 lies on the outside, and another lies completely on the inside of the total product. If the partial webs 11.1, 11.2 were turned in above the web 21, the layers of partial webs 21.1, 21.2 of the second printing press 31 would lie between the layers of partial webs 11.1, 11.2 from the first printing press 01.

Figure 13:
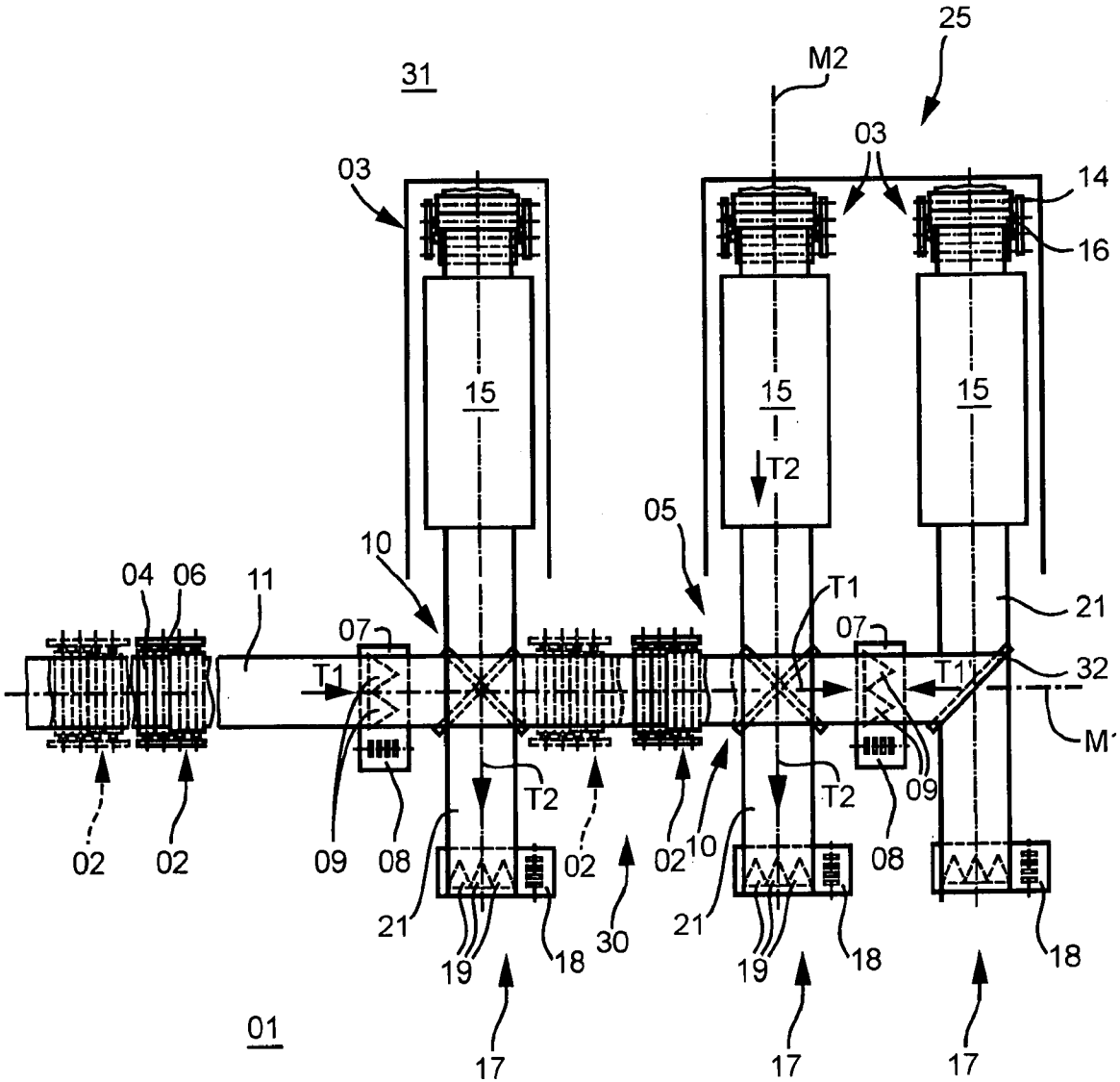

FIG. 13 shows a further example of a printing press system in an X-placement in accordance with the present invention. Several printing units 02 of the first type, for example several "purely" coldset printing units 02, and/or at least one coldset printing unit 02 and a former structure 07, and possibly an additional turning arrangement that is assigned to the first printing press 01, are again arranged in the manner of a so-called in-line press 01, in a common machinery alignment M1 extending perpendicularly in respect to the axial direction of their printing group cylinders 04, 06. Again, a folding group 08, such as, for example, a coldset folding group 08, is arranged downstream of the former structure 07. As was discussed above, one or several formers 09 of the former structure 07 are oriented in such a way that the webs 11, which are running up on the formers 09, have a transport direction T1, T1', as projected onto the horizontal plane, which extends along, or parallel to the machinery alignment M1. This means that the webs 11 which have been imprinted in the coldest printing units 02, can be conducted, in a so-called straight-ahead guided manner, onto the formers 09.

The printing units 02 of the first printing press 01 are embodied as printing towers 02, for example, each of which preferably has two stacked H-printing units. In principle, the printing towers 02 can also have two stacked satellite printing units, or can have four double printing groups for imprinting on both sides of a web.

In the present example, the printing press 01, which is embodied as an in-line press 01, has several, and as depicted here has two former structures 07, each with one respectively downstream arranged folding group 08 and with at least one assigned printing unit 02 of the second type in the machinery alignment M1. A former structure 07, with an assigned printing unit 02, or with assigned printing units 02, can be designated as a section, wherein the assignment of a printing unit 02 arranged, in particular, between two former structures 07 to the one or the other section can be variable. In this case, the printing unit 02 is assigned to the section on whose former structure 07 it performs the production.

Roll changers 12, which are not specifically represented here, for use in supplying the printing units 02 with the webs 11, are assigned to the printing units 02, and are located, for example, on a level which is below the level supporting the printing units 02.

Moreover, units of a so-called superstructure 05 such as, for example, a group of guide rollers 32, called a guide roller group 13 for short and which are not specifically represented, can be provided in the web path between the printing unit 02 and the assigned former structure 07, over which guide roller group 13 the imprinted webs 11 can be conducted, and so that the sequence of the layers on the former 09 can be determined. If needed, the superstructure 05 can have further units, such as, for example, a longitudinal cutting arrangement and/or not specifically represented further turning arrangements, assigned to the first printing press, for partial-width webs.

As can be taken from the depiction of FIG. 13, the former structure 07 can have, in particular in connection with multi-width webs 11, such as, for example, with four, or with even six newspaper pages wide, two formers 09 arranged side-by-side on one level, each of which has a width for the folding of webs 11 of a width of two newspaper pages, or of partial webs 11.1, 11.2. However, more than two, such as, for example, three formers 09, in particular in connection with a triple-width web 11, can be arranged side-by-side on one level. As already described in previous examples, two of these groups, or pairs, or triple groups, of formers 09 can be arranged on two levels above each other, such as, for example, in a balloon former arrangement.

In the represented embodiment of FIG. 13, the printing unit 02 is configured for imprinting webs 11 of a width of four side-by-side arranged upright newspaper pages, and in particular, in broadsheet format, of four horizontal tabloid pages of a first tabloid format, i.e. in double-width. In this case, a not specifically represented longitudinal cutting arrangement is provided in the web path between the printing unit 02 and the former structure 07, which cutting arrangement is configured for cutting the double-width web 11 into two partial webs 11.1, 11.2.

Webs 11, which are intended to be imprinted in the first printing press 01, configured, for example, as a newspaper printing press 01, are for example wound off the roll changer 12, not represented here, conducted through the printing unit 02 and imprinted in a single or a multi-color there, conducted via one of the guide rollers of the guide roller group 13 to the former structure 07, are longitudinally folded on a former 09 and supplied to the folding group 08 for further processing. In connection with multi-width webs 11, such as, for example, four, or even six newspaper pages wide, these webs 11 can either be cut into partial-width webs directly upstream of a not specifically represented turning arrangement of the first printing press, such as, for example, a turning deck, or directly prior to running up onto the formers 09, by the use of an also not specifically longitudinal cutting arrangement. Considered by itself, with printing units 02, possibly a turning arrangement, a former structure 07 and folding group 08, the printing press 01, which is configured in this way, is therefore completely equipped and can be operated independently of another. It is equipped with the required units, such as, for example, with corresponding printing units 02 and/or former structures 07 and/or folding groups 08 for printing and, if desired further processing, of the product to be predominantly made by use of this printing press 01.

At least one printing unit 03, or an in-line press arrangement 25 or printing press 31 of a second type is now again arranged laterally of the machinery alignment M1 of the first printing press 01, as seen in FIG. 13. The printing units 02, 03 of the first and second type are placed orthogonally in respect to each other. This means that the machinery alignment M2 and/or the throughput direction of the dryer 15 is substantially located perpendicularly in regard to the machinery alignment M1. Also, as shown in FIG. 13, several printing groups 03 of in-line press arrangements 25 of the second type can be assigned, laterally offset from each other, to the first printing press 01. As represented, these then can be arranged side-by-side in the axial direction of the printing group cylinder 14, 16. However, in a not specifically represented embodiment, it is also possible for several second printing units 03 to be arranged one behind the other along a machinery alignment M2, for example similar to the in-line arrangement of the printing press 01. Thus, the heatset printing unit, together with the assigned dryer 15, extends transversely with respect to the printing press 01.

The forme cylinder 14 of the heatset printing unit 03 has an effective barrel width, one which is usable for imprinting a web 21, and which corresponds to at least four newspaper pages of the format to be printed on the first printing press 01, for example a newspaper printing press 01.

At least one former structure 17, which is different from the former structures 07 of the printing press 01 and has at least one former 19 and a downstream located folding group 18, for example a heatset folding group 19, is assigned to one or several of the heatset printing units 03 or the heatset in-line press arrangements 25.

As also described in connection with the previous preferred embodiments, both in-line press arrangements 30, 25, which are extending perpendicularly in respect to each other, are respectively configured as printing presses 01, 31 for straight-running imprinted webs 11, 21. This means that the former structures 07, 17 are preferably oriented in such a way that webs 11, 21 of material running up on the former 09, 19 have a transport direction T1, T1', T2 projected onto the horizontal plane, which extends along or parallel to the machinery alignment M1, M2 of the respective in-line press arrangements 30, 25. This means that the webs 11 which are imprinted in the printing units 02, as well as the webs 21 which are imprinted in the printing units 30, can, in one mode of operation, be conducted onto the assigned formers 09, 19 in a so-called straight-ahead embodiment.

In this embodiment of the two printing units 02, 03, or of the two printing presses 01, 31, or of the two in-line press arrangement 30, 25, arranged perpendicularly in relation to each other, it is then provided that, as for example is seen in FIG. 1, the associated former structure 07 of the one printing unit 02, or printing press 01, is arranged in the machinery alignment M1 for straight-ahead running of webs 11 imprinted by this press 01, the assigned former structure 17 of the other printing unit 03, or printing press 31, is now arranged in the machinery alignment M2 also for straight-ahead running of webs 21 imprinted in the in-line press arrangement 25. During "normal" printing operations, without it being intended to bring the webs 11, 21 of the different printing units 02, 03 together, it is now possible to respectively perform the production on the assigned former structures 07, 17 in straight-ahead running. In this case, the former structures 07, 17 then are also located orthogonally to each other in respect to the transport direction T1, T1', T2 of a web 11, 21 running up on them.

In this orthogonal, or crossed placement, or X-placement of the first and second in-line press arrangement 30, 25, the printing unit 03 and the former structure 17, which are assigned in straight-ahead running of the second in-line press arrangement 25, when viewed in a horizontal projection, are arranged on different sides of the machinery alignment M1 of the first in-line press arrangement 30. In this case, the two in-line press arrangements 30, 25 are, for example, arranged in such a way, with respect to each other, that two webs 11, 21, which are imprinted in the two crossed printing presses 01, 31 intersect at right angles, viewed in a horizontal projection, on their path between the printing unit 02, 03 and the former 09, 19, respectively assigned in straight-ahead running. In the area of this intersection point of the two straight-ahead running web paths, the previously described superstructure 05, which has one or a plurality of turning arrangement 10, and a group of guide rollers 13, is embodied in such a way that at least one web 21, or at least one partial web 21.1, 21.2 can be conducted over guide rollers 13 out of the one in-line press arrangement 25 selectively straight ahead onto the assigned former structure 17 or, once they have been deflected by 90°, onto the former structure 09 of the other in-line press arrangement 30. Turning arrangements 13 can also be additionally provided, by the use of which, one or several webs 11 can be selectively conducted, once they have been deflected by 90°, onto the former structure 19 of the other in-line press arrangement 30, instead of only straight ahead onto the assigned former structure 07. In this way, webs 11, 21 from the in-line press arrangements 30 and 25 can be brought together on one former structure 07, 17 to make a mixed product.

In an advantageous embodiment, the heatset former structure 17 has at least two, and in particular has three formers 19 which are arranged side-by-side on the same press level. For example, the latter applies to webs 21 which are of triple-width with respect to a defined printed page format. For example, the formers 19 have a width which is less than half of a web width to be maximally processed in the printing unit 03, and/or the sum of whose widths results in the width of the maximum web width. For example, each former 19 substantially has a width maximally corresponding to one-third of a web width of a triple-width web 21 to be processed in the second printing press 31. The web width to be maximally processed can be, for example, 54". The two outer ones of the three formers 19 are preferably embodied to be movable transversely with respect to the transport direction T3, T3' of the incoming web 21. The center former 19 can be arranged being fixed in the transverse direction. The three formers 19 can be arranged offset, with respect to each other, in the vertical direction in such a way that they nevertheless overlap each other, viewed in the horizontal direction, as is discussed below. Although the three formers 19, when considered from a technical operating point of view, are located on a common machine level, they can be shifted laterally without interfering with each other. This is advantageous if different web widths are to be processed. The previously mentioned folding group 18 is arranged downstream of the former structure 17 and has, for example, in addition to the formers 19 for forming a longitudinal fold, a further, second longitudinal folding arrangement for forming a second longitudinal fold.

A web 21, which is imprinted in the in-line press arrangement 25, in a heatset mode or a coldset mode can, for example, be unrolled from a roll changer 26, which is not specifically represented here, can be conducted through the printing units 03 and can be imprinted there in a single color or in several colors. During a heatset mode, the web 21 is subsequently guided through the activated dryer 15, such as a hot air, UV- or IR-dryer, and, if required, is then guided through a downstream-located cooling device. Alternatively, during a coldset mode, the web 21 is conducted through the deactivated dryer 15, or around it, to the former structure 17 in a straight-ahead run, is longitudinally folded on a former 19 and is conducted to the folding group 18 for further processing. With multi-width webs 21, of, for example, four or six printed pages wide, these can either be cut, by use of the not specifically represented longitudinal cutting arrangement, into partial-width webs directly upstream of the turning arrangement 10, or directly prior to running up on the former 19, and can possibly be laterally offset by a turning arrangement assigned to the second printing press 31 which is not specifically depicted. In this way, the heatset, in-line press arrangement 25, including a possibly provided turning arrangement of its own, the former structure 17 and the folding group 18, considered by itself, forms a completely equipped second printing press 31, such as, for example, from a telephone book or magazine printing press 31, and can be operated independently of the first printing press 01. Press arrangement 25 is thus equipped for printing, and possibly for further processing of the product predominantly to be made by this printing press 31 with the units required, for example respectively corresponding printing units 03 and/or former structures 17 and/or folding groups 18.

In a first production situation of the printing press 31 of the first type, such as, for example, a heatset printing press 31, a magazine production, a telephone book production, or also a catalog production, for example, can take place on three formers 19 in a purely heatset mode with six pages-wide webs 21 in relation to this printed page format. As mentioned above, in this case, the printing form, or formes 29 on the forme cylinders 14 are provided with the six side-by-side placed print images of this format.

In another production situation, the forme cylinders 14 of the second printing unit 03 can, however, be selectively occupied with one or with several printing formes 28, which have print images in a newspaper format, and in particular in the newspaper format to be printed on the first printing press 01, or having print images in the tabloid format to be printed on the first printing press 01. In this case, four printed pages in the appropriate format can then be arranged side-by-side. This production situation of the in-line press arrangement 25 of the second type can preferably take place selectively in a heatset mode or in a coldset mode, for example by taking into consideration the appropriate ink, and/or the appropriate paper, and/or the activity, or the web path in regard to the dryer 15, as has been discussed above.

In order to make possible a mixed production, as in the above-mentioned examples, in a so-called hybrid production, at least one web 21, which has been imprinted by a second printing unit 03, and in particular has been printed in the heatset in-line press arrangements 25, can now be transferred into the first printing press 01 and can be conveyed, together with the web 11 which has been imprinted by a first printing unit 02, over a former 09 of the former structure 07.

Because the in-line press arrangement 25, or the machinery alignment M2, extends transversely to the printing press 01, or its machinery alignment M1, it is possible in a simple way, as in the above-mentioned, preferred embodiments, to bring a web 21, which is coming out of the in-line press arrangement 25 from the direction of the side at various levels, into the superstructure 05 on top of, between or under web layers of webs 11.1, 11.2 which have been imprinted in the printing press 01. With the angled arrangement of the printing units 02, 03, or of the machinery alignments M1, M2, with respect to each other, the webs 21, that have been imprinted in the in-line press arrangement 25, can also be introduced, for example as heatset webs 21 in case of a hybrid production, at any desired level into the superstructure 05, and therefore, without extensive turning and mixing operations, can be introduced into the finished hybrid product.

For this purpose, the first printing press 01 has, in particular in its superstructure 05, at least one turning bar 32 positioned at the level of the machinery alignment M2 of the second in-line press arrangement 25, or printing press 31, by the use of which turning bar 32 a web 21, or a partial web 21.1, 21.2, which is coming in from the direction of the machinery alignment M2, can be deflected into a transport direction along the machinery alignment M1, or the transport direction T1, T2'. Turning bar 32 is substantially angled by 45° in respect to the transport direction T2 of the incoming web 21 and/or the machinery alignment M2.

In the represented embodiment, the turning bar 32 has a usable length corresponding, in its projection onto the incoming web 21, at least to the maximum width of the incoming web 21 and/or to a usable barrel width of the image-conveying printing group cylinder 16. However, as already described in part above, it is possible to provide a plurality of partial-width turning bars 32, such as, for example, a group of turning bars 32 that are arranged on top of each other and which are usable for turning several partial webs 21.1, 21.2.

If the inline press arrangements 25 can be selectively operated in the heatset mode or in the coldset mode, it is possible, in one production situation, such as, for example, during a newspaper production with a large number of pages, to operate one or several of the presses 25, for example equipped with printing formes containing newspaper pages, in a coldset mode, and to introduce "normal" layers of newspaper pages imprinted by coldset into the newspaper product obtained at the coldset folding group 08.

In other production situations, in which a mixed product of newspaper pages and of at least one page, which has been imprinted with a higher quality, is to be produced, one or several of the in-line press arrangements 25 can be operated in the heatset mode, and the heatset partial webs 21.1, 21.2, which have been imprinted in this way, can be admixed to the partial webs 11.1, 11.2, which have been imprinted on the newspaper printing press 01, via the use of the turning arrangement 10.

Figure 14:
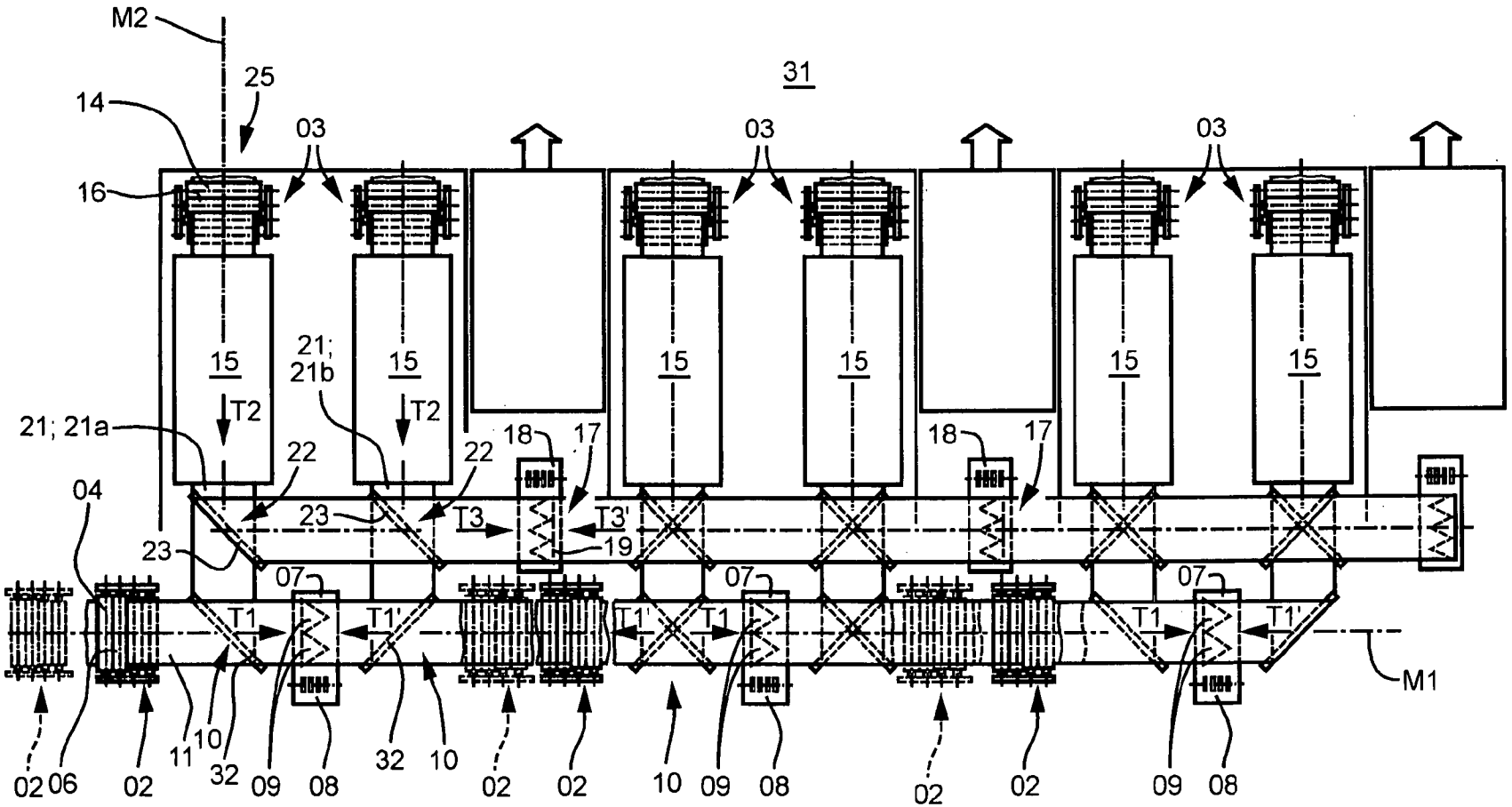

In contrast to the above-described preferred embodiments, although the two printing units 02, 03 of the printing presses 01, 31 are also arranged laterally offset and are positioned orthogonally in respect each other, the formers 09, 19 of the two former structures 07, 17 have an approach direction which is projected parallel, or anti-parallel on the horizontal plane, as may be seen in FIG. 14.

Several printing units 02 of the first type, such as, for example, "pure" coldset printing units 02, and a former structure 07 are again arranged in the manner of a so-called in-line press 01, in a common machinery alignment M1 extending perpendicularly with respect to the axial direction of its printing group cylinders 04, 06. The folding group 08, such as, for example, a coldset folding group 08, is arranged downstream of the former structure 07. One former 9 or several such formers 09 of the former structure 07 are again oriented in such a way that webs 11 of material, such as, for example, paper webs 11, or webs 11 for short, and running up onto the former 09, have a transport direction T, T' projected onto a horizontal plane, which extends along or which is parallel to the machinery alignment M1. This means that the webs 11, which have been imprinted in the coldset printing units 02, can be conducted, in a so-called straight-ahead guided manner, onto the formers 09. In regard to the embodiment of the printing units 02, 03, reference is made to the previous examples.

In the present example of FIG. 14, the printing press 01, which is embodied as an in-line press 01, has several, and in this case has three, former structures 07 in a machinery alignment M1, each with a downstream-located folding group 08, and with at least one assigned printing unit 02. Additional printing units 02 can be optionally assigned to one or to several of the former structures 07, as is indicated by dashed lines in FIGS. 1 and 2. A former structure 07 with an assigned printing unit 02, or with assigned printing units 02, can be called a section, in which section the assignment of a printing unit 02, arranged, in particular, between two former structures 07, to one or the other section can be variable. In this case, the printing unit 02 is assigned to the section on whose former structure 07 it performs the production.

On a level which is below the level that is supporting the printing units 02, for example, the printing units are provided with roll changers 12, as seen in FIG. 15, for supplying the printing units 02 with the webs 11.

Moreover, units of a so-called superstructure 05, such as, for example, a group of guide rollers 32, and called a guide roller group 13, can be provided in the web path between the printing unit 02 and the assigned former structure 07, over which superstructure 05 the imprinted webs 11 can be conducted, so that the sequence of the layers on the former 09 can be determined. If needed, the superstructure 05 can have further units, such as, for example, a longitudinal cutting arrangement and/or not specifically represented further turning arrangements, which are assigned only to the first printing press, for use with partial-width webs 11.1, 11.2, 11.3 and/or with longitudinal registration arrangements.

As can be taken from the depiction of FIG. 14, the former structure 07 can have, in particular in connection with multi-width webs 11, such as, for example, with four, or even six newspaper pages wide webs 11, two formers 09 that are arranged, side-by-side on one level, each of which having a width for the folding of webs 11 of a width of two newspaper pages, or of partial webs 11.1, 11.2, 11.3. However, more than two, such as, for example, three formers 09, and in particular for use in connection with a triple-width web 11, can be arranged side-by-side on one level. In accordance with FIG. 15, two of these groups, or pairs, or triple groups, of formers 09 can be arranged on two levels above each other, such as, for example, in a balloon former arrangement.

In the represented embodiment, the printing unit 02 is configured for imprinting webs 11 having a width of four side-by-side arranged upright newspaper pages, and in particular such pages in broadsheet format, or four horizontal tabloid pages of a first tabloid format, typically in double-width. Here, single width means two newspaper pages, tabloid pages side-by-side, with double-width and triple width, corresponding to four or six such pages, respectively. In this case, a longitudinal cutting arrangement, which is not specifically represented, is provided in the web path between the printing unit 02 and the former structure 07, which cutting arrangement is configured for cutting the double-width web 11 into two partial webs 11.1, 11.2.

Webs 11, which are to be imprinted in the first printing press 01, that is configured, for example, as a newspaper printing press 01, are, for example, wound off the roll changer 12, conducted through the printing unit 02 and imprinted in a single color or in multi-colors there, are then conducted, via one of the guide rollers of the guide roller group 13, to the former structure 07, are longitudinally folded on a former 09 and are supplied to the folding group 08 for further processing. In connection with multi-width webs 11, such as, for example, four, or even six newspaper pages wide, these multi-width webs 11 can be cut, by use of a longitudinal cutting arrangement, which is not specifically represented into partial-width webs either directly upstream of a turning arrangement of the first printing press which is not depicted, such as, for example, a turning deck, or directly prior to running up onto the formers 09. Considered by itself, the printing press 01, which is configured in this way, is therefore completely equipped and can be operated independently of another one. Printing press 01 is equipped with the required units, such as, for example, respectively corresponding printing units 02 and/or former structures 07 and/or folding groups 08 for printing and, if desired for also accomplishing further processing, of the product to be predominantly made by this printing press 01.

In at least one mode of operation, at least one printing unit 03 of the second type, such as, for example, a heatset printing unit 03, as well as a dryer 15 which is arranged downstream of the printing unit 03, besides the at least one, typically coldest printing unit 02 of the first type, is now additionally located on a possible web path to at least one of the former structures 07 of the printing press 01. The at least one printing unit 03 of the second type, and the possibly associated, assigned dryer 15, are arranged in a machinery alignment M2 extending along a transport direction T2, projected onto the horizontal plane, of a web 21 conducted through these two units. The arrangement of one or of several second printing units 03, possibly together with a dryer 15, such as, for example, a hot air, UV- or IR-dryer, in a machinery alignment M2, is again called an in-line press arrangement 25, and in particular is referred to as a heatset in-line press arrangement 25.

The at least one second printing unit 03, or in-line press arrangement 25, which, for example, is configured for heatset printing, is again oriented orthogonally to the first printing unit 02, or to the first printing press 01, configured for coldset printing, within the meaning of what was said above. The machinery alignment M2, and/or the passage direction through the dryer 15 extends substantially perpendicularly to the machinery alignment M1, for example.

Regarding a possible web path, several, typically heatset, printing units 03 of the second type can also be assigned to a former structure 07 of the newspaper printing press 01. As is represented in FIG. 14, these printing units can then be arranged side-by-side in the axial direction of the printing group cylinders 14, 16. However, in a representation which is not specifically shown, several such heatset printing units 03 of the second type can be arranged one behind the other along a machinery alignment M2, similar to an in-line arrangement of the printing press 01. Thus, the typically heatset printing unit 03, together with the associated dryer 15, extends transversely with respect to the printing press 01.

The printing unit 03 of the heatset in-line press arrangement 25 of the second type is, for example, configured as a printing tower 03, which preferably has four stacked double printing groups for two-sided imprinting, such as, for example, so-called bridge or n-printing units. However, in principle the printing tower 03 can also have two stacked H-printing units, or two stacked satellite printing units, or can be formed from these.

The printing unit 03 of the second in-line press arrangement 25, which, for example, is configured as heatset in-line press arrangement 25, is, for example, configured as a printing tower 03, which preferably has four stacked double printing groups for two-sided imprinting, such as, for example, so-called bridge or n-printing units. However, in principle the printing tower 03 can also have two stacked H-printing units, or two stacked satellite printing units, or can be formed from these.

In the embodiment of the present invention, in accordance with FIG. 14, two heatset printing units 03, oriented in the above mentioned way, and each with, for example, a dryer 15, or with in-line press arrangements 25, are assigned to each one of the former structures 07 of the newspaper printing press 01.

At least one former structure 17 is assigned to one or to several of these heatset printing units 03, or heatset in-line press arrangements 25, which former structure 17 is different from the former structures 07 of the printing press 01 and which has at least one former 19 and a downstream-arranged folding group 18, such as, for example, a heatset folding group 18. One or several formers 19 of the former structure 18 are preferably oriented in such a way that webs 21 running up on the former 19 have a transport direction T3, T3' projected onto the horizontal plane, which substantially extends parallel to the axial direction of the printing cylinders 14, 16 of the heatset printing unit 03, and/or running substantially perpendicularly to the machinery alignment M2 and/or parallel to the machinery alignment M1 of the printing press 01. This means that the webs 21, which are imprinted in the heatset printing units 03, when viewed in the horizontal direction, are initially subjected to a directional change, for example by 90°, before they are conducted onto the former(s) 19. A web path from the printing unit 03 to the former structure 17, projected onto the horizontal plane, therefore extends at an angle. In particular, this web path has a 90° kink.

In the depicted example, the printing unit 03, which is embodied as a heatset printing unit 03, is embodied to be occupied by, and to imprint webs 21 of a width of six side-by-side arranged printed pages of a second tabloid format, and in particular webs in a magazine or telephone book format. This means that printing unit 03 is embodied in triple width in regard to the magazine or telephone book format. Here, single width means two magazine or telephone book pages side-by-side, double- and triple-width correspondingly mean four or six such pages. However, the forme cylinder 14 of the typically heatset printing unit 03 of the second type also has an effective barrel width, which is usable for imprinting a web 21, which web 21 corresponds to at least four newspaper pages of a format corresponding to the format to be imprinted on the newspaper printing press 01.

Figure 17:
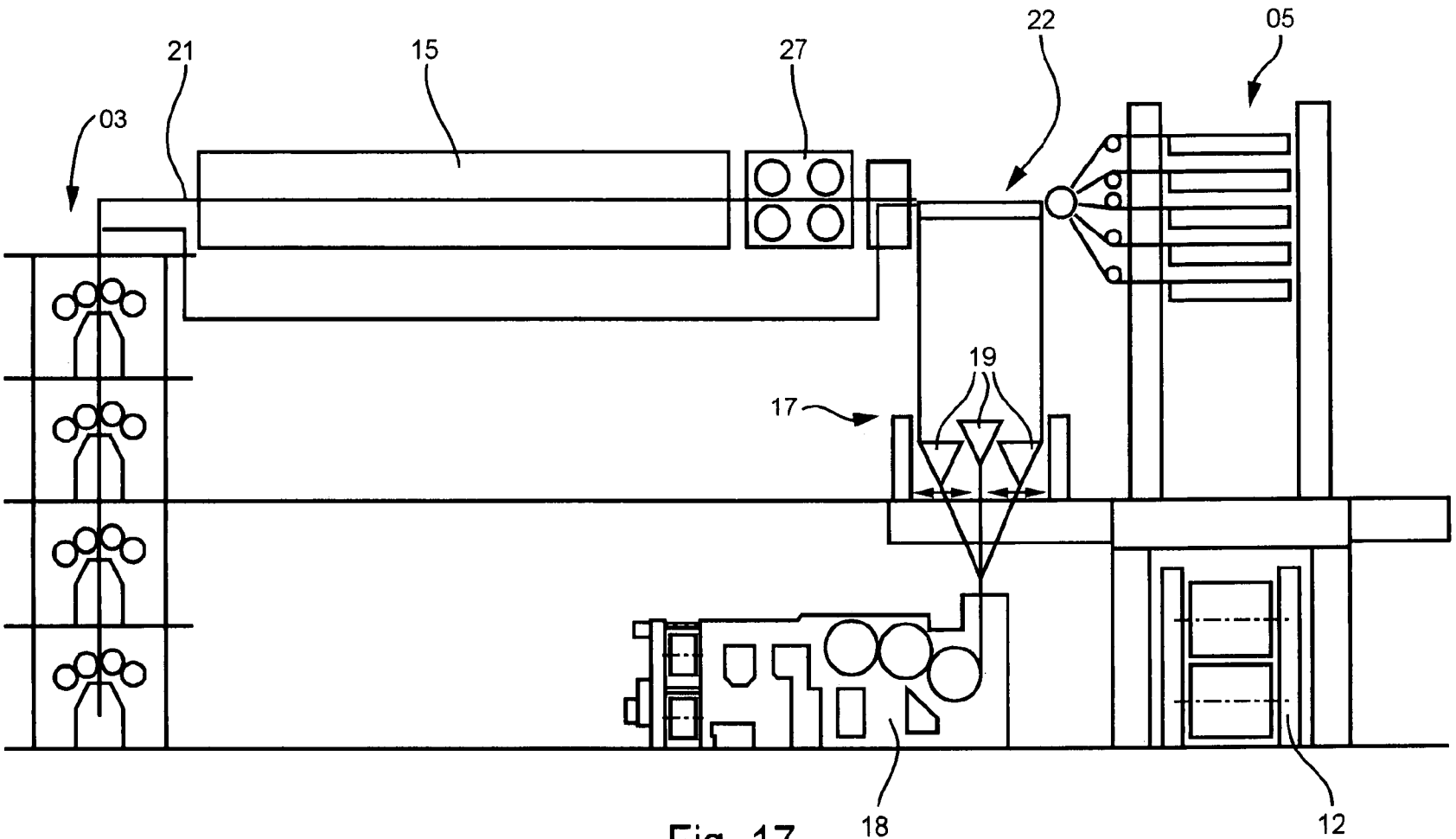

In an advantageous embodiment, the typically heatset former structure 17 has at least two, however, in particular, may have three, formers 19, arranged side-by-side on the same press level. The latter applies, for example, in connection with the above mentioned triple-width webs 21 of the tabloid format. For example, the formers 19 have a width which is less than half the maximum web width to be processed in the printing unit 03, and/or the sum of whose widths results in the width of the maximal web width. Each former 19 is, for example, substantially of a width corresponding, at a maximum, to a third of a to be processed web width of a triple-width web 21. The maximum web width of a web to be processed can be, for example, 54". Preferably, the two outer ones of the three formers 19 are embodied to be movable transversely to the transport direction T3, T3' of the incoming web 21, as is indicated by two-headed arrows in FIG. 17. The center former 19 can be arranged fixed in the transverse direction. The three formers 19 can be arranged offset vertically, in respect to each other, in the manner that is shown in FIG. 17, but so that they overlap, when viewed in the horizontal direction. Although the three formers 19, when considered from a technical operating point of view, are located on a common machine level, they can be laterally shifted without interfering with each other. This is advantageous if different web widths are to be processed. The above-mentioned folding group 18 is arranged downstream of the former structure 17 and has, for example, in addition to the formers 19 for forming a longitudinal fold, a further, second longitudinal folding arrangement for forming a second longitudinal fold, as has been discussed above.

To deflect the web 21, in the above-mentioned way onto the typically heatset former structure 17, a turning arrangement 22 is provided in the machinery alignment M2 on the web path downstream of the heatset printing unit 03, and in particular downstream of the dryer 15, which is embodied for deflecting the web path of an incoming web 21, that is projected onto the horizontal plane, by substantially 90°.

In a first embodiment, the turning arrangement 22 is embodied with a number of turning bars, which are corresponding to half the number of the printed pages that are provided side-by-side for printing. In the case of double-width webs 21, this number would be two, and in the present case of triple-width webs 21 there would be three such turning bars. These turning bars are embodied with a length which is configured for deflecting single-width webs 21, or partial webs 21.1, 21.2, such as those of two printed pages in width. For processing double-width or triple-width webs 21, a longitudinal cutting arrangement, which is not specifically represented, is provided in this embodiment between the printing unit 03 and the turning arrangement 22.

However, in an advantageous second preferred embodiment, the turning arrangement 22 has at least one guide element 23, such as, for example, a turning bar 23, whose usable length, in projection onto the incoming web 21, corresponds at least to the maximum width of the incoming web 21 and/or to a maximally usable barrel width of the image-conveying printing group cylinder 14. The guide element 23 is substantially inclined or turned by 45° in relation to the transport direction T2 of the incoming web 21 and/or to the machinery alignment M2. In the instant case, the guide element 23 has a length whose projection onto the incoming web 21 corresponds to at least six side-by-side located tabloid pages of the second format mentioned above. For example, the usable length of the turning bar 23 may correspond to at least 1.4 times the maximal width of the web 21 to be processed in the heatset printing unit 03. This means, in this embodiment, for example, to at least 1.4 times the maximal width of a web 21 of a width of six horizontal tabloid pages.

If several webs 21 can be imprinted in the machinery alignment M2 by the use of one or of several heatset printing units 03, which are arranged one behind the other in the machinery alignment M2, the turning arrangement 22 has, for example in a configuration arranged on top of each other, a plurality of turning bars 23 of such length, and in particular, corresponding to at least the maximum number of the webs 21 to be conducted through the printing units 03.

In an advantageous embodiment of the present invention, the turning bar 23 is configured to be movable, for example in a frame of the turning arrangement 22, transversely to, or, in particular, longitudinally along the transport direction T2 of the incoming web 21, again as seen in FIG. 14. In this way, it is possible, in connection with webs 21 of different width or with narrower starting webs 21 of different lateral orientation, to match the web alignment, resulting after turning, to the position of the formers 19.

Turning of the yet uncut web 21 is possible by the use of a turning bar 23 of such a length. Longitudinal cutting of the web 21, along a cutting line, such as, for example, along a main cutting line between two respectively adjoining formers 19 can then take place, for example, by the use of a not specifically represented longitudinal cutting arrangement, directly prior to the web's running up on the formers 19, for example running up on a former inlet roller or on an upstream arranged further traction roller. Besides a cutter responsible for the main cutting line, the longitudinal cutting arrangement can also have additional cutters, which are aligned with the respective former tips of the downstream located former 19, for the selective formation of further longitudinal cuts, such as, for example, secondary cutting lines.

Figure 16:
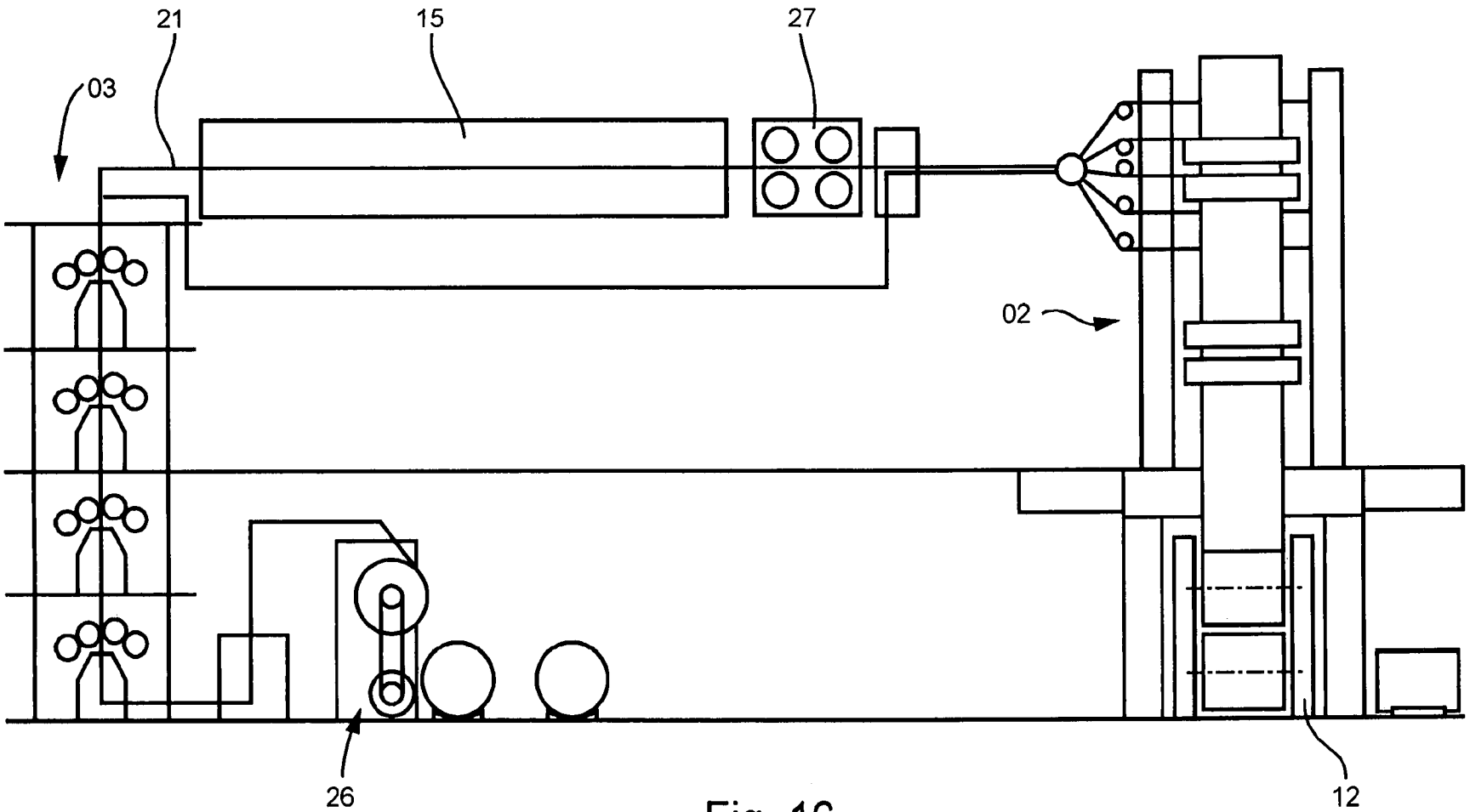

For example, a web 21 imprinted in the above-described second, or heatset, in-line press arrangement 25, in a heatset or a coldset operation, can be wound off a roll changer 26, conducted through the printing unit 03 and can be imprinted in a single or multi-color in the printing unit 03. In a heatset operation, the web 21 is subsequently conducted through the activated dryer 15 and possibly through a downstream arranged cooling arrangement 27 and possibly through a turning arrangement, which is not specifically represented, or, in a coldset operation, is then conducted through the deactivated dryer 15, or around it, to the former structure 17 via the turning arrangement 22, is longitudinally folded over a former 19 and is conducted to the folding group 18 for further processing, as depicted in FIGS. 16 and 17. With multi-width webs 21 of, for example, four or six printed pages wide, the webs 21 can be cut into webs of partial width by the use of the not specifically represented longitudinal cutting arrangement, either directly upstream of the turning arrangement 22 or directly prior to the web's running onto the formers 19 and, if desired, the web can be laterally offset in a turning arrangement, which is not specifically represented. The heatset in-line press arrangement 25 embodied in this way, together with the turning arrangement 22, the former structure 17 and the folding group 18 thus constitutes, viewed by itself, a completely equipped second printing press 31, such as, for example, a telephone book or a magazine printing press 31, and which can be operated independently of the first printing press 01. It is equipped for printing, and possibly for further processing of the product predominantly to be made by the use of this printing press 31 with the units required, such as, for example, with the respectively corresponding printing units 03 and/or former structures 17 and/or folding groups 18.

In a first production situation of the heatset in-line press arrangement 25, such as, for example, in a pure heatset operation, a magazine, a telephone book or also a catalog production with webs 21 of a width of six pages, for example in relation to the above mentioned second tabloid format, on the three formers 19 can, for example, take place. In this case and as mentioned above, the printing formes 29 are then provided with six side-by-side placed print images.

In another production situation, the forme cylinders 14 of the second printing unit 03 can selectively be provided with one or with several printing formes 28 supporting print images in a newspaper format, and in particular, of the newspaper format to be printed in the first printing press, or supporting print images in tabloid format to be printed in the first printing press 01. In this case, four printed pages of the appropriate format, for example, can be arranged side-by-side. This production situation of the in-line press arrangement 25 can selectively occur in a heatset or in a coldset mode, for example by taking into consideration the appropriate ink, and/or the appropriate paper, and/or the activity, or the web path in regard to the dryer 15, as has been discussed above.

Now, in order to make possible a mixed production, or a so-called hybrid production, at least one web 21, which has been imprinted by a second printing unit 03, and in particular has been imprinted in the heatset in-line press arrangements 25, can now be transferred into the first printing press 01. It can be conveyed, together with at least one web 11, which has been imprinted by a first printing unit 02, over a former 09 of the former structure 07.

Because the in-line press arrangement 25, or its machinery alignment M2, extends transversely to the printing press 01 or to its machinery alignment M1, it is possible, in a simple way, to bring a web 21 coming out of the in-line press arrangement 25, from the direction of the side, into the superstructure 05 at various levels on top of, between, or under web layers of webs 11.1, 11.2 11.3 which have been imprinted in the printing press 01. With the angled arrangement of the printing units 02, 03, or of the machinery alignments M1, M2, in respect to each other, the webs 21, which have been imprinted in the in-line press arrangement 25, can also be introduced, for example as heatset webs 21 in case of a hybrid production, at any desired level into the superstructure 05, and therefore can be introduced, without extensive turning and mixing operations, into the finished hybrid product.

For this purpose, the printing press 01 has, in particular in its superstructure 05, the at least one turning arrangement 10 with at least one turning bar 32 at the level of the machinery alignment M2 of an in-line press arrangement 25, by the use of which turning arrangement 10, a web 21, coming in from the direction of the machinery alignment M2, can be deflected into a transport direction along the machinery alignment M1, or transport direction T1, T2'.

In one advantageous embodiment, the turning bar 32 has a usable length which, in projection onto the incoming web 21, corresponds at least to the maximum width of the latter and/or to a maximally usable barrel width of the image-conveying printing group cylinder 14. The turning bar 32 is substantially inclined, or angled, by 45° in relation to the transport direction T2 of the incoming web 21 and/or to the machinery alignment M2. In the instant case, the turning bar 32 has a length whose projection onto the incoming web 21 corresponds to at least four side-by-side arranged upright newspaper pages or tabloid pages of the first mentioned format of the printing press 01. If several webs 21 can be imprinted by one or by several such heatset printing units 03, which are arranged one behind the other in the machinery alignment M2, several such turning bars 32 are provided, for example being arranged on top of each other.

In one embodiment of the present invention, the superstructure 05 here also has at least one turning arrangement 10, such as, for example, a turning deck 10, with a group of several turning bars 32 that are arranged on top of each other on different levels. Regarding the position of their level, at least a portion of the group of turning bars 32 advantageously corresponds with at least two guide rollers of the group of guide rollers 13 in such a way that the web 21, which is selectively conducted over one of three turning bars 32 arranged on top of each other, can come to lie either above, between, or underneath of two or more partial webs 11*a*, 11*b*, 11*c* which have been imprinted in the first printing press 01.

In another embodiment of the present invention, only one turning bar 32 can be provided in the turning arrangement 10 which, however, in its level, corresponds with four rollers of the guide roller group 13 in such a way that, depending on the guidance of two or more webs 11*a*, 11*b*, 11*c* imprinted in the first printing press 01, both of these come to lie above the turned-in web 21, both come to lie underneath web 21, or one comes to lie below web 21 and one comes to lie above the turned-in web 21.

Since, in an embodiment of the invention as outlined above, the in-line press arrangements 25 can be selectively operated in the heatset mode or in the coldset mode, it is possible, in one production situation, such as, for example, in the course of a newspaper production, with a large number of pages, to operate one or several of the in-line press arrangements 25, equipped for example with printing formes having newspaper print pages, in the coldset mode and to exclusively introduce "normal" layers of newspaper pages, which were printed in the coldset operation, into the newspaper product that has been obtained at the coldset folding group 08. Thus, for example, the webs 21*a* and 21*b*, as identified in FIGS. 14 and 15 for the left side, could be imprinted in the coldset mode without utilizing the respective dryer 15 and could then be brought together, via the two turning arrangements 10.1 and 10.2, with webs 11*a*, 11*b* from the printing press 01, and could then be further processed into one product.

In other production situations, in which a mixed product of newspaper pages and at least one page, which has been imprinted with a higher quality, is to be produced, one or several of the in-line press arrangements 25 can be operated in the heatset mode, and the heatset webs 21*a*, 21*b*, which have been imprinted in this way, can be admixed with the webs 11*a*, 11*b*, 11*c* imprinted on the newspaper printing press 01, in the superstructure 05.

The mixed production situations described in connection with FIGS. 14 and 15 with several heatset in-line press arrangements 25 assigned to a coldset printing press 01 should be applied, to the extent possible, to the above-mentioned preferred embodiments.

Various options for conducting a web are indicated, by way of example, in FIG. 15, in which a web 11*c*, which is depicted in dashed lines, can be additionally conducted from a further optional printing unit 02 into the superstructure 05. Although in FIG. 15 the webs 21*a*, 21*b* from the in-line press arrangements 25 are conducted, by way of example, as the uppermost layers, or as so-called "top sheets", onto a upper former 09 of the former structure 07, in the course of turning the web 21*a*, 21*b* in, they can be conducted between webs 11*a*, 11*b*, 11*c* from the printing units 02, depending on the selection of the level of these webs in the turning arrangement 10. For example, in the example which is represented, the web 21*b*, that has been imprinted in a heatset operation, located on the right one of two adjoining in-line press arrangements 25, represents the outermost layer of intermediate products which will later be longitudinally folded. The in-line press arrangement 30, which is located on the left, is here operated in the coldset mode, for example. This web 21*a*, which has been imprinted in the coldset mode, can come to lie underneath the outermost layer that is coming from the right in-line press arrangement 25.

The entire first printing press 01, embodied as an in-line press 01, or also a section with at least one printing unit 02 and an associated former structure 09, can also be identified as in-line press arrangement 30 in this example.

FIGS. 18 to 20 and FIG. 23 show preferred embodiments of a printing press system in which, in addition to the provision of one or of several printing units 02 of a first type, or of a first printing unit 02 of a first printing press 01, one or several printing units 03 of a second type, such as, for example, second printing unit 03 of the second printing press 31 are provided. The at least one second printing unit 03 is arranged laterally, with respect to the alignment of the first printing units 02. As seen in a view taken from above, at least one print location 41 of this printing unit 03 of the second type is located outside of the alignment which is constituted by the printing group cylinders 04, 06 of printing units 02 of the first printing press 01, or by the maximum web width of the first printing press 01. In this way, a web 21, which has been imprinted by the printing unit 03 of the second type, can be guided, in a simple way, from the direction of the side, transversely in respect to the machinery alignment M1 of the first printing press 01, into the stream of webs 11, or of partial webs, from the first printing press 01. A transport direction T2, which is projected onto the horizontal plane, of a web 21, that has been imprinted by the printing unit 03 of the second type and which is running towards the first printing press 01, therefore meets the machinery alignment M1 of the first printing press 01, projected onto the horizontal plane, at a 90° angle.

The axes of rotation of the printing group cylinders 14, 16 of the printing unit or units 03 of the second type extend in a direction that is parallel to the axes of rotation of the printing group cylinders 04, 06 of the printing unit or units 02 of the first type. The machinery alignment M1, which extends in the axial direction of the printing cylinders 04, 06 of the first printing unit or units 02 and projected onto the horizontal plane, and the machinery alignment M2, which extends in the axial direction of the printing cylinders 14, 16 of the second printing unit or units 03 and projected onto the horizontal plane, extend parallel with each other, as may be seen in FIG. 18. Here, the printing groups of the printing units 02, 03 are only indicated by their transfer cylinders 06, 16.

Figure 18:
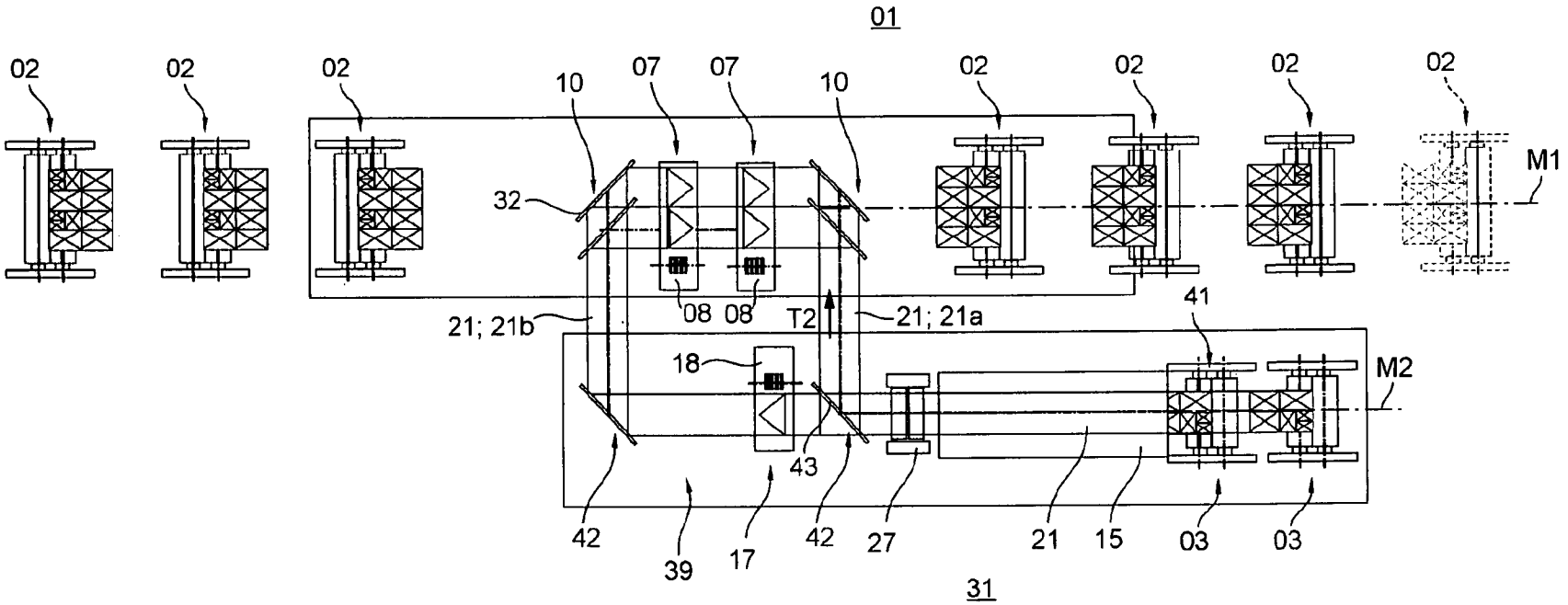
Figures 19, 20A, 20B:
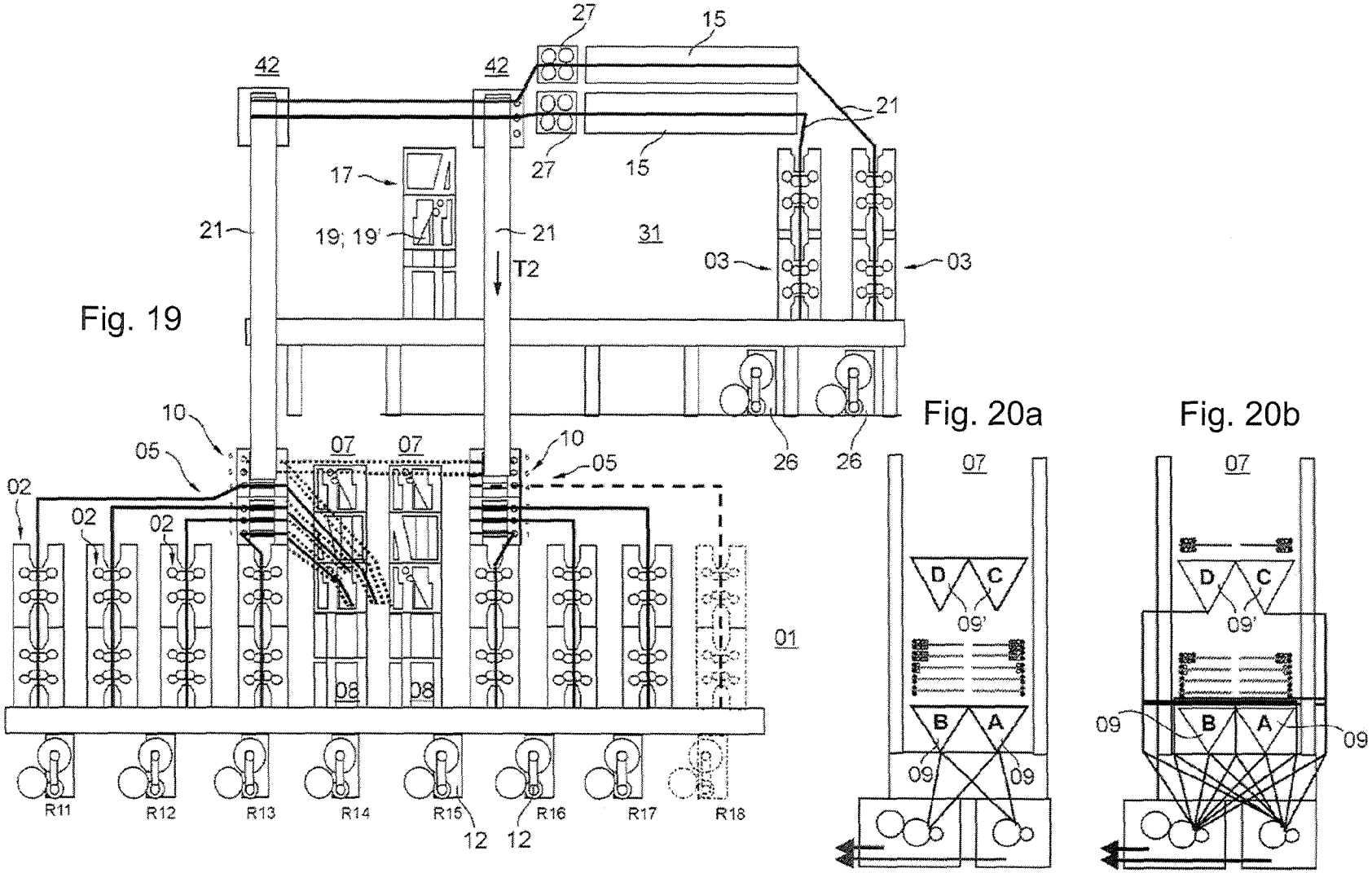

By way of example, a top plan view of such printing press systems is represented in FIG. 18, and lateral views thereof as shown in FIGS. 19 and 23, wherein the first printing press 01 respectively has two or more printing units 02, which are embodied as printing towers 02. In this case, the web 11 runs substantially vertically between several print locations 41 which, for example, apply different color inks to the web 11, or between printing groups in the printing units 02 of the first printing press 01. The printing units 02 of the first type are preferably embodied as coldset printing units 02 and are operated with coldset inks and, for example, are intended primarily for use with uncoated, or with only slightly coated, paper.

The at least two printing units 02 of the first type of the first printing press 01 are embodied as printing towers 02 and have, as represented in FIG. 19, for example two stacked H-printing units. However, as represented by way of example in FIG. 23, they can instead have two stacked satellite printing units, such as 9 cylinder satellites or 10 cylinder satellites, or instead can have at least four double printing groups bridge, n- or u-units, stacked on top of each other and, vice versa, FIG. 23 can also have stacked bridge or H-printing units. In any case, the printing tower 02 has several print locations on top of each other for use in two-sided multi-color printing. Therefore, the first printing press 01 is preferably embodied as a newspaper printing press 01 for accomplishing multi-web multi-color printing.

In the preferred embodiments shown in FIGS. 18 to 20 and 23, the printing units 02 of the first type, and the printing unit or units 03 of the second type, also differ in the above recited manner in length and/or circumference of the image-conveying printing group cylinder 04, 14 and/or in respect to coldset/heatset and/or in the printing method.

In the preferred embodiment of FIGS. 18 to 20, the first printing press 01 is, for example, embodied with double-width printing units 02, and in particular, with coldset printing units 02, having four printed pages placed side-by-side in the axial direction of the forme cylinder. However, in order to provide a compact press for large production sizes, these printing units 02 can also be configured to be of triple width, in 6/1 or 6/2 embodiments. By way of example, in the embodiment of the present invention in accordance with FIG. 23, the first printing press 01 is embodied with triple-width printing units 02 and has, as can be seen in FIG. 23*b*), at least one, and here has two groups of three two page-wide formers 09, 09' in the machinery alignment M1. While, in the example of FIG. 19 and FIG. 23, the printing units 02 are embodied with double-round forme cylinders 04 by way of example, in other embodiments these can also be configured to be single-round and can cooperate, for example, with double-round transfer cylinders 06, 16. However, this can also be provided the other way around. Thus, the first printing press 01 is preferably embodied as a newspaper printing press 01 in a 4/1, 4/2, 6/1 or 6/2 configuration.

In its machinery alignment M1, the first printing press has at least one former structure 07 and a folding group 08 which is arranged downstream thereof. If there are several groups or sectors of printing units 02, the first printing press can also have several first former structures 07 and folding groups 08, as seen in FIGS. 19 and 23. These can be arranged on the same respective side of a group of printing towers 02, or respectively individually within a group 02 of printing towers 02, as seen in FIG. 23, or, as shown by way of example in FIG. 19, side-by-side between the two adjoining groups of printing units 02. The first printing press 01 can also have only one group of adjoining printing units 02 of the first type and one former structure 07. It preferably has several such groups of printing units 02 and former structures 07. In a way which was described previously in connection with FIG. 8, the former structure, or former structures 07, can be embodied with one or with two groups of formers 09, 09' arranged on top of each other, as seen in FIGS. 20 and 23. In a triple-width embodiment of the printing units 02, the groups can respectively have three formers 09, 09' situated side-by-side, as seen, for example, in FIG. 23.

Now, in order to guide the web 21, which has been imprinted during mixed production by the printing unit 03 of the second type, from the direction of the side transversely, in regard to the machinery alignment M1 of the first printing press 01, to the flow of webs 11, or of partial webs 11.1, 11.2, 11.3 of the first printing press 01, at least one turning arrangement 10 is again provided in the machinery alignment M1 of the first printing press 01 in the superstructure 05 in such a way that the web 21, or partial web 21.1, 21.2 incoming from the second printing unit 03, or from the second printing press 31, can be turned, by 90°, into alignment with a web 21, or a partial web 11.1, 11.2, 11.3 of the first printing press 01. This means that, with the turning arrangement 10, a web 21 of the second printing press 31, and running in the transport direction T2, can be deflected by 90° into a transport direction T1 that is extending parallel, with regard to the machinery alignment M1 of the first printing press 01, and can be conducted onto the former structure 07 of the first printing press 01.

In the preferred embodiment of FIGS. 18 to 20, and in the preferred embodiment of FIG. 23, the printing unit 03 of the second type is a component of a second printing press 31, which has a plurality, such as, for example, two, of these printing units 03 in a machinery alignment M2, as well as having at least one, in this case one, former structure 07 assigned in straight-ahead arrangement, and a folding group 08 assigned to these printing units 03.

Although the two printing presses 01, 31 have been represented on top of each other in FIG. 19 and FIG. 23 for better comprehension, they are not located on top of each other, but rather are located side-by-side.

In FIGS. 18 to 20 and in the preferred embodiment of FIG. 23, the printing units 03 of the second type are embodied as heatset printing units 03, and the second printing press 31, as a whole, is embodied as a heatset printing press with at least one dryer 15, which may be a hot air, UV- or IR-dryer, and in this case, is provided with two dryers 15 for drying two webs 21. In the case of a dryer 15 which is embodied as a hot air dryer, respectively one cooling arrangement 27, for example a cooling roller stand, is provided in the web path. In the example represented, the second printing press 31 has several, here two, printing towers 03 for multi-color imprinting of several, here two, webs 21. As can be seen in FIG. 18, the printing units 03 are embodied in single width in respect to a newspaper format and are embodied with print images of two side-by-side arranged newspaper pages for imprinting on the webs 21. This also applies to an advantageous embodiment of the example in FIG. 23. At least one turning arrangement 42 is provided in the superstructure 39 of the second printing press 31 in such a way that the web 21, or the partial web 21.1, 21.2 imprinted by the second printing unit 03, or the second printing press 31, can be turned by 90° into a transport direction T2 toward the first printing press 01. In the represented example, two turning arrangements 42 are provided in the extended superstructure 39 of the second printing press 31 for transferring the web or webs 21 in the direction toward the first printing press 01. Viewed with respect to the machinery alignment M2 of the second printing press 31, the turning arrangements are arranged spaced apart from each other and, with respect to the longitudinal direction of the printing presses 01, 03, along the machinery alignments M1, M2, they are arranged at the same "level" as the turning arrangement 10 of the first printing press 01.

In the example which is shown in FIGS. 18 to 20 and FIG. 23, the second printing press 31 has its own former structure 17 which is assigned, in a straight-ahead guided manner, to the second printing units 03. In case of the embodiment of the second printing press 31 with single-width printing units, the former structure is also of single width, this means that it is embodied with only one former 09, 09' at the same former level. In the case of double-width printing units the former structure can be embodied with at least one group of two side-by-side formers 09, 09', as seen in FIG. 8.

In a separated production mode of operation, production is performed with one printing press 01 on one former structure 07, and with the other printing press 31 on the other former structure 17. Here, the webs 11, 21, or the partial webs 11.1, 11.2, 11.3, 21.1, 21.2, are conducted, without a transfer, to the straight-ahead assigned former structure 07, 17. If required, partial webs 11.1, 11.2, 11.3, 21.1, 21.2 can be laterally offset, in not specifically represented turning arrangements, which can be additionally assigned to the respective printing presses 01, 31 in the superstructure 05, 39, and can then be conducted straight ahead to the respective former structure 07, 17.

In an operating mode, with mixed production on the former structure 07, or on one of the former structures 07 of the printing press 01 of the first type, a web 21, or a partial web 21.2 of the second printing press 31, which was longitudinally cut upstream of the turning arrangement 42, can be initially deflected by 90° by a turning bar 43 of the turning arrangement 42 into a direction toward the first printing press 01, and thereafter can again be deflected by 90° by a turning bar 32 of the turning arrangement 10, and can be brought into alignment with a web 11 or with a partial web 11.1 of the first printing press 01. For this purpose, the superstructure 39 of the second printing press 31 has the turning arrangement, or arrangements 42, and the superstructure 05 of the first printing press 01 has the turning arrangement, or arrangements 10 and has at least the one group of guide rollers 13. Here, too, the turning arrangement 10 has at least one group of several turning bars 32, which are arranged on top of each other at different levels. Advantageously, at least a portion of the group of turning bars 32 corresponds, in respect to the position of its level, with at least two guide rollers of the group of guide rollers 13 in such a way that the web 21, or the partial web 21.1, which has been selectively conducted over one of three turning bars 32, that are arranged on top of each other, can come to rest either above, as seen in FIG. 4 *c*) in solid lines, or below, as seen in FIG. 4 *c*) in dashed lines of a web 11, or of the partial web 11.1, 11.2 (11.3) which has been imprinted in the first printing press 01. As previously mentioned, in an alternative embodiment, only one turning bar 32 can be provided in the turning arrangement 10 for each partial web 21.1, 21.2 from the second printing press to be turned which, however, corresponds at its level with several, for example four, rollers from the guide roller group 13 in such a way that, depending on the guidance of several, for example two or more, webs 11.1, 11.2, 11.3 imprinted in the first printing press 01, both of these come to lie above the turned-in web 21, both of these come to lie below, or one comes to lie below and the other comes to lie above the turned-in web 21.

In case of the existence of several groups of printing units 02 and of several former structures 07 in the first press, it is advantageous to provide several second printing groups 03 and several transfer devices, or to provide several turning arrangements 42 which are spaced apart, in the linear direction of the machinery alignment M2. In this way, several partial productions, which are running on the first printing press 01, can each be complemented simultaneously with product sections, or layers, from the second printing press 31.

In the preferred embodiment of the present invention, in accordance with FIG. 19, both printing units 03 of the second type are arranged directly next to each other. Both dryers 15 are arranged on top of each other. The two transfer devices, or turning arrangements 42, as well as the former structure 17 are arranged on the same side of the group of second printing units 03.

In the preferred embodiment in accordance with FIG. 23, both printing units 03 of the second type are not arranged directly next to each other, but instead are separated by a former structure 17. Both dryers 15 are arranged here next to each other in the linear direction of the machinery alignment M2. The two transfer devices, or turning arrangements 42 are also arranged on both sides of the group of the common former structure 17.

As shown in FIG. 23*b*, by way of example, but also as a possible supplement to the former structures 07, 17 of the other preferred embodiments, it is possible to provide an additional former 09''', which is located outside of the machinery alignment M1, for a group of formers 09, 09' that are located in the machinery alignment M1. This additional former 09''' then can have a significantly greater effective width, such as, for example, which is greater by a factor of 1.3, and which can therefore be configured for folding larger partial webs 11.1, 11.2. It is therefore possible, for example, in connection with a triple-width printing unit 02, for the additional former 09''' to have a width which corresponds to half the effective barrel length of the forme cylinder 04, or of three pages of the standard product. It is then possible to fold two-sided partial webs 11.1, 11.2 of a larger printed page format.

In a preferred embodiment of the present embodiment, in accordance with FIGS. 18 to 20 or FIG. 23, the second printing press 31 can also be configured as a job printing press with several printing units 03, through which the web 21 sequentially passes in the horizontal direction. In this case, a newspaper printing press would be combined with a job printing press in such a way that, in a mixed production mode, newspaper products can be formed with high quality pages from the job printing press and in this way the resulting newspaper products can be upgraded. It is then possible, in a separate production, to simultaneously produce, in the printing press system, a pure newspaper product, and to also produce a pure jobbing product. This combination should also be applied to the preferred embodiments with "crossed" printing presses in FIGS. 1 to 13, in a T- or X-placement, as well as to the example with orthogonal printing units 02, 03 and parallel former structures 07, 17 of FIG. 14.

As can be seen in FIG. 19, the printing units 02, 03 of the two parallel printing presses 01, 31 can be configured in a table embodiment, in which each of the printing units 02, 03 is arranged on a level which is higher than a roll changer level. By way of example, in the embodiment which is depicted in accordance with FIG. 23, the first printing press 01 is arranged in a table embodiment, and the second printing press 31 is placed on the ground, and the roll changers 26 have been placed on the same level as the printing units 03.

Figures 24A, 24B, 24C:
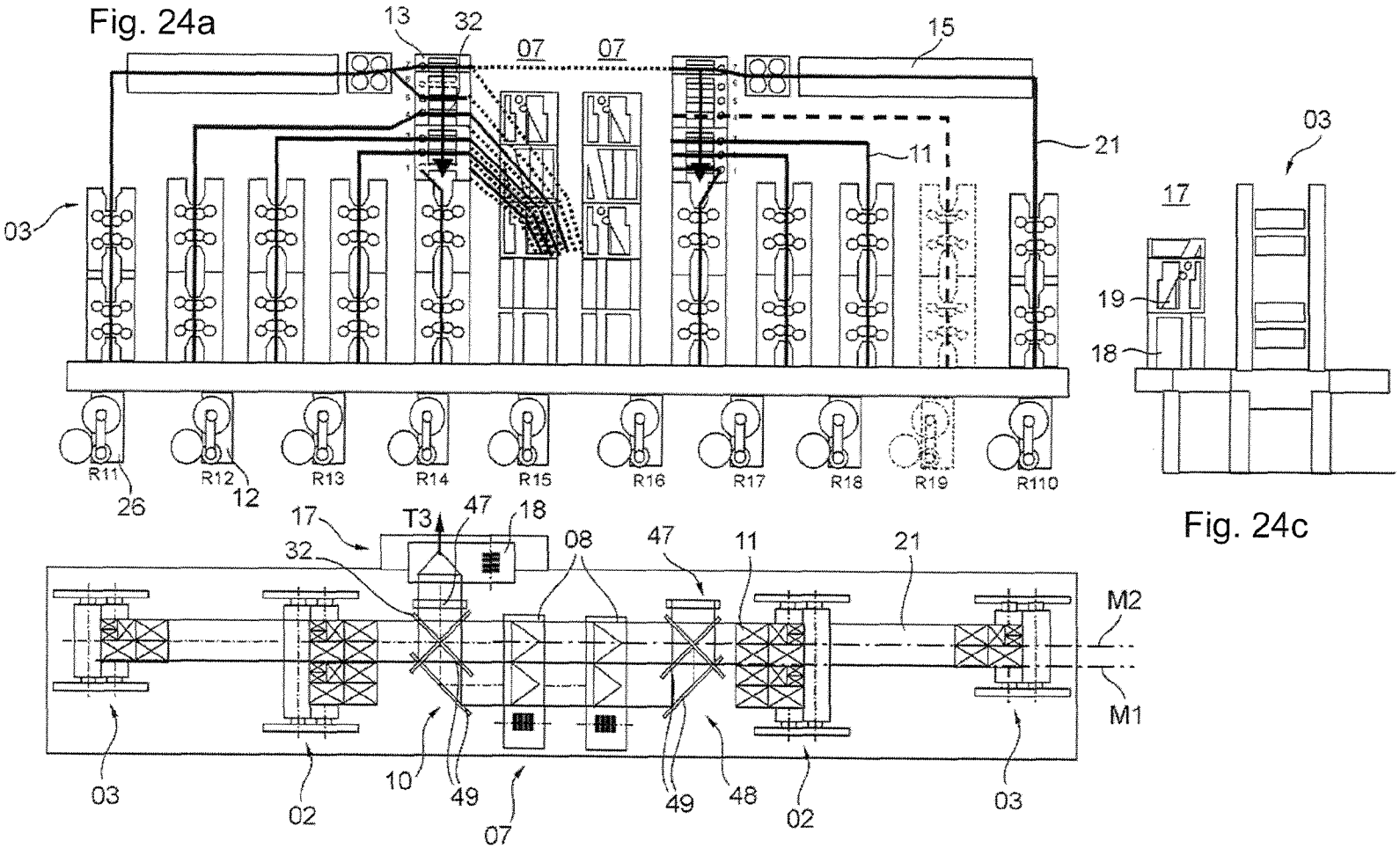
Figure 25A:
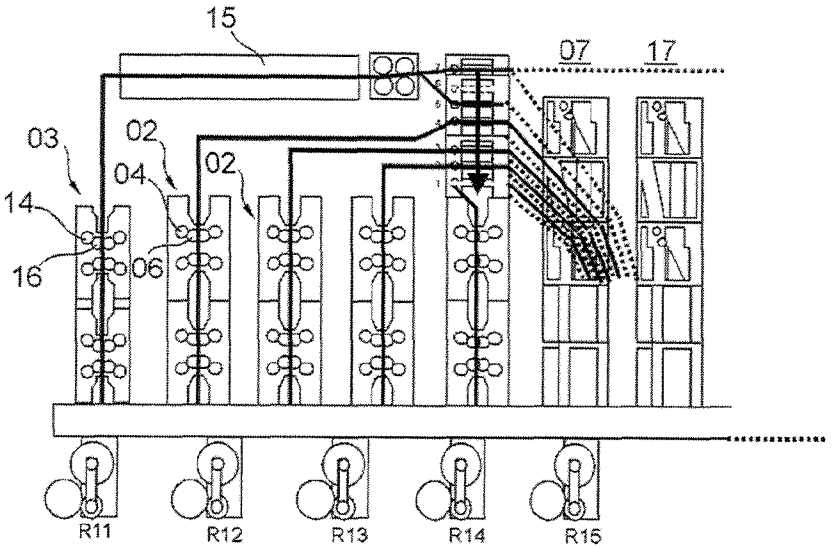
Figure 25B:
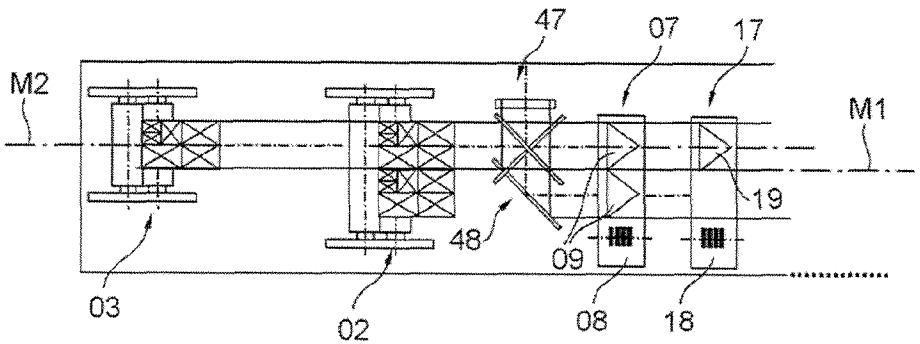

Preferred embodiments of the combination of two printing presses 01, 32, or in-line press arrangements 30, 25 are represented in FIGS. 24 to 28, and in particular are depicted in FIGS. 24 and 25, in which, although several printing units 02, 03 of the same type can be arranged in a machinery alignment M1, M2, the printing units 02, 03 of the same type need not adjoin each other directly, but instead can be placed into the printing press system as required. Although printing units 02, 03 of the first and second type are arranged in the same line in the preferred embodiment of FIGS. 24 and 25, they have different machine widths, which widths, in an embodiment for the examples in FIGS. 26 to 28, can also be applied to the printing press systems represented there. For example, the printing units 02 of the first type are of double- or even triple width, and the at least one printing unit 03 of the second type is of single width, when considered in relation to the same format. In other words, it is configured for imprinting only two side-by-side arranged printed pages of this format, as seen in FIG. 24*b* and FIG. 25*b*. In a variation which is not specifically represented, first printing units 02 of triple width can be combined with at least one double-wide second printing unit 03. In this case, the arrangement of the two printing presses 01, 31, or of the in-line press arrangements 30, 25 is such that, although the narrower printing units 03, 02 are arranged in the alignment defined by the wider printing units 02, 03, the center press alignments M1, M2 extend parallel, but are laterally spaced apart from each other.

A lateral view of the printing press system with several, and specifically here with two groups consisting of first printing units 02 or printing towers 02 and interspersed former structures 07, 17, as well as with printing units 03 of the second type located in the same alignment, is represented in FIG. 24*a*). FIG. 24*b*) schematically shows a top plan view in which, however, the representation of some first printing units 02 from FIG. 24*a*) was omitted. Two printing units 03, such as, for example, two printing towers 03, of the second type and two dryers 15 are here again assigned to two groups of first printing units 02, and in particular, two printing towers 02, or two former structures 07 of the first printing press 01. For reasons of space, the dryers are advantageously located, at least partially, above the printing towers 02 of the first type. A former structure 17 of the second type, or a first former structure 17, are again provided in the preferred embodiment in accordance with FIG. 24. Preferably, this second former structure 17 differs from the first former structure 07 in the number of formers 09, 19 of a former group and/or in the effective width of one or of several formers 09, 19, as is discussed above. In FIG. 24, the second former structure 17 is not arranged in the machinery alignment M2 of the second printing press 31, or of the printing unit 03. Instead, it is rotated by 90°, next to the alignment defined by the second printing units 03. The former structure 17 is oriented in such a way that the incoming direction T3, when it is projected onto the horizontal plane, extends parallel with respect to the linear direction of the printing cylinders 14, 16, or perpendicularly with regard to the center press alignment M2 of the second printing unit 03. A web 21, which has been imprinted by the second printing unit 03, can be conducted, via the turning arrangement 10 and/or via the guide rollers 13, selectively onto the first former structure 07 or, it can be deflected by 90°, onto the second former structure 17 and the downstream arranged folding group 18, such as, for example, a heatset folding group.

In order to guide the web 21, which has been imprinted by the second printing unit 03, onto the second former structure 17, the web 21 is deflected by 90° by a turning arrangement 10. However, for a mixed production run, web 21 is conducted over guide elements 13 onto the, or one of the, first former structures 07. In this case, the turning arrangement 10 can have turning bars 49 which permit the lateral displacement of the web 21 into an alignment which is parallel in respect to the machinery alignment M2, so that web 21 is now directed onto one of the other ones of the adjoining formers 09, 09'. Such an arrangement of turning bars 49 can also be considered to be a turning arrangement 48 per se. In this regard, see the right side of FIG. 24*b*). Rollers 47 of a so-called bay window arrangement can be additionally provided, by the use of which rollers 47 a web 21, which is rotated by 90°, can be conducted onto another level and can be returned on this other level into the alignment of the press, and can again be brought, via a further turning bar, into a transport direction T1, T2 which is parallel in relation to the machinery alignment M2 or M1.

FIG. 25 shows a variation of the preferred embodiment that is depicted in FIG. 24, and in which the second former structure 17 now also lies in the machinery alignment M2 of the second printing unit, or units 03, instead of being rotated by 90°. The embodiment which is represented in FIG. 24 has only one group of first printing units 02 and only one first former structure 07, as well as having only one second printing unit 03 and a second former structure. However, it is also possible to provide several groups of first printing units 02 and/or several first former structures 07, and/or several second printing units 03, and/or several second former structures 17.

Figure 26:
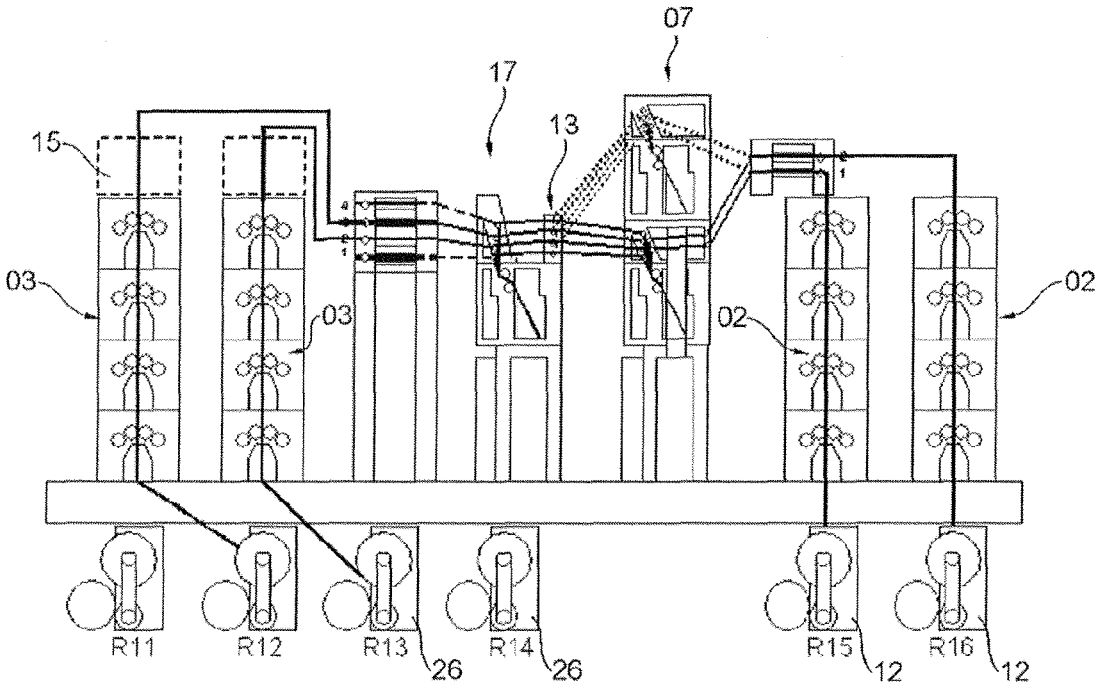
Figure 27B:
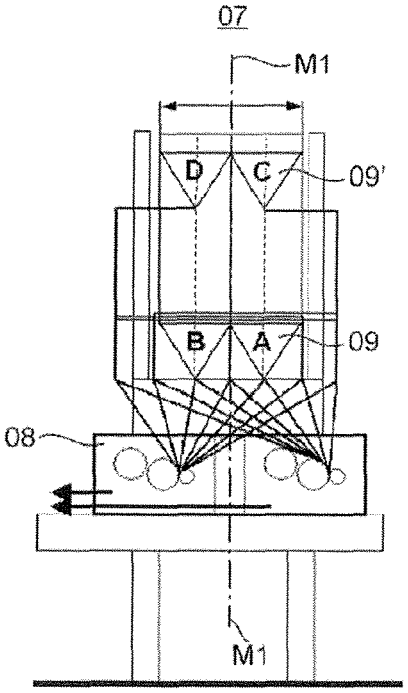
Figure 27A:
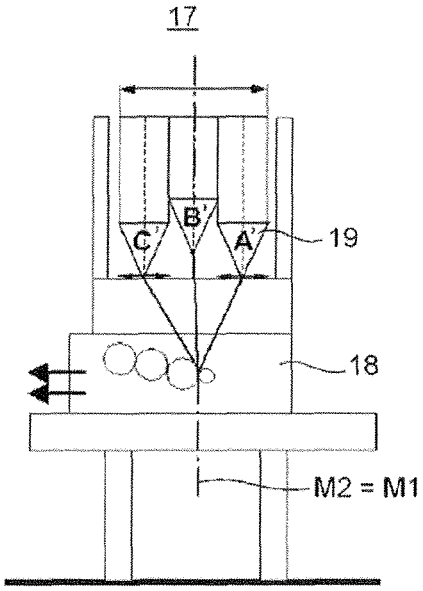
Figure 28:
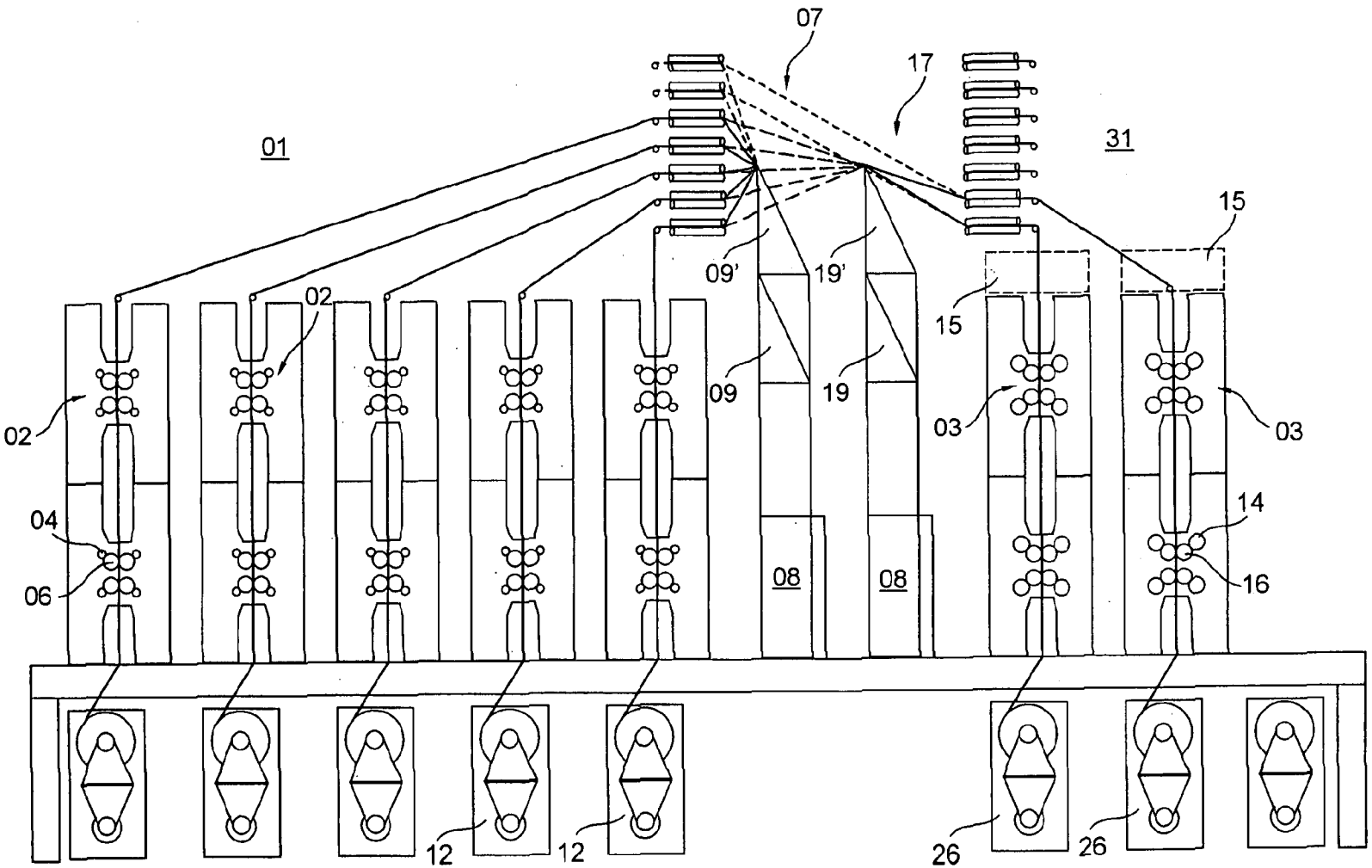

In the two preferred embodiments of FIGS. 26 to 28, the printing press system has, as was the situation in connection with FIGS. 24 and 25, a combination of two printing presses 01, 31, or in-line press arrangements 30, 25, in which several printing units 02, 03 of different types are arranged in the same line, for example. In principle, the printing units 02, 03, or the printing towers 02, 03, can be embodied to have the same width, such as, for example, being double-wide or triple-wide in relation to a newspaper format. However, as was previously described in connection with FIGS. 24 and 25, the printing units 02, 03 can also have different widths or can have different circumferences wherein, in case of different width, the center press alignments M1, M2 again extend parallel, but laterally spaced apart from each other.

In FIGS. 26 and 27 the printing units 02, 03, or their printing group cylinders 04, 14, 06, 16 of the first and second type have approximately the same maximally effective width which corresponds, for example in a first format, such as, for example, in a newspaper format, to a width of "i" (for example "i"=4) printed pages, such as, for example, newspaper pages. This means that the printing units 02, 03 are embodied to be n-times wide in regard to a first format, for example double-wide (n=2 and i=2*n=4), or triple-wide (n=3 and i*n=6). One of the two types of printing units 02, 03 is now embodied for supporting one or several printing formes, such as, for example, "i" printing formes, with a number of "i" print images of the first format in the axial direction of the forme cylinder 04, 14. The other one of the two types of printing units 03, 02 is at least embodied to support one or several printing formes with "j" print images in a smaller, second format, wherein "j">"i". Then a first former structure 07, 17 has at least one group of "I"/2 formers 09, 09', and a second former structure 17 has at least one group of "j"/2 formers 19. In this case, the second format can be, for example, a tabloid format, a magazine format or a telephone book format. In the example of FIGS. 26 and 27, the first printing units 02 of the first printing press 01 are double-wide in respect to, for example, a newspaper format, and are thus embodied with four printed pages in the axial direction on the forme cylinder 04. The first former structure 07 then has at least one, and as depicted here has two groups of two formers 09, 09' arranged side-by-side on one level. In respect to a smaller format, such as, for example, a tabloid, telephone book or magazine format, the printing units are configured to be triple-wide, thus having at least one group of three formers 19' on one level. A dryer 15 is preferably arranged in the web path and is arranged downstream of the second printing units 03. The second printing unit, or units is/are preferably embodied in such a way that "i" print images (here "i"=4) of the larger format, or "j" print images (here "j"=4) of the smaller format can be selectively arranged by the use of one or of several printing formes on the forme cylinder 14. Then, in a mixed production, it is possible to combine, on the first former structure 07 for example, partial products of a larger format from the first printing unit 02, and partial products of a smaller format from the second printing unit 03, such as, for example, as a pop-up. In another mode of operation of the mixed production, print images of the larger format can also be arranged on the forme cylinder 14 of the second printing unit 03, and the webs 21 with these print images can, for example, be conducted through the dryer 15 and can then be combined with the web 11 of the first printing unit 02 having print images of a larger format to form a mixed product.

In FIG. 28, one of the printing presses 01, 31, for example the first printing press 01, or the first printing unit 02, is configured with forme cylinders 04 of single circumference, and thus with merely one print image, or printing forme in the circumferential direction of the forme cylinder 04, while the other printing press 31, or the other printing unit 03, is configured with forme cylinders 14 of double circumference, and thus with two print images or with two printing formes in the circumferential direction of the forme cylinder 14. One of the printing presses 01, 31 can advantageously be embodied in a 4/1 configuration and the other printing press 01, 31 in a 4/2 configuration. In a configuration that is intended for larger product thicknesses and/or for more compact structural space, the one printing press 01, 31 can advantageously be embodied in a 6/1 array and the other printing press 31, 01 in a 6/2 array. However, the two printing units 02, 03, or printing presses 01, 31 can have a different width and an offset in the center press alignments M1, M2. They can also differ in the printing process used, as discussed above and/or in the employment of a dryer 15, as is also discussed above. In the represented example of FIG. 28, one of the printing presses 01, 31, and in this case, the printing press 31, has a dryer 15.

For all previous examples of the printing press system, it is provided, in a further development, to embody at least one of the printing units 02, 03, and/or the former structure 07, 17 of the first or second printing press 01, 31, for making so-called "pop-up" products. In this connection, see FIGS. 6, 7, 21 and 22, for example.

Figure 21A:
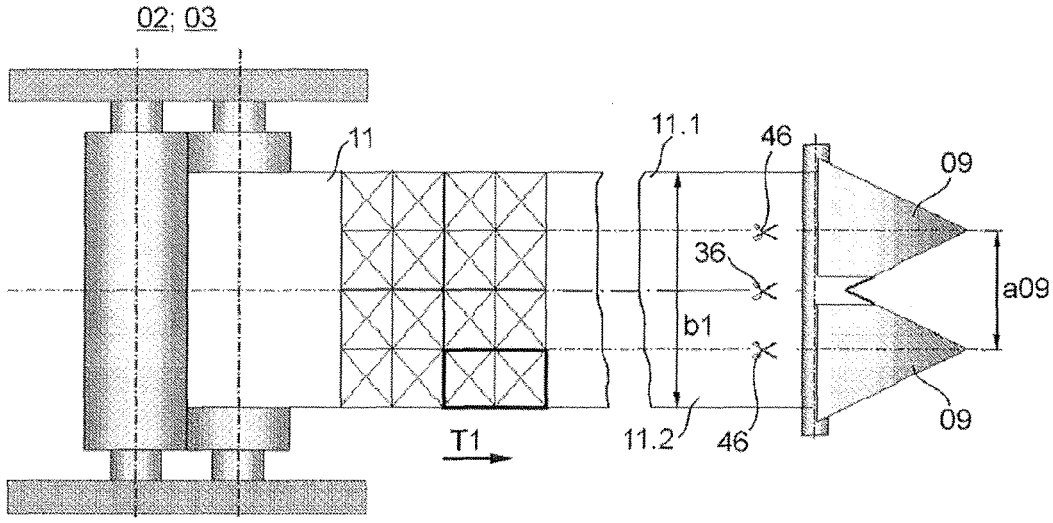
Figure 21B:
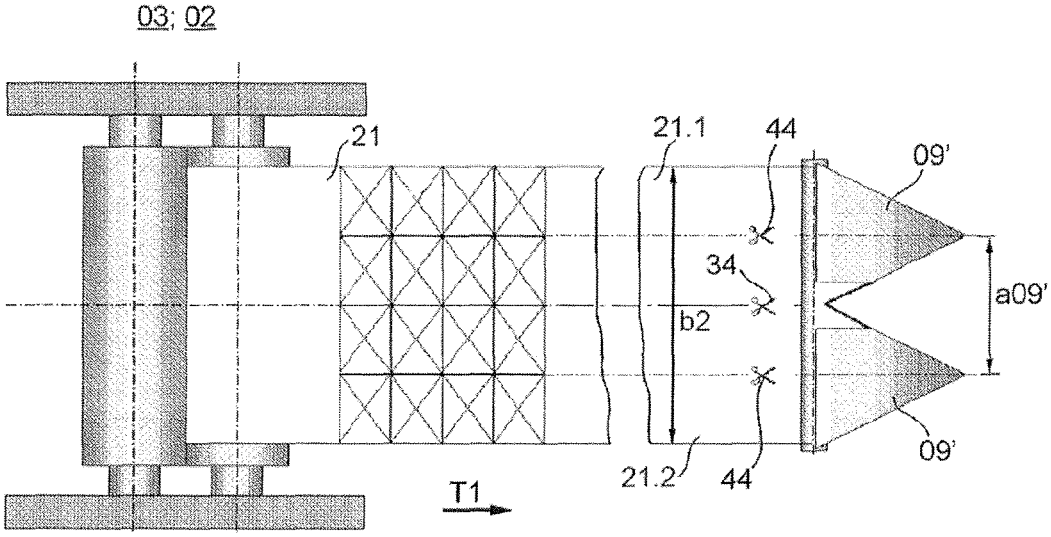
Figure 21C:
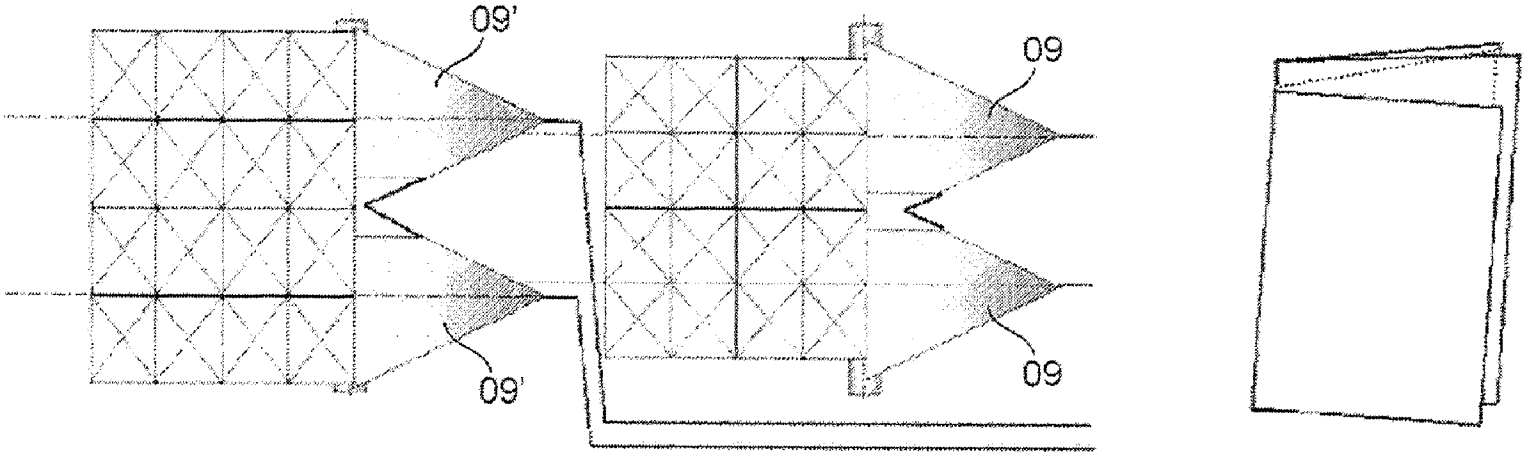

In a first embodiment, a former structure 07 of the first printing press 01 can be embodied with two groups of formers 09, 09' for this purpose, whose effective widths differ and which are therefore adapted for folding partial webs 11.1, 11.2, 11.3 of different widths. In a further embodiment, the formers 09, 09' of at least one of the two former groups can be configured to be movable in a direction transversely to the web running direction, such as, for example, transversely to the transport direction T1 and, if possible, their effective width should be changeable by the provision of insertion pieces which can be removed or which can be tilted out of the way. Depending on the width of the partial webs, the two adjoining formers 09, 09' have then been brought into a position relative to each other in such a way that a distance a09, a09' of the former tips, differently matched, can be different, all as seen in FIG. 21 *a*) to FIG. 21 *c*). FIG. 21 schematically shows the above-described matter by the use of two printing units 02, 03, through which webs 11, 21 of different web width b1, b2 run. The partial webs 11.1, 11.2, 21.1, 21.2 of the narrower web 11, 21 are conducted onto the former group with the smaller distance a09 between the former tips of the formers 09, 09', while the partial webs 21.1, 21.2, 11.1, 11.2 of the wider web 21, 11 are conducted onto the former group with the larger distance a09' between the former tips of the formers 09', 09. This principle was previously explained in connection with FIG. 21 by the use of webs 11, 21 imprinted by the tabloid printing process with horizontal printed pages in tabloid format. In this case, besides the longitudinal cutting arrangement 34, 36 for the main cutting lines, additional longitudinal cutting arrangements 44, 46, forming secondary cutting lines, have been provided between the respective printing unit 02, 03 and the former structure 07, 17, or formers 09, 09', which additional longitudinal cutting arrangements 44, 46 longitudinally cut the partial webs 11.1, 11.2, 21.1, 21.2 in the area of the fold back which is to be formed, or which has already been formed. However, the embodiment which is represented for tabloid formats, should be applied in the same way to broadsheet production in which, however, as a rule no cut in the secondary cutting lines takes place, and the printed pages are configured as upright printed pages which, as indicated in "bold" in the representation of FIG. 21 *a*), correspond approximately to two tabloid pages.

Figure 22A:
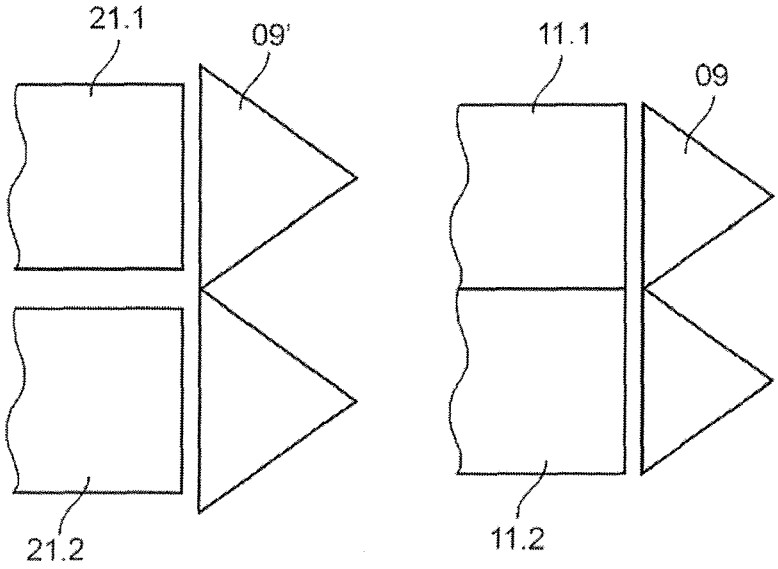
Figure 22B:
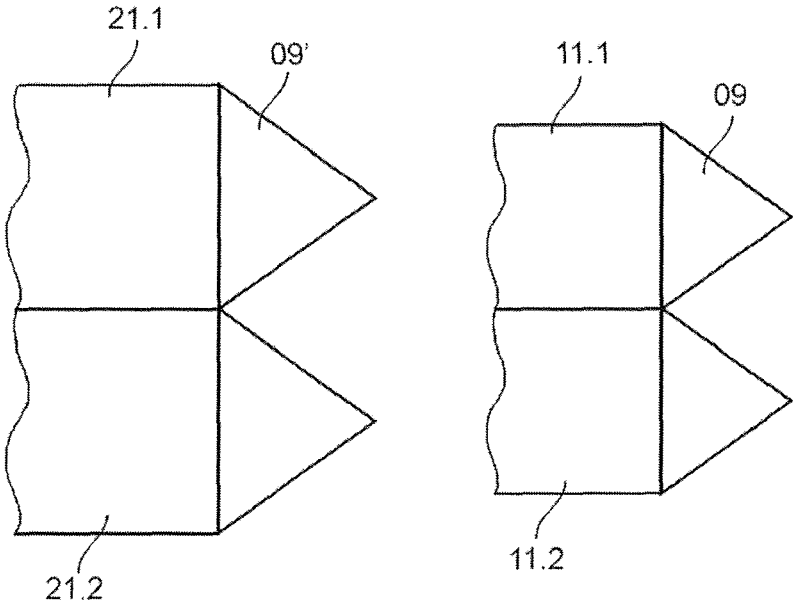

In another variation of the present invention, the formers 09, 09' of the greater maximally required width, for example corresponding to the representation in FIG. 22, can be fixedly installed, but wherein the web 21, or partial webs 21.1, 21.2, which had been turned-in in the previous preferred embodiments, provides the wider partial webs 21.1, 21.2 in the mixed mode of operation, along with the formation of pop-ups, and is correspondingly turned in. In this case, the printed pages are embodied with a width which is correspondingly greater when compared with a multiple of the printed page format of the first printing press 01, so that a projection can remain for each printed page width. Depending on the partial web width of the web 21, or of the partial webs 21.1, 21.2 that are coming from the side, and which are to be turned into the flow from the first printing press 01, the respective partial web 21.1, 21.2 is aligned with the respective former tip by positioning the turning bars 32, which turning bars 32 can be advantageously moved transversely in respect to the machinery alignment M1 of the first printing press 01. For a "normal" mixed production, the adjoining partial webs 21.1, 21.2, when viewed from above, extend, spaced apart from each other, because of the increased effective former width, as depicted in FIG. 22 *a*). In a pop-up production, and with maximum projection, or maximum width, the cut and turned-in partial webs 21.1, 21.2 can extend directly next to each other on the adjoining former 09', as seen in FIG. 22 *b*), depending on the formers 09, 09' to be occupied. Depending on the positioning of the turning bars 32, the two partial webs 21.1, 21.2 can also be conducted on top of each other onto the same former 09'.

What has been said in the above-described individual preferred embodiments, in regard to the construction of the individual units, such as printing units 02, 03, former structures 07, 17, turning arrangement 10, 42 and/or folding groups 08, 18, and the like, should, whenever logical and possible, be applied to the respectively other preferred embodiment. The teachings regarding comparable arrangements of the two printing presses 01, 31, or printing units 02, 03, should be applied alternatively to each other in the same way, since, in order to avoid repetitions, not all details have been repeated in each example.

While preferred embodiments of a printing machine system, in accordance with the present invention, have been set forth fully and completely hereinabove, it will be apparent to one of skill in the art that various changes in, for example, the drives for the various cylinders, the operational characteristics of the roll changers, the specific material webs to be printed, and the like could be made without departing from the true spirit and scope of the present invention which is accordingly to be limited only by the appended claims.

What is claimed is:

1. A printing press system comprising:

a first printing press;

at least one first printing unit in the first printing press and having a first machinery alignment;

a first former structure in the first printing press and arranged in the first machinery alignment of the at least one first printing unit;

a second printing press;

at least one second printing unit in the second printing press and having a second machine alignment;

a dryer in the second printing press and arranged in the second machinery alignment of the at least one second printing unit;

a second former structure, the first former structure and the second former structures being different from each other in at least one of a number of formers arranged side-by-side on a machine level of one of the first and second former structures being different from a number of formers arranged side-by-side in the machine level of the other former structure, and in an effective width of at least one of the formers in one of the first and second former structures being different from an effective width of any of the formers in the second former structure, and wherein one of a web and a partial web, which has been imprinted in the second printing unit and which has been conducted through the dryer, can be selectively conducted onto one of the second former structure and the first former structure.

2. The printing press system in accordance with claim 1, characterized in that the one of the web and the partial web, which was imprinted in the second printing unit, and conducted through the dryer, can be selectively conducted, in one of a separate production mode onto the second former structure and a mixed production mode can be conducted, together with one of a web and a partial web imprinted in the first printing press, onto the first former structure arranged in the first machinery alignment.

3. The printing press system in accordance with claim 1, characterized in that the second former structure is arranged in the second machinery alignment of the at least one second printing unit.

4. The printing press system in accordance with claim 1, characterized in that, with respect to their axial direction, printing group cylinders of the first and of the second printing units are aligned substantially orthogonally in relation to each other.

5. The printing press system in accordance with claim 4, characterized in that the printing group cylinders of the first and second printing units which extend orthogonally to each other and the first and second former structures assigned to a respective one of the first and second machinery alignments are respectively each arranged on different sides of the one of the first and second machinery alignment of the respectively other one of the first and second printing press.

6. The printing press system in accordance with claim 1, characterized in that, with respect to their axial direction, printing group cylinders of the first and of the second printing units are aligned substantially parallel in relation to each other.

7. The printing press system in accordance with claim 1, characterized in that the first and second former structures extend orthogonally in relation to each other in respect to a transport direction of a web, which is projected onto the horizontal plane and which runs up on each of the first and second former structures.

8. The printing press system in accordance with claim 1, characterized in that the first and second former structures extend parallel in relation to each other in respect to a transport direction of a web, which is projected onto the horizontal plane and runs up on each of the first and second former structures.

9. The printing press system in accordance with claim 1, characterized in that with respect to its print location, the at least one second printing unit of the second printing press, when viewed from above, is arranged laterally in regard to the first machinery alignment of the at least one first printing unit.

10. The printing press system in accordance with claim 1, characterized in that the second machinery alignment of the second printing press, which extends perpendicularly to an axial direction of printing group cylinders of the at least one second printing unit, extends substantially orthogonally to the first machinery alignment of the first printing press which extends perpendicularly with respect to an axial direction of printing group cylinders of the at least one first printing unit.

11. The printing press system in accordance with claim 1, characterized in that the second machinery alignment of the second printing press, which extends perpendicularly to an axial direction of printing group cylinders of the at least one second printing unit, extends substantially parallel with the first machinery alignment of the first printing press which extends perpendicularly with respect to an axial direction of printing group cylinders of the at least one first printing unit.

12. The printing press system in accordance with claim 1, characterized in that the at least one first printing unit and the first former structure of the first printing press are arranged as an in-line press in the first machinery alignment extending perpendicularly to an axial direction of printing group cylinders of the at least one first printing unit.

13. The printing press system in accordance with claim 1, characterized in that the at least one second printing unit and the second former structure of the second printing press are arranged as an in-line press in the second machinery alignment extending perpendicularly to an axial direction of printing group cylinders of the at least one second printing unit.

14. The printing press system in accordance with claim 1, characterized in that a first turning arrangement is provided at least in the first machinery alignment of the first printing press, and over which first turning arrangement a web, which is imprinted in one production situation by the second printing unit, can be conducted onto the former structure of the first printing press.

15. The printing press system in accordance with claim 14, characterized in that the first turning arrangement is arranged in the area of a crossing point of the first and second machinery alignments.

16. The printing press system in accordance with claim 14, characterized in that the first turning arrangement has at least one turning bar which is embodied to be movable along one of the first and second machinery alignments.

17. The printing press system in accordance with claim 14, characterized in that the first turning arrangement has at least one turning bar whose usable length, when projected onto an incoming web, corresponds to at least one of at least three printed pages, and at least to a maximally usable barrel width of an image-conveying printing group cylinder.

18. The printing press system in accordance with claim 1, characterized in that a first turning arrangement is provided at least in the first machinery alignment of the first printing press, and over which first turning arrangement, in a selective manner, one of a web and a partial web imprinted in the second printing unit can be conducted onto the first former structure of the first printing press (01), and one of a web and a partial web imprinted in the first printing unit can be conducted onto the second former structure of the second printing press.

19. The printing press system in accordance with claim 1, characterized in that the first printing press has a first turning arrangement, by the use of which first turning arrangement a web running in the first turning arrangement from the second printing unit can be rerouted into a transport direction of a web coming from the first printing unit.

20. The printing press system in accordance with claim 19, characterized in that the first turning arrangement is additionally embodied to reroute a web arriving from the first printing unit into a transport direction of a web coming out of the second printing unit.

21. The printing press system in accordance with claim 1, characterized in that the first printing press has a first turning arrangement, by the use of which first turning arrangement a web arriving in the direction of the second machinery alignment of the second printing press can be rerouted into a transport direction one of along and parallel to the first machinery alignment.

22. The printing press system in accordance with claim 1, characterized in that two in-line arrangements of the first and second printing presses are arranged in an X-placement in relation to each other in such a way that, viewed in a horizontal projection, two webs imprinted in the two crossing in-line arrangements cross each other at right angles on their path between the respective one of the first and second printing units and the one of the first and second former structures which is respectively assigned in a straight-ahead extending manner with its respective one of the first and second printing presses.

23. The printing press system in accordance with claim 1, characterized in that in one of the first and second printing presses the at least one printing unit (02, 03) and the former structure assigned to the one of the first and second machinery alignments are arranged on the same side of the other one of the first and second machinery alignments of the other one of the first and second printing presses, and in the other one of the first and second printing presses the at least one printing unit and the former structure assigned to the other one of the first and second machinery alignments are arranged on different sides of the machinery alignment of the one of the first and second printing presses.

24. The printing press system in accordance with claim 1, characterized in that the first former structure of the first printing press has a group of at least two formers arranged side-by-side on the same machine level.

25. The printing press system in accordance with claim 24, characterized in that two groups, each of at least two side-by-side arranged formers, are arranged on top of each other.

26. The printing press system in accordance with claim 25, characterized in that the two groups differ in at least one of a number and an effective width of the side-by-side arranged formers.

27. The printing press system in accordance with claim 1, characterized in that the second former structure of the second printing press has at least one of a second former on a machine level, and a group of at least two second formers arranged side-by-side on the same machine level.

28. The printing press system in accordance with claim 1, characterized in that the first printing press has several ones of said at least first printing unit in the first machinery alignment.

29. The printing press system in accordance with claim 28, characterized in that the several ones of the printing units of the first printing press are embodied as printing towers, and with several printing groups arranged on top of each other.

30. The printing press system in accordance with claim 29, characterized in that a respective web can be imprinted on both sides in several colors in each of the printing towers.

31. The printing press system in accordance with claim 1, characterized in that the at least one first printing unit of the first printing press, and the at least one second printing unit of the second printing press are embodied as printing units of different types.

32. The printing press system in accordance with claim 31, characterized in that the two printing units of different types differ from each either in the printing process employed by each.

33. The printing press system in accordance with claim 32, characterized in that the two printing units of different types differ from each other in at least one of a maximal length effective for printing and in a circumference of an image-conveying printing group cylinder.

34. The printing press system in accordance with claim 33, characterized in that the two printing units of different types are differently embodied in such a way that it is possible to imprint different numbers of printed pages of the same format in the longitudinal direction of printing group cylinders of the two printing units.

35. The printing press system in accordance with claim 33, characterized in that the two printing units of different types are differently embodied in such a way that it is possible to imprint different numbers of printed pages of the same format in the circumferential direction of printing group cylinders of the two printing units.

36. The printing press system in accordance with claim 33, characterized in that the printing unit of the one type has printing group cylinders of a width of at least four printed pages, and the printing unit of the other type has printing group cylinders of a width of two printed pages.

37. The printing press system in accordance with claim 36, characterized in that at least an image-conveying printing group cylinder of the printing unit of the one type has a circumference corresponding to the length of two printed pages, and at least an image-conveying printing group cylinder of the printing unit of the other type has a circumference corresponding to the length of one printed page.

38. The printing press system in accordance with claim 31, characterized in that one of the two printing units is n-times wide, and the other of the two printing units is m-times wide, with n not being equal to m, wherein n- or m-times wide means a width for imprinting 2*n or 2*m printed pages in a longitudinal direction of printing group cylinders of each of the two printing units.

39. The printing press system in accordance with claim 38, characterized in that partial webs of a web imprinted in an n-times wide printing unit are one of turned by 90° into the alignment of an (n−1)-times wide printing unit and are conducted onto an (n−1)-times wide former structure.

40. The printing press system in accordance with claim 31, characterized in that a web imprinted in a printing unit of the first type is conducted onto one of the first and second former structures without an interaction with the dryer, and a web imprinted in a printing unit of the second type is conducted onto one of the first and second former structures after passing through the dryer.

41. The printing press system in accordance with claim 31, characterized in that the printing unit of the one type is an offset printing unit, and the printing unit of the other type is a flexographic printing unit.

42. The printing press system in accordance with claim 31, characterized in that the printing unit of the one type is one of an offset and a flexographic printing unit, and the printing unit of the other type is a printing unit for a non-impact method.

43. The printing press system in accordance with claim 1, characterized in that a first web of one of uncoated and slightly coated paper, with a coating weight of at most 10 $g/m^2$, passes through the at least one printing unit of one of the first printing press and the second printing press, and a second web made of one of satinized and coated paper of a coating weight of more than 10 $g/m^2$, passes through the at least one printing unit of the first printing press and the second printing press.

44. The printing press system in accordance with claim 1, characterized in that a web imprinted in the at least one first printing unit can be guided onto the first former structure arranged in the first machinery alignment, and a web imprinted in the at least one second printing unit can be guided onto the second former structure arranged in the second machinery alignment.

45. The printing press system in accordance with claim 1, characterized in that the web imprinted in the at least one second printing unit can be conducted, after being deflected by 90° viewed in the horizontal plane by a turning arrangement, onto the first former structure arranged in the first machinery alignment.

46. The printing press system in accordance with claim 1, characterized in that the web imprinted in the at least one second printing unit can be conducted, after being deflected by 90° viewed in the horizontal plane, together with a web imprinted in the at least one first printing unit, onto the first former structure arranged in the first machinery alignment.

47. The printing press system in accordance with claim 1, characterized in that a first partial web coming from one of the first and second printing press, and containing print images of printed pages of a first format, and a second partial web coming from the other of the first and second printing press, and containing print images of printed pages of a second format, are conducted onto the same former structure.

48. The printing press system in accordance with claim 47, characterized in that the first and second partial webs are of different widths.

49. The printing press system in accordance with claim 1, characterized in that an image-conveying printing group cylinder of the first printing unit supports four printed pages of a defined format side-by-side in an axial direction, and an image-conveying printing group cylinder of the second printing unit supports two printed pages of a defined format side-by-side in an axial direction.

50. The printing press system in accordance with claim 1, characterized in that an image-conveying printing group cylinder of the first printing unit supports six printed pages of a defined format side-by-side in an axial direction, and an image-conveying printing group cylinder of the second printing unit supports two printed pages of a defined format side-by-side in the axial direction.

51. The printing press system in accordance with claim 1, characterized in that an image-conveying printing group cylinder of the first printing unit supports six printed pages of a defined format side-by-side in an axial direction, and an image-conveying printing group cylinder of the second printing unit supports four printed pages of a defined format side-by-side in an axial direction.

52. The printing press system in accordance with claim 1, characterized in that an image-conveying printing group cylinder of the first printing unit supports four printed pages of a defined format side-by-side in an axial direction, and an image-conveying printing group cylinder of the second printing unit supports two printed pages of a defined format side-by-side in an axial direction.

53. The printing press system in accordance with claim 1, characterized in that an image-conveying printing group cylinder of the first printing unit supports six printed pages of a defined format side-by-side in an axial direction, and an image-conveying printing group cylinder of the second printing unit supports two printed pages of a defined format side-by-side in an axial direction.

54. The printing press system in accordance with claim 1, characterized in that an image-conveying printing group cylinder of the first printing unit supports six printed pages of a defined format side-by-side in an axial direction, and an image-conveying printing group cylinder of the second printing unit supports four printed pages of a defined format side-by-side in an axial direction.

55. The printing press system in accordance with claim 1, characterized in that an image-conveying printing group cylinder of one of the first and second printing units supports two printing formes with printed pages of a defined format in a circumferential direction, and an image-conveying printing group cylinder of the other of the first and second printing units supports one printing forme with one printed page of a defined format in a circumferential direction.

56. The printing press system in accordance with claim 55, characterized in that the printing formes and the printed pages relate to the same format.

57. The printing press system in accordance with claim 55, characterized in that the printing formes and the printed pages relate to a newspaper format.

58. The printing press system in accordance with claim 55, characterized in that the printing formes and the printed pages relate to a tabloid format.

59. The printing press system in accordance with claim 55, characterized in that the printing forms are releasable printing plates.

60. The printing press system in accordance with claim 1, characterized in that the first printing press has a superstructure and further has a longitudinal cutting arrangement and a turning arrangement for a partial-width web in the superstructure.

* * * * *